US005266456A

United States Patent [19]

Mihayashi et al.

[11] Patent Number: 5,266,456

[45] Date of Patent: * Nov. 30, 1993

[54] SILVER HALIDE COLOR PHOTOGRAPHIC MATERIAL HAVING A HIGH SILVER IODIDE CONTENT AND CONTAINING A YELLOW COLORED CYAN COUPLER

[75] Inventors: Keiji Mihayashi; Takayoshi Kamio, both of Kanagawa, Japan

[73] Assignee: Fuji Photo Film Co., Ltd., Kanagawa, Japan

[ * ] Notice: The portion of the term of this patent subsequent to May 12, 2009 has been disclaimed.

[21] Appl. No.: 675,219

[22] Filed: Mar. 26, 1991

[30] Foreign Application Priority Data

Mar. 26, 1990 [JP] Japan ..... 2-75916

[51] Int. Cl.[5] ..... G03C 7/333; G03C 7/34; G03C 1/035

[52] U.S. Cl. ..... 430/551; 430/359; 430/549; 430/553; 430/567

[58] Field of Search ..... 430/567, 553, 559, 549, 430/560, 561, 562, 359, 504, 551

[56] References Cited

U.S. PATENT DOCUMENTS

| | | | |
|---|---|---|---|
| 3,615,602 | 10/1971 | Credner et al. | 430/359 |
| 4,294,900 | 10/1981 | Aono | 430/549 |
| 4,439,513 | 3/1984 | Sato et al. | 430/562 |
| 4,668,614 | 5/1987 | Takada et al. | 430/599 |
| 5,064,753 | 11/1991 | Sohei et al. | 430/567 |
| 5,075,207 | 12/1991 | Langen et al. | 430/549 |
| 5,112,730 | 5/1992 | Ohkawa et al. | 430/553 |

FOREIGN PATENT DOCUMENTS

| | | | |
|---|---|---|---|
| 0173302 | 3/1986 | European Pat. Off. | 430/559 |
| 337370A3 | 10/1989 | European Pat. Off. . | |
| 3815469 | 11/1989 | Fed. Rep. of Germany . | |
| 221748 | 10/1986 | Japan . | |
| 3304242 | 12/1988 | Japan . | |

OTHER PUBLICATIONS

Derwent Abstract of JPA 61-221748, Oct. 2, 1986.

European Search Report 91 10 4775, Jun. 18, 1991, S. Magrizos, The Hague.

*Primary Examiner*—Lee C. Wright

*Attorney, Agent, or Firm*—Sughrue, Mion, Zinn, Macpeak & Seas

[57] ABSTRACT

Disclosed is a silver halide color photographic material containing a silver halide emulsion having a high silver iodide content and containing a novel yellow colored cyan coupler. The material has a high sensitivity, a good graininess, an excellent color reproducibility and a sufficient sharpness. The material has at least one light-sensitive emulsion layer on a support and is characterized in that it contains at least one yellow colored cyan coupler, that the emulsion layer contains chemically sensitized silver halide grains, and that the chemically sensitized silver halide grain in the emulsion has a silver iodobromide phase with a silver iodide content of from 15 to 45 mol % as a distinctly layered structure and has a silver iodide content of more than 7 mol % based on the whole grain.

13 Claims, No Drawings

SILVER HALIDE COLOR PHOTOGRAPHIC MATERIAL HAVING A HIGH SILVER IODIDE CONTENT AND CONTAINING A YELLOW COLORED CYAN COUPLER

FIELD OF THE INVENTION

The present invention relates to a silver halide color photographic material and, in particular, to one which contains a silver halide emulsion having a high silver iodide content and contains a novel yellow colored cyan coupler. The photographic material of the present invention has a high sensitivity, a good graininess, an excellent color reproducibility and a sufficient sharpness.

BACKGROUND OF THE INVENTION

Silver halide color photographic materials are desired which have a high sensitivity, a good graininess, a good color reproducibility and a good sharpness.

For the purpose of improving the color reproducibility, JP-A-61-221748 and JP-A-1-319744 have proposed incorporation of a yellow colored cyan coupler into a photographic material. (The term "JP-A" as used herein means an "unexamined published Japanese patent application".) However, the photographic material containing the proposed yellow colored cyan coupler has been found to have an insufficient graininess.

A photographic material having silver halide grains, in which the grain has a distinct layered structure of a phase having a high silver iodide content and has a high mean silver iodide content, has been proposed in JP-A-60-143331, JP-A-1-186938, JP-A-1-269935 and JP-A-2-28637. The proposed photographic material has a high sensitivity and a good graininess. However, the material has been found to be inferior to any other photographic material containing a low silver iodide content emulsion with respect to the sharpness and the color reproducibility.

SUMMARY OF THE INVENTION

The object of the present invention is to provide a photographic material having a high sensitivity and having good graininess, sharpness and color-reproducibility.

The object of the present invention has been attained by a silver halide color photographic material having at least one light-sensitive emulsion layer on a support. The material contains at least one yellow colored cyan coupler. The emulsion layer contains chemically sensitized silver halide grains. And the chemically sensitized silver halide grains in the emulsion have a silver iodobromide phase with a silver iodide content of from 15 to 45 mol % as a distinct layered structure and have a mean silver iodide content of more than 7 mol % based on the whole grain.

DETAILED DESCRIPTION OF THE INVENTION

The photographic material of the present invention contains at least one yellow colored cyan coupler, which will be explained in detail hereunder.

That yellow colored cyan coupler is a cyan coupler which has an absorption maximum between 400 nm and 500 nm in the visible absorption range of the coupler and which couples with the oxidation product of an aromatic primary amine developing agent to form a cyan dye having an absorption maximum between 630 nm and 750 nm in the visible absorption range.

Preferrable are yellow colored cyan couplers which react with the oxidation product of an aromatic primary amine developing agent by a coupling reaction to release a compound residue containing a water-soluble 6-hydroxy-2-pyridon-5-ylazo group, a water-soluble pyrazolon-4-ylazo group, a water-soluble 2-acylaminophenylazo group, a water-soluble 5-aminopyrazol-4-ylazo group or a water-soluble 2-sulfonamidophenylazo group.

Specifically, the preferred colored cyan couplers of the present invention are those of the following general formulae (CI) to (CIV):

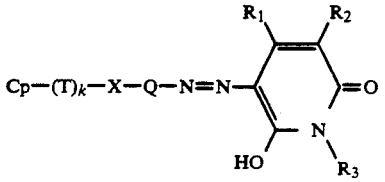

(CI)

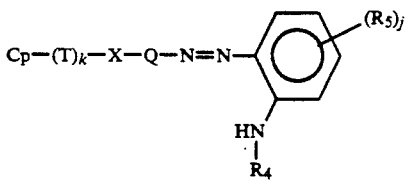

(CII)

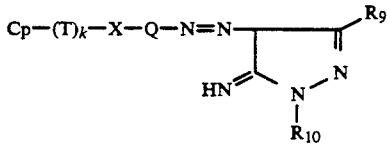

(CIII)

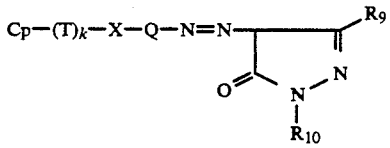

(CIV)

In formulae (CI) to (CIV), Cp represents a cyan coupler residue where T is bonded to the coupling position of the residue; T represents a timing group; k represents an integer of 0 or 1; X represents a divalent linking group which contains a N, O or S atom and which is bonded to $(T)_k$ via that N, O or S atom to link $(T)_k$ and Q; and Q represents an arylene group or a divalent heterocyclic group.

In formula (CI), $R_1$ and $R_2$ independently represent a hydrogen atom, a carboxyl group, a sulfo group, a cyano group, an alkyl group, a cycloalkyl group, an aryl group, a heterocyclic group, a carbamoyl group, a sulfamoyl group, a carbonamido group, a sulfonamido group or an sulfonyl group; and $R_3$ represents a hydrogen atom, an alkyl group, a cycloalkyl group, an aryl group or a heterocyclic group; provided that at least one of T, X, Q, $R_1$, $R_2$ and $R_3$ contains a water-soluble group (for example, hydroxyl, carboxyl, sulfo, amino ammoniumyl, phosphono, phosphino, hydroxysulfonyloxy).

It is well known that the moiety of

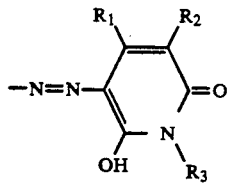

in formula (CI) may have the following tautomeric structures which are within the scope of the structure of formula (CI) as defined in the present invention:

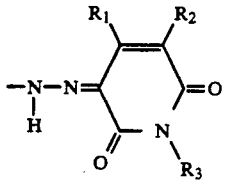

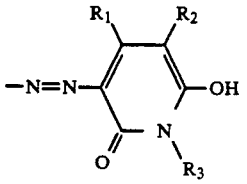

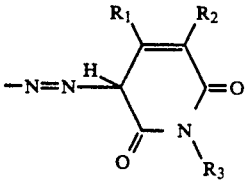

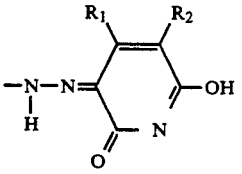

($R_3$=H)

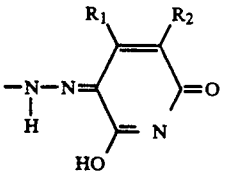

($R_3$=H)

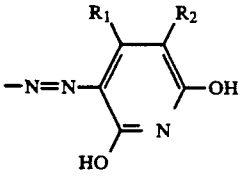

($R_3$=H)

-continued

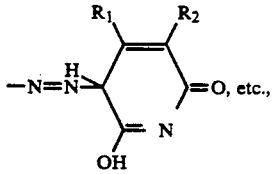

($R_3$=H)

In formula (CII), $R_4$ represents an acyl group or a sulfonyl group; $R_5$ represents a substitutable group; and j represents an integer of from 0 to 4. When j is an integer of 2 or more, the plurality of $R_4$ groups may be same or different. In formula (CII), at least one of T, X, Q, $R_4$ and $R_5$ contains a water-soluble group (for example, hydroxyl, carboxyl, sulfo, phosphono, phosphino, hydroxysulfonyloxy, amino, ammoniumyl).

In formulae (CIII) and (CIV), $R_9$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, a sulfamoyl group, a carbonamido group, a sulfonamido group, or an alkylsulfonyl group; and $R_{10}$ represents a hydrogen atom, an alkyl group, a cycloalkyl group, an aryl group, or a heterocyclic group. However, at least one of T, X, Q, $R_9$ and $R_{10}$ contains a water-soluble group (for example, hydroxyl, carboxyl, sulfo, phosphono, phosphino, hydroxysulfonyloxy, amino, ammoniumyl. In formula (CIII), the moiety of

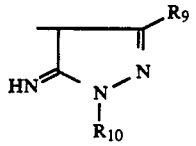

and the moiety of

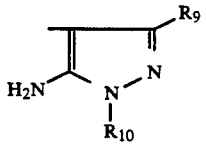

are in a relationship of tautomers and are the same compound.

Next, the compounds of formulae (CI) to (CIV) will be explained in more detail hereunder.

The coupler residue to be represented by Cp may be any known cyan coupler residue (for example, phenol cyan coupler residue or naphthol cyan coupler residue).

The coupler residues of the following general formulae (Cp-6), (Cp-7) and (Cp-8) are preferred examples of Cp:

(Cp-6):

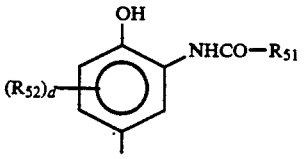

-continued (Cp-7):

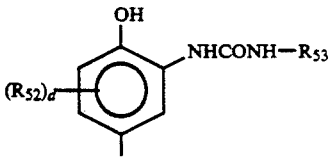

(Cp-8):

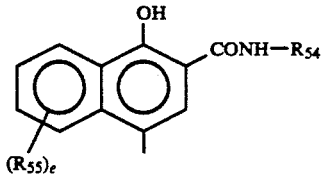

In the above-mentioned formulae, the free bond as derived from the coupling position is the position to which the coupling split-off group, T or X group, is bonded.

In these formulae, where $R_{51}$, $R_{52}$, $R_{53}$, $R_{54}$ or $R_{55}$ contains a non-diffusive group, the group has a total carbon number of from 8 to 40, preferably 10 to 30. Where the Cp does not contain a non-diffusive group, the total carbon number of the group is preferably 15 or less. Where the couplers of the above-mentioned formulae are bis-type, telomer-type or polymer type couplers, anyone of the above-mentioned $R_{51}$, $R_{52}$, $R_{53}$, $R_{54}$ and $R_{55}$ substituents is a divalent group which is bonded to a repeating Cp unit or the like. In that case, the above-defined limitation of the total carbon number of the substituent does not apply.

Next, $R_{51}$, $R_{52}$, $R_{53}$, $R_{54}$ d and e will be explained in detail. In the following explanation, $R_{41}$ represents an aliphatic group, an aromatic group or a heterocyclic group; $R_{42}$ represents an aromatic group or a heterocyclic group; and $R_{43}$, $R_{44}$, and $R_{45}$ each represents a hydrogen atom, an aliphatic group, an aromatic group or a heterocyclic group.

$R_{51}$ has the same meaning as $R_{42}$. $R_{52}$ has the same meaning as $R_{41}$, or represents $$R_{41}\underset{\underset{R_{43}}{|}}{CON}-,\ R_{41}O\underset{\underset{R_{43}}{|}}{CON}-,\ R_{41}CONH-,$$

$$R_{41}SO_2\underset{\underset{R_{43}}{|}}{N}-,\ R_{43}\underset{\underset{R_{44}}{|}}{N}CO-\underset{\underset{R_{45}}{|}}{N}-,\ R_{41}O-,\ R_{41}S-,$$

a halogen atom, or $$R_{41}\underset{\underset{R_{43}}{|}}{N}-.$$

The letter d represents a number from 0 to 3. When d is a plural number, the plurality of $R_{52}$ groups may be the same or different substituents. The $R_{52}$ groups may be bonded to each other as divalent groups to form a cyclic structure. As examples of divalent groups for forming that cyclic structure,

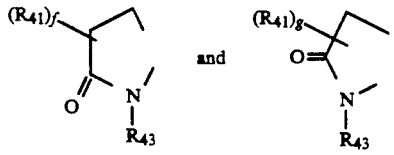

are typical, where f represents an integer of from 0 to 4; and g represents an integer of from 0 to 2. $R_{53}$ has the same meaning as $R_{41}$. $R_{54}$ has the same meaning as $R_{41}$. $R_{55}$ has the same meaning as $R_{41}$ or represents $R_{41}CONH-$, $R_{41}OCONH-$, $R_{41}SO_2NH-$, $$R_{43}\underset{\underset{R_{44}}{|}}{N}-CO-\underset{\underset{R_{45}}{|}}{N}-,\ R_{43}\underset{\underset{R_{44}}{|}}{N}-SO_2-\underset{\underset{R_{45}}{|}}{N}-,$$

$R_{43}O-$, $R_{41}S-$, a halogen atom, or $$R_{41}\underset{\underset{R_{43}}{|}}{N}-.$$

Where the formula (Cp-8) has a plurality of $R_{55}$ groups, they may be the same or different.

In the above-mentioned (Cp-6), (Cp-7) and (Cp-8) formulae, the aliphatic group is a saturated or unsaturated, linear, cyclic or branched, substituted or unsubstituted aliphatic hydrocarbon group having from 1 to 32 carbon atoms, preferably from 1 to 22 carbon atoms. Specific examples of the aliphatic group are methyl, ethyl, propyl, isopropyl, butyl, (t)-butyl, (i)-butyl, (t)-amyl, hexyl, cyclohexyl, 2-ethylhexyl, octyl, 1,1,3,3-tetramethylbutyl, decyl, dodecyl, hexadecyl and octadecyl group.

The aromatic group includes a substituted or unsubstituted phenyl group and a substituted or unsubstituted naphthyl group having from 6 to 20 carbon atoms.

The heterocyclic group is a 3-membered to 8-membered substituted or unsubstituted heterocyclic group, having from 1 to 20 carbon atoms, preferably from 1 to 7 carbon atoms, and having one or more hetero atoms selected from nitrogen, oxygen and sulfur atoms. Specific examples of the heterocyclic group are 2-pyridyl, 2-thienyl, 2-furyl, 1,3,4-thiadiazol-2-yl, 2,4-dioxo-1,3-imidazolidin-5-yl, 1,2,4-triazol-2-yl and 1-pyrazolyl groups.

The above-mentioned aliphatic hydrocarbon group, aromatic group and heterocyclic group may be substituted. Specific examples of substituents for the group are a halogen atom, $$R_{47}O-,\ R_{48}S-,\ R_{47}\underset{\underset{R_{48}}{|}}{CON}-,\ R_{47}\underset{\underset{R_{48}}{|}}{N}CO-,$$

$$R_{46}O\underset{\underset{R_{47}}{|}}{CON}-,\ R_{46}SO_2\underset{\underset{R_{47}}{|}}{N}-,\ R_{47}\underset{\underset{R_{48}}{|}}{N}SO_2-,$$

$$R_{46}SO_2-,\ R_{47}OCO-,\ R_{47}\underset{\underset{R_{48}}{|}}{N}-CO-\underset{\underset{R_{49}}{|}}{N}-,\ R_{46}-,$$

-continued

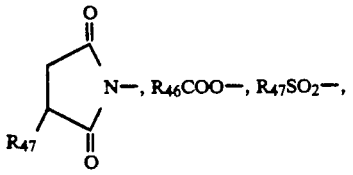

group and a nitro group. $R_{46}$ represents an aliphatic group, an aromatic group or a heterocyclic group; and $R_{47}$, $R_{48}$ and $R_{49}$ each represents an aliphatic group, an aromatic group, a heterocyclic group, or a hydrogen atom. The meanings of the aliphatic group, aromatic group and heterocyclic group are same as those defined above.

In formula (Cp-6), $R_{51}$ is preferably an aliphatic group or an aromatic group. In formula (Cp-6), $R_{52}$ is preferably a chlorine atom, an aliphatic group or $R_{41}CONH$—. The letter d is preferably 1 or 2. In (Cp-7) $R_{53}$ is preferably an aromatic group. In formula (Cp-7), $R_{52}$ is preferably $R_{41}CONH$—. In formula (Cp-7), d is preferably 1. In formula (Cp-8), e is preferably 0 or 1. $R_{55}$ is preferably $R_{41}OCONH$—, $R_{41}CONH$— or $R_{41}SO_2NH$—, which is preferably bonded to the 5-position of the naphthol ring.

The timing group represented by T is cleaved from X after the bond between Cp and T has been cleaved by the coupling reaction between the coupler of Cp and the oxidation product of an aromatic primary amine developing agent. The group of T has the function of adjusting the coupling reactivity, stabilizing the coupler moiety and adjusting the timing of the release of the moiety X and the group bonding to X. The following known groups are examples of T. The symbol (*) indicates the position which bonds to Cp and (**) the position which bonds to X.

(T-1)

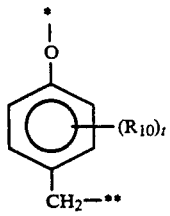

(T-2)

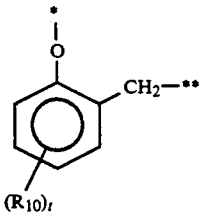

(T-3)

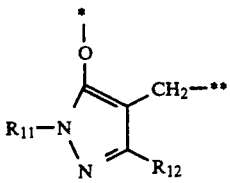

-continued (T-4)

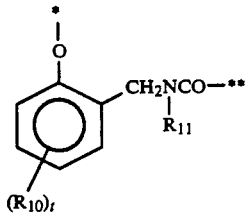

(T-5)

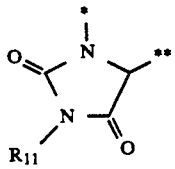

(T-6)

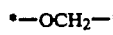

(T-7)

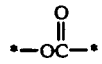

In these formulae, $R_{10}$ represents a group substituted on the benzene ring; $R_{11}$ has the same meaning as $R_{41}$; $R_{12}$ represents a hydrogen atom or a substituent; and t represents an integer of from 0 to 4. Examples of substituents to be represented by $R_{10}$ and $R_{12}$, include $R_{41}$, a halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N(R_{43})$—$R_{43}CO$—, $R_{41}COO$—, $R_{41}SO$—, a nitro group, $R_{43}(R_{44})NCON(R_{45})$—, a cyano group, $R_{41}OCON(R_{43})$—, $R_{43}OSO_2$—, $R_{43}(R_{44})N$—, $R_{43}(R_{44})NSO_2N(R_{45})$—,

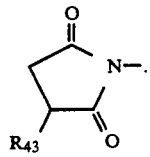

The letter k represents an integer of 0 or 1. In general, k is preferably 0, or that is, Cp and X are preferably bonded to each other directly.

X represents a divalent linking group, which is bonded to $(T)_k$ and the preceding residue Cp via a N, O or S atom in X.

It is preferably —O—, —S—,

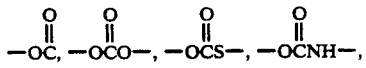

$—OSO_2$— or $—OSO_2NH$—, or a heterocyclic group which is bonded to $(T)_k$ and the preceding residue Cp via a nitrogen atom (for example, a residue derived from pyrrolidine, piperidine, morpholine, piperazine, pyrrole, pyrazole, imidazole, 1,2,4-triazole, benzotriazole, succinimide, phthalimide, oxazolidine-2,4-dione, imidazolidine-2,4-dione, or 1,2,4-triazolidine-3,5-dione), or a composite linking group which is composed of any of the above-mentioned groups and an alkylene group (for example, methylene, ethylene, propylene), a cycloalkylene group (for example, 1,4-cyclohexylene), an arylene group (for example, o-phenylene, p-phenylene), a divalent heterocyclic group (for example, a residue to be derived from pyridine or thiophene), —CO—, $-SO_2$—, —COO—, —CONH—, $—SO_2NH$—, —SO- $_2O$—NHCO—, —$NHSO_2$—, —NHCONH—, —NH-$SO_2NH$—, or —NHCOO—. X is more preferably a group represented by general formula (II):

$$*-X_1-(L-X_2)_m-** \quad \text{(II)}$$

In formula (II), (*) indicates the position at which the formula is bonded to $(T)_k$ and the preceding group; (**) indicates the position at which the formula is bonded to Q and the following group; $X_1$ represents —O— or —S—; L represents an alkylene group; and $X_2$ represents a single bond,

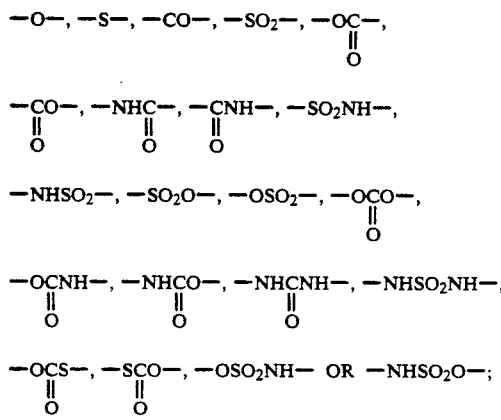

and m represents an integer of from 0 to 3. Preferably, X has a total carbon number (hereinafter referred to as a "C-number") of from 0 to 12, more preferably from 0 to 8. X is most preferably —$OCH_2CH_2O$—.

Q represents an arylene group or a divalent heterocyclic group. Where Q is an arylene group, the arylene group may be in the form of a condensed ring or may have one or more substituents (for example, those selected from the group consisting of a halogen atom, a hydroxyl group, a carboxyl group, a sulfo group, a nitro group, a cyano group, an amino group, an ammonium group, a phosphono group, a phosphino group, an alkyl group, a cycloalkyl group, an aryl group, a carbonamido group, a sulfonamido group, an alkoxy group, an aryloxy group, an acyl group, a sulfonyl group, a carboxyl group, a carbamoyl group and a sulfamoyl group). The arylene group preferably has a C-number of from 6 to 15, more preferably from 6 to 10.

Where Q is a divalent heterocyclic group, the group is a 3-membered to 8-membered, preferably 5-membered to 7-membered, monocyclic or condensed cyclic heterocyclic group having at least one hetero atom selected from the group consisting of N, O, S, P, Se and Te in the ring, for example, a residue derived from pyridine, thiophene, furan, pyrrole, pyrazole, imidazole, thiazole, benzothiazole, benzoxazole, benzofuran, benzothiophene, 1,3,4-thiadiazole, indole or quinoline. It may have one or more substituents. Examples of substituents to be on the heterocyclic group, include those of the above-mentioned arylene group. Preferably the heterocyclic group has a C-number of from 2 to 15, more preferably from 2 to 10. Most preferably, Q is

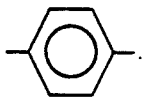

Accordingly, —$(T)_k$—X—Q— is most preferably

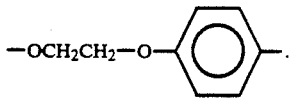

Where $R_1$, $R_2$ or $R_3$ is an alkyl group, the group may be linear or branched, and it may contain one or more unsaturated bonds, and it may have one or more substituents. Examples of substituents on the group include a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbon amido group, a sulfonamido group, a carbamoyl group, a sulfamoyl group and a sulfonyl group.

The carboxyl group referred to herein includes a carboxylate group; the sulfo group, a sulfonato group; the phosphino group, a phosphinato group; and the phosphono group, a phosphonato group; along with a pair ion of $Li^+$, $Na^+$, $K^+$ or ammonium.

Where $R_1$, $R_2$ or $R_3$ is a cycloalkyl group, the group is a 3-membered to 8-membered cycloalkyl group and may contain one or more crosslinked groups and/or one or more unsaturated bonds. It may also have substituents. Examples of one or more substituents on the group include the above-mentioned alkyl group.

Where $R_1$, $R_2$ or $R_3$ is an aryl group, the group may be in the form of a condensed ring or it may have one or more substituents. Examples of substituents on the group include an alkyl group and a cycloalkyl group in addition to the substituents for the above-mentioned alkyl group.

Where $R_1$, $R_2$ or $R_3$ is a heterocyclic group, the group is a 3-membered to 8-membered (preferably, 5-membered to 7-membered) monocyclic or condensed cyclic heterocyclic group having at least one hetero atom selected from the group consisting of N, S, O, P, Se and Te in the ring, for example, an imidazolyl, thienyl, pyrazolyl, thiazolyl, pyridyl or quinolyl group. It may have one or more substituents. Examples of substituents to be on the group include the above-mentioned aryl group are referred to.

$R_1$ is preferably a hydrogen atom, a carboxyl group, an alkyl group having from 1 to 10 carbon atoms (e.g., methyl, t-butyl, carbomethyl, 2-sulfomethyl, carboxymethyl, 2-carboxyethyl, 2-hydroxyethyl, benzyl, ethyl, isopropyl), or an aryl group having from 6 to 12 carbon atoms (e.g., phenyl, 4-methoxyphenyl, 4-sulfophenyl). Especially preferably, $R_1$ is a hydrogen atom, a methyl group, or a carboxyl group.

$R_2$ is preferably a cyano group, a carboxyl group, a carbamoyl group having from 1 to 10 carbon atoms, a sulfamoyl group having from 0 to 10 carbon atoms, a sulfo group, an alkyl group having from 1 to 10 carbon atoms (e.g., methyl, sulfomethyl), a sulfonyl group having from 1 to 10 carbon atoms (e.g., methylsulfonyl, phenylsulfonyl), a carbonamido group having from 1 to 10 carbon atoms (e.g., acetamido, benzamido), or a sulfonamido group having from 1 to 10 carbon atoms (e.g., methanesulfonamido, toluenesulfonamido). Especially preferably, $R_2$ is a cyano group, carbamoyl group or a carboxyl group.

$R_3$ is preferably a hydrogen atom, an alkyl group having from 1 to 12 carbon atoms (e.g., methyl, sulfomethyl, carboxymethyl, 2-sulfomethyl, 2-carboxymethyl, ethyl, n-butyl, benzyl, 4-sulfobenzyl), or an aryl group having from 6 to 15 carbon atoms (e.g., phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, 2,5-disulfophenyl). More preferably, it is an alkyl group having from 1 to 7 carbon atoms, or an aryl group having from 6 to 10 carbon atoms.

$R_4$ is an acyl group of the following general formula (III), or a sulfonyl group of the following general formula (IV):

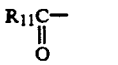

(III)

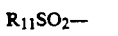

(IV)

$R_{11}$ may be an alkyl group, a cycloalkyl group, an aryl group or a heterocyclic group.

Where $R_{11}$ is an alkyl group, the group may be either linear or branched, or it may contain one or more unsaturated bonds, or it may have one or more substituents. Examples of substituents on the group include a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamido group, a sulfonamido group, a carbamoyl group, a sulfamoyl group and a sulfonyl group.

The carboxyl group as referred to herein includes a carboxylate group; the sulfo group, a sulfonato group; the phosphino group, a phosphinato group; and the phosphono group, a phosphonato group; along with a pair ion of $Li^+$, $Na^+$, $K^+$ or ammonium.

Where $R_{11}$ is a cycloalkyl group, the group is a 3-membered to 8-membered cycloalkyl group and may contain one or more crosslinked groups and/or one or more unsaturated bonds. It may also have one or more substituents. Examples of substituents on the group include those for the above-mentioned alkyl group.

Where $R_{11}$ is an aryl group, the group may be in the form of a condensed ring or it may have one or more substituents. Examples of substituents on the group include an alkyl group and a cycloalkyl group in addition to the substituents for the above-mentioned alkyl group of $R_{11}$.

Where $R_{11}$ is a heterocyclic group, the group is a 3-membered to 8-membered (preferably, 5-membered to 7-membered) monocyclic or condensed cyclic heterocyclic group having at least one hetero atom selected from the group consisting of N, S, O, P, Se and Te in the ring, for example, an imidazolyl, thienyl, pyrazolyl, thiazolyl, pyridyl or quinolyl group. It may have one or more substituents. Examples of substituents to be on the group include those for the above-mentioned aryl group.

$R_{11}$ is preferably an alkyl group having from 1 to 10 carbon atoms (e.g., methyl, carboxymethyl, sulfoethyl, cyanoethyl), a cycloalkyl group having from 5 to 8 carbon atoms (e.g., cyclohexyl, 2-carboxycyclohexyl), or an aryl group having from 6 to 10 carbon atoms (e.g., phenyl, 1-naphthyl, 4-sulfophenyl). Especially preferably, it is an alkyl group having from 1 to 3 carbon atoms, or an aryl group having 6 carbon atoms.

$R_5$ (CII) is a substitutable group, preferably an electron-donating group, especially preferably $—NR_{12}R_{13}$ or $—OR_{14}$. The position of $R_5$ in the formula is preferably the 4-position. $R_{12}$, $R_{13}$ and $R_{14}$ each represents a hydrogen atom, an alkyl group, a cycloalkyl group, an aryl group or a heterocyclic group. $R_{12}$ and $R_{13}$ may form a nitrogen-containing hetero ring, which is preferably alicyclic.

The letter j represents an integer of from 0 to 4, and it is preferably 1 or 2, especially preferably 1.

Where $R_9$ or $R_{10}$ is an alkyl group, the group may be linear or branched, and it may contain one or more unsaturated bonds, and it may have one or more substituents. Examples of substituents on the group include a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamido group, a sulfonamido group, a carbamoyl group, a sulfamoyl group and a sulfonyl group.

The carboxyl group as referred to herein includes a carboxylato group; the sulfo group, a sulfonato group; the phosphino group, a phosphinato group; and the phosphono group, a phosphonato group; along with a pair ion of $Li^+$, $Na^+$, $K^+$ or ammonium.

Where $R_9$ or $R_{10}$ is a cycloalkyl group, the group is a 3-membered to 8-membered cycloalkyl group and may contain one or more crosslinked groups and/or one or more unsaturated bonds. It may also have one or more substituents. Examples of substituents on the group include those for the above-mentioned alkyl group.

Where $R_9$ or $R_{10}$ is an aryl group, the group may be in the form of a condensed ring or it may have one or more substituents. Examples of substituents on the group include an alkyl group and a cycloalkyl group in addition to the substituents for the above-mentioned alkyl group of $R_9$ or $R_{10}$.

Where $R_9$ or $R_{10}$ is a heterocyclic group, the group is a 3-membered to 8-membered (preferably, 5-membered to 7-membered) monocyclic or condensed cyclic heterocyclic group having at least one hetero atom selected from the group consisting of N, S, O, P, Se and Te in the ring, for example, an imidazolyl, thienyl, pyrazolyl, thiazolyl, pyridyl or quinolyl group. It may have one or more substituents. Examples of substituents to be on the group include those for the above-mentioned aryl group.

$R_9$ is preferably a cyano group, a carboxyl group, a carbamoyl group having from 1 to 10 carbon atoms, an alkoxycarbonyl group having from 2 to 10 carbon atoms, an aryloxycarbonyl group having from 7 to 11 carbon atoms, a sulfamoyl group having from 0 to 10 carbon atoms, a sulfo group, an alkyl group having from 1 to 10 carbon atoms (e.g., methyl, carboxymethyl, sulfomethyl), a sulfonyl group having from 1 to 10 carbon atoms (e.g., methylsulfonyl, phenylsulfonyl), a carbonamido group having from 1 to 10 carbon atoms (e.g., acetamido, benzamido), a sulfonamido group having from 1 to 10 carbon atoms (e.g., methanesulfonamido, toluenesulfonamido), an alkyloxy group (e.g., methoxy, ethoxy), or an aryloxy group (e.g., phenoxy). Especially preferably, $R_9$ is a cyano group, a carbamoyl group, an alkoxycarbonyl group, or a carboxyl group.

$R_{10}$ is preferably a hydrogen atom, an alkyl group having from 1 to 12 carbon atoms (e.g., methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl, 4-sulfobenzyl), or an aryl group having from 6 to 15 carbon atoms (e.g., phenyl, 4-carboxyphenyl, 3-carboxyphenyl, 2,4-dicarboxyphenyl, 4-sulfophenyl, 3-sulfophenyl, 2,5-disulfophenyl, 2,4-disulfophenyl). More preferably, it is an alkyl group having from 1 to 7 carbon atoms, or an aryl group having from 6 to 10 carbon atoms.

Specific examples of Cp, X, Q,

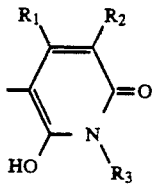

-continued

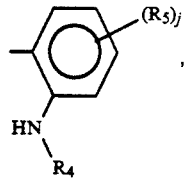

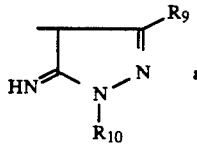

and

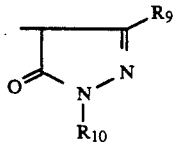

are mentioned below.

Examples of Cp:

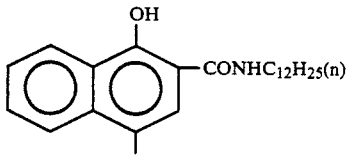

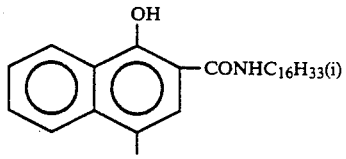

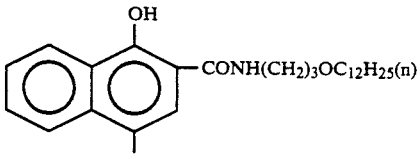

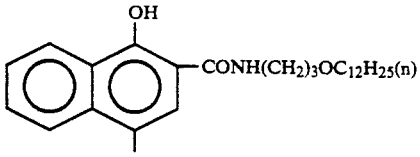

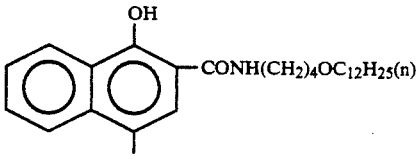

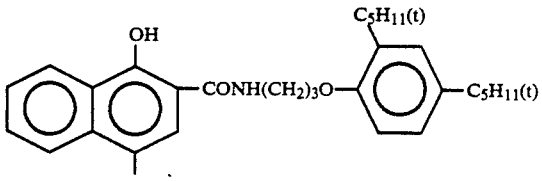

-continued
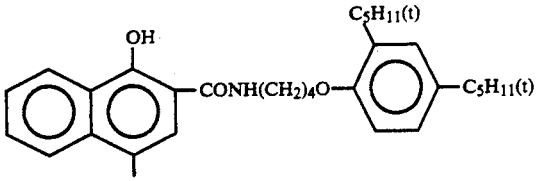
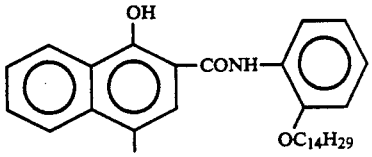
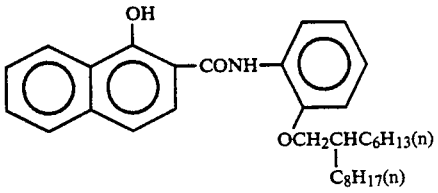
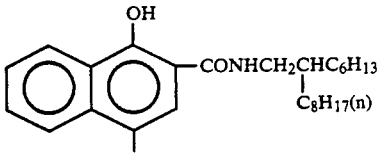
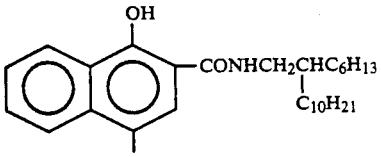
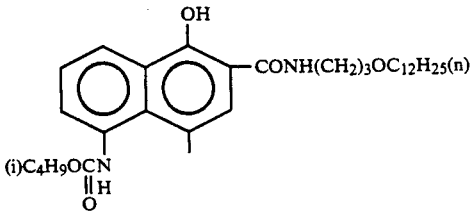
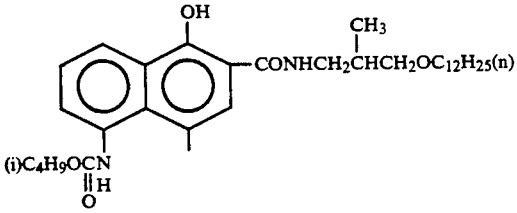
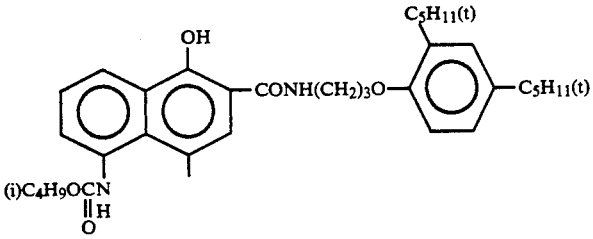

-continued
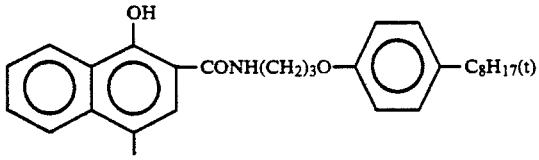
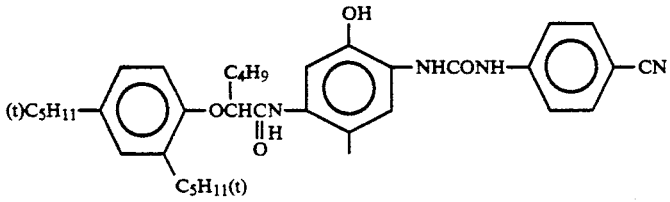
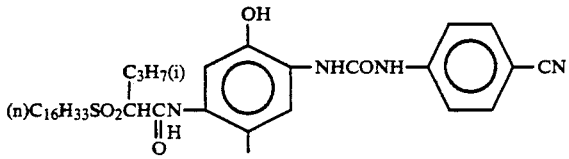
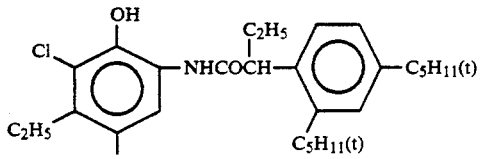
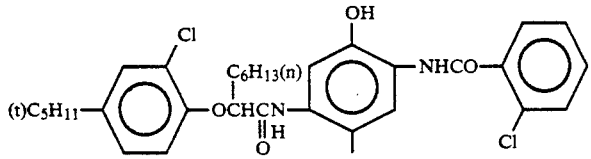
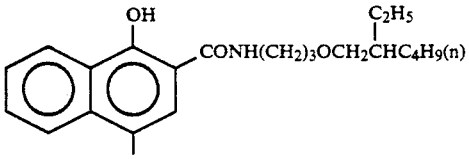
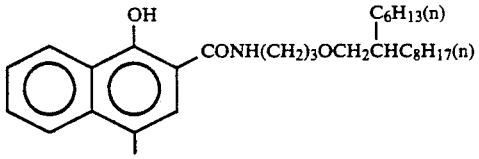
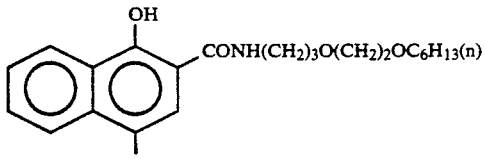
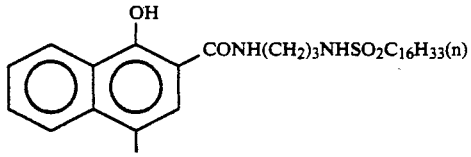

-continued

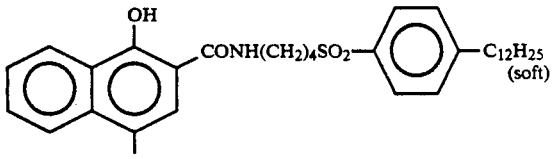

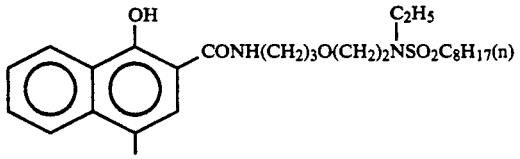

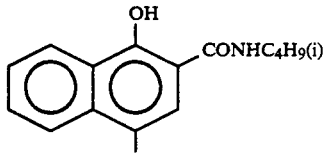

Examples of X:

$-O-$, $-S-$, $-OCH_2-$, $-OCH_2CH_2-$, $-OCH_2CH_2O-$, $-OCH_2CH_2CH_2O-$, $-O(CH_2CH_2O)_2-$, $-OCH_2CH_2S-$, $-OCH_2CH_2NHCO-$, $-OCH_2CH_2NHSO_2-$, $-OCH_2CH_2SO_2-$, $-OCH_2CH_2OCO-$, $-OCH_2CH_2CO-$, $-SCH_2CONH-$, $-SCH_2COO-$, $-O\underset{\underset{CH_3}{|}}{C}HCONH-$, $-OCH_2CH_2OSO_2-$, $-OCO-$, $-OCH_2\underset{\underset{CO_2H}{|}}{C}H-$, $-OCH_2\underset{\underset{CO_2H}{|}}{C}HCH_2-$, $-OCH_2\underset{\underset{CO_2H}{|}}{C}HO-$, $-O\underset{\underset{CO_2H}{|}}{C}HCH_2O-$, $-OCH_2\underset{\underset{CO_2H}{|}}{C}HS-$, $-OCH_2\underset{\underset{SO_3Na}{|}}{C}HO-$, Examples of Q:

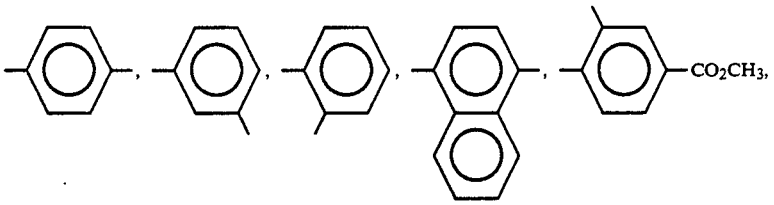

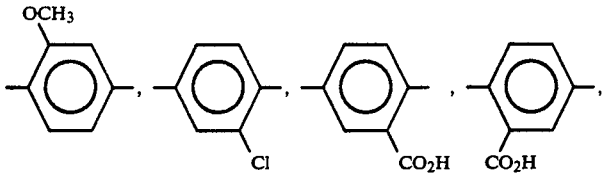

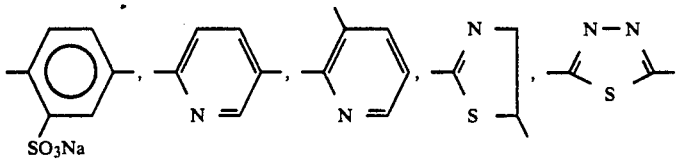

-continued
Examples of 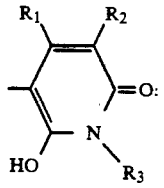
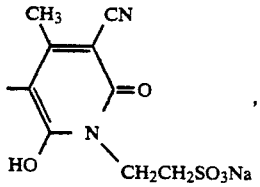
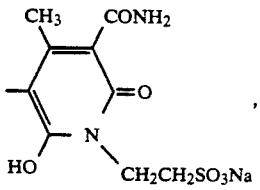
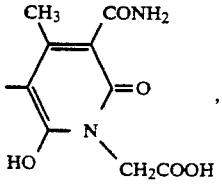
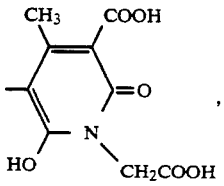
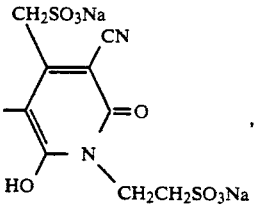
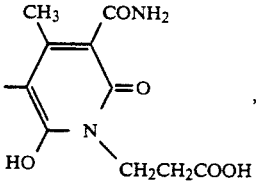
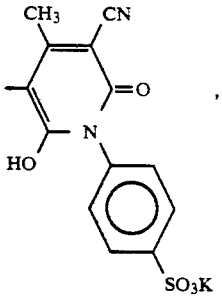
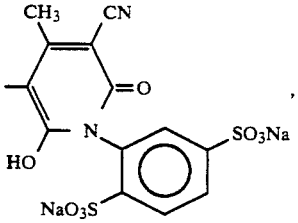
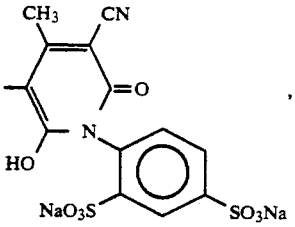
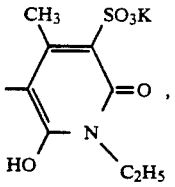
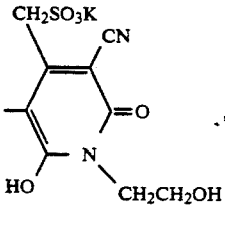
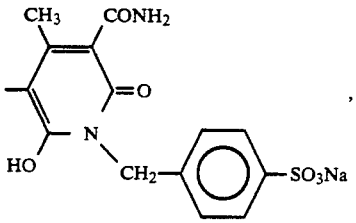

-continued
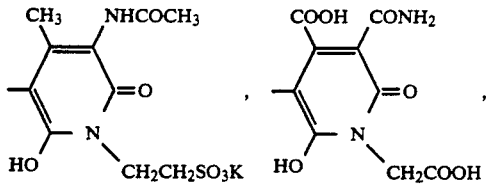
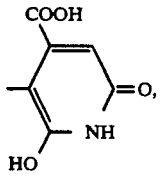
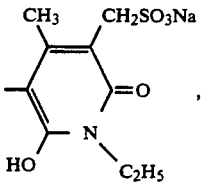
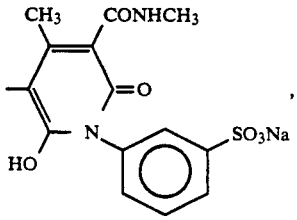
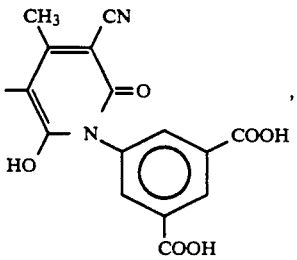
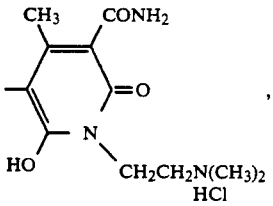
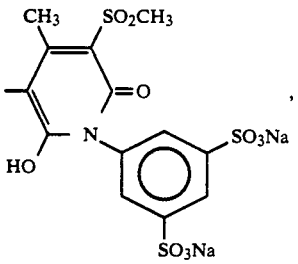
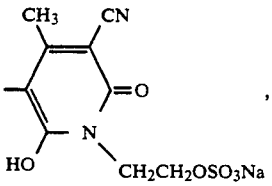
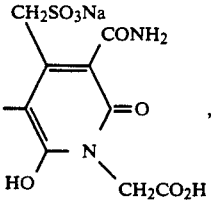
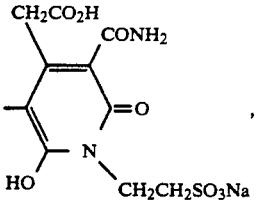
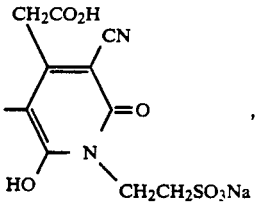
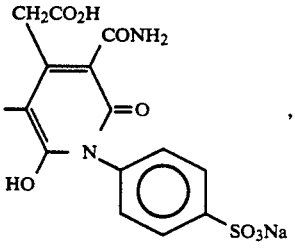
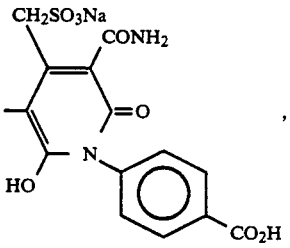

-continued
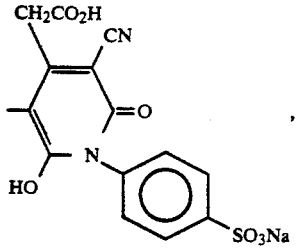
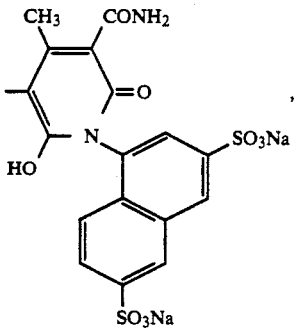
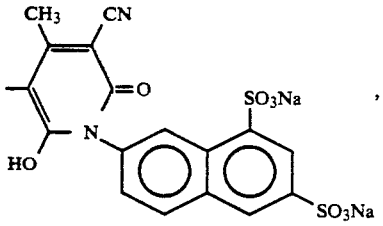
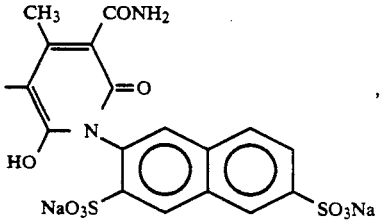
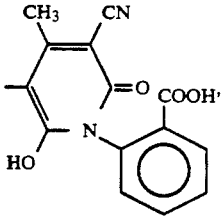
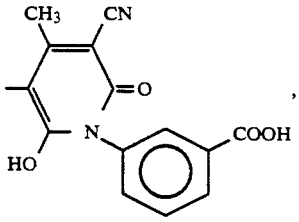
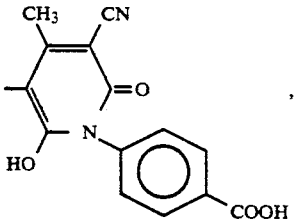
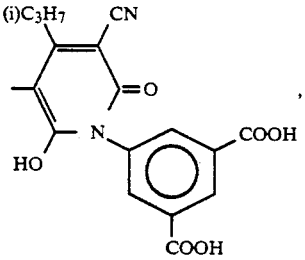
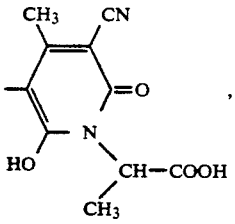
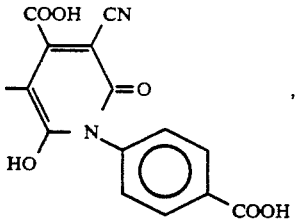
Examples of 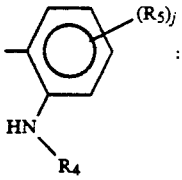 :
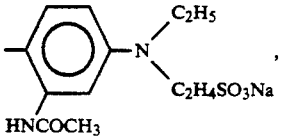
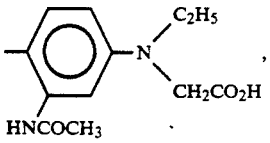

-continued
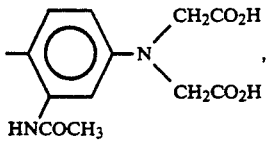
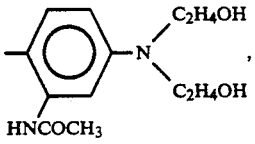
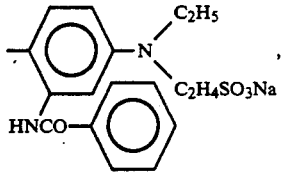
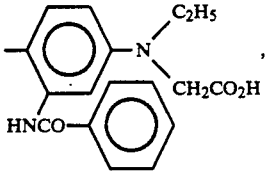
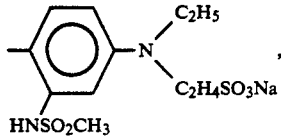
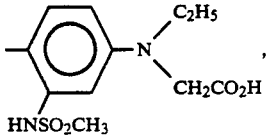
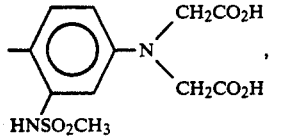
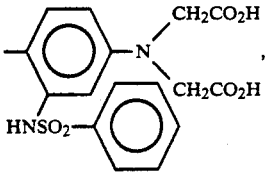
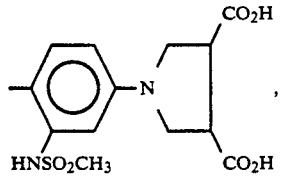
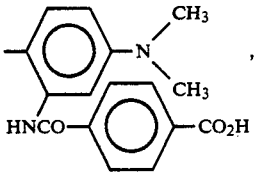
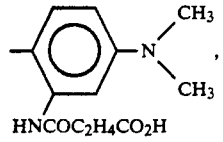
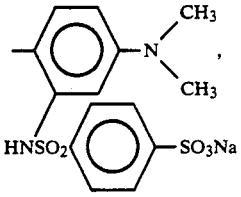
Examples of 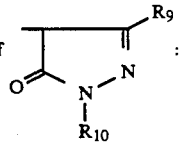 :
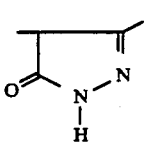
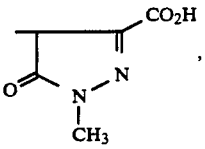
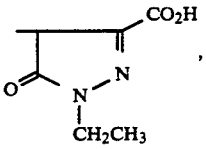
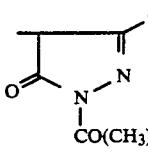
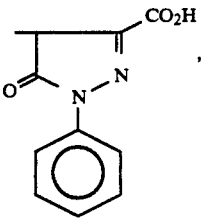
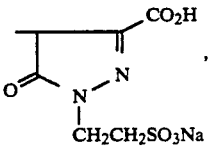

-continued
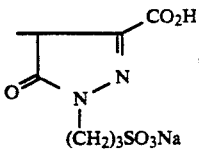
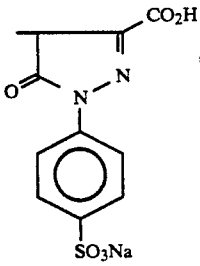
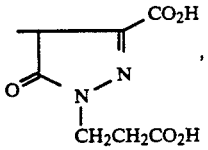
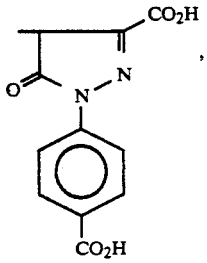
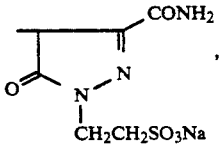
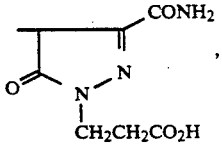
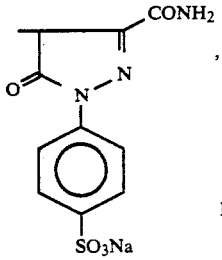
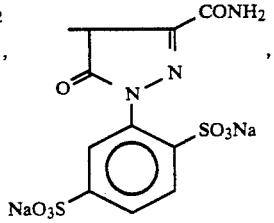
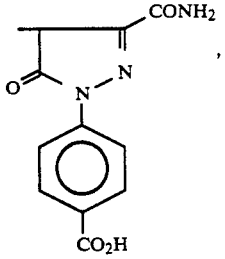
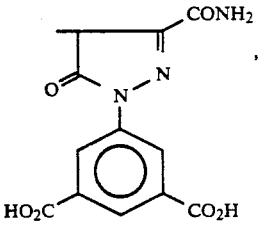
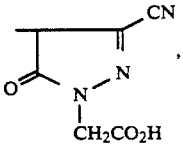
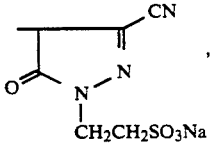
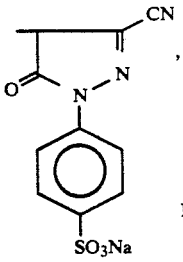
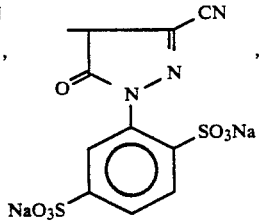
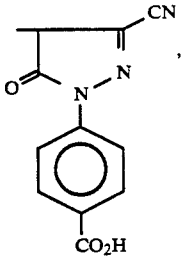
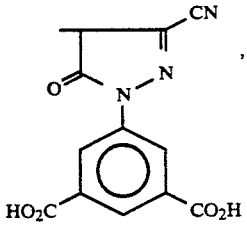
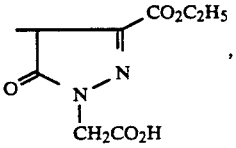
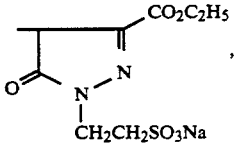

-continued
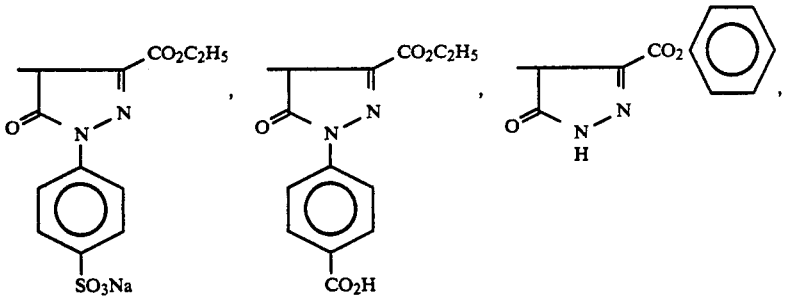
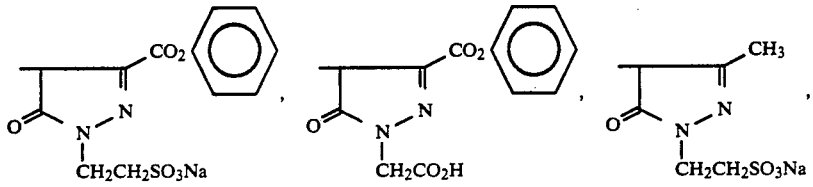
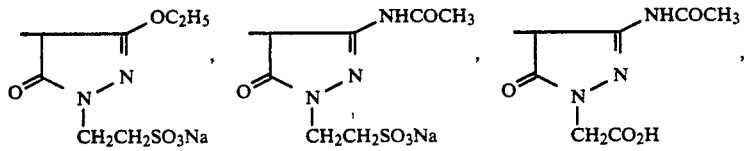
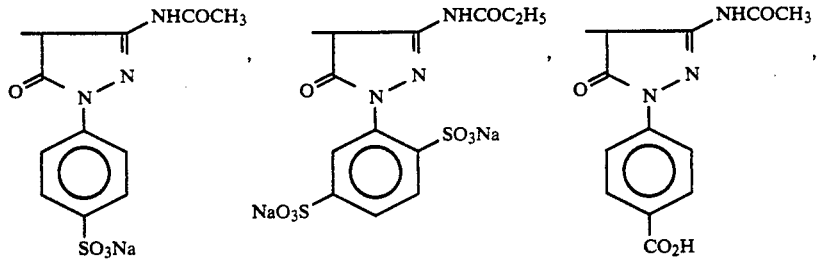
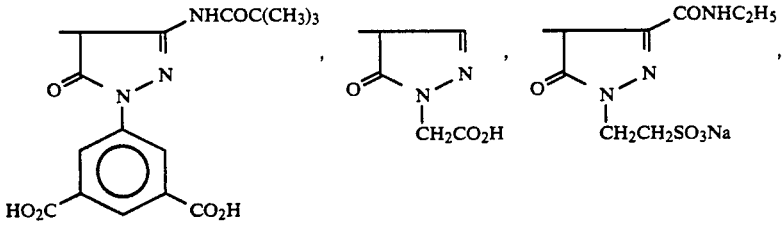
Examples of 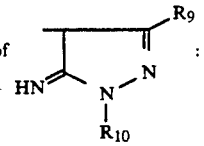 :
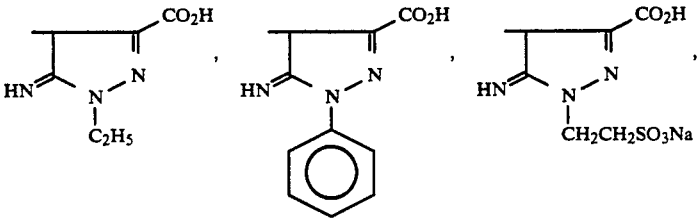

-continued
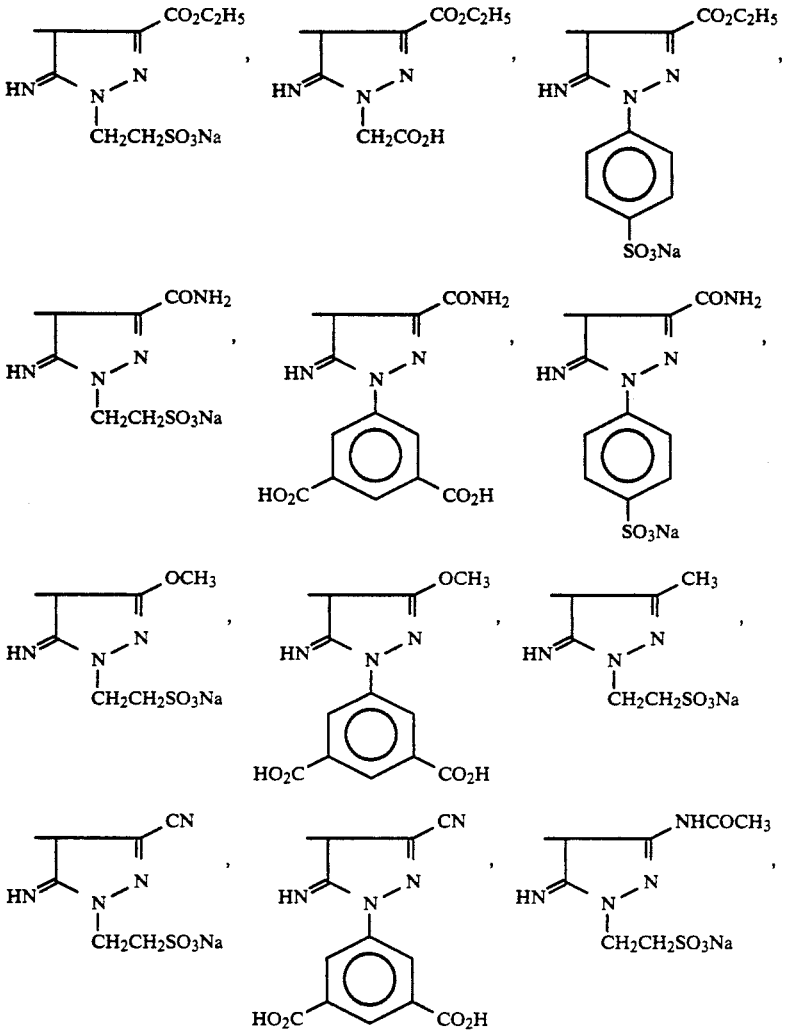
Specific examples of yellow colored couplers for use in the present invention are mentioned below, which, however, are not limitating.
(YC-1):
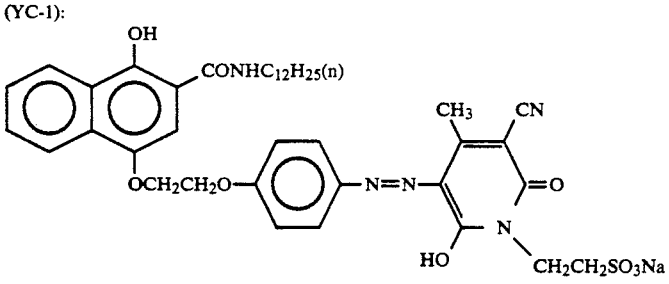
(YC-2):
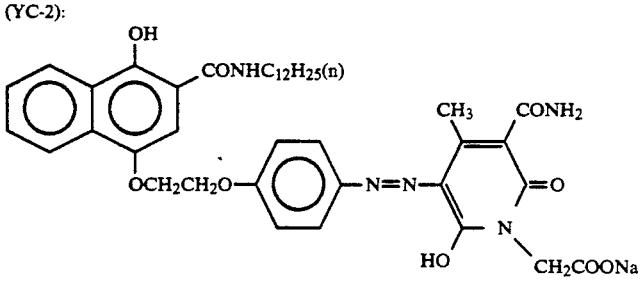
(YC-3):

-continued
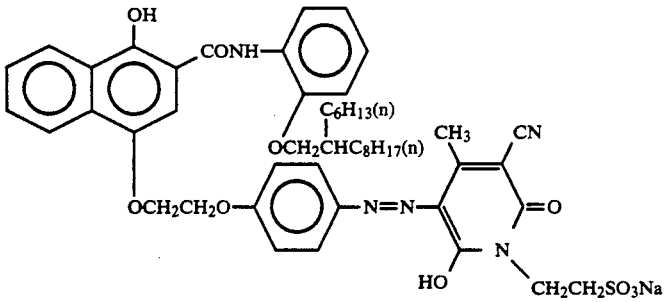
(YC-4):
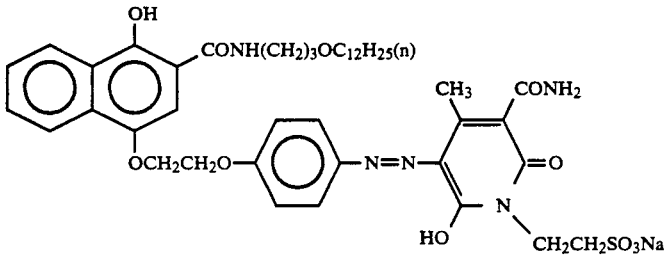
(YC-5):
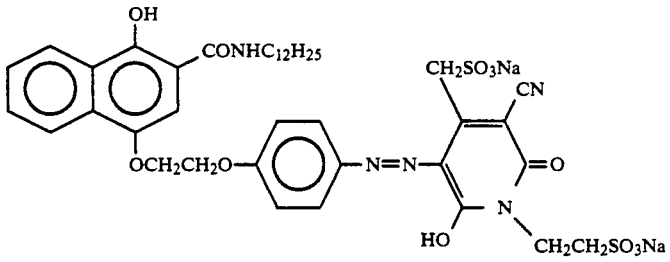
(YC-6):
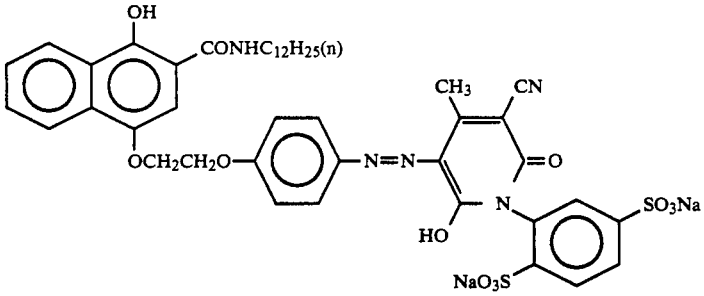
(YC-7):
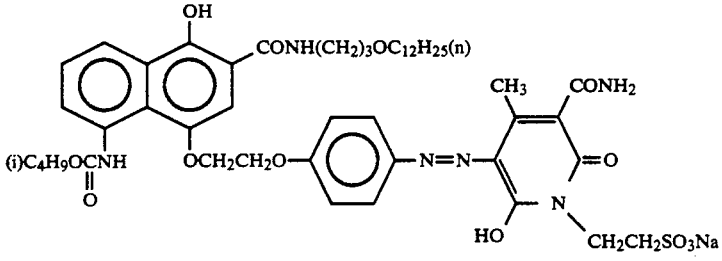
(YC-8):

-continued
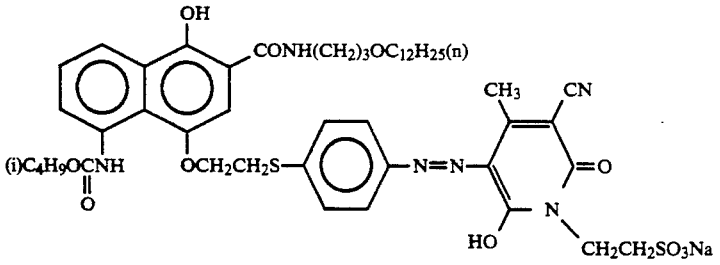
(YC-9):
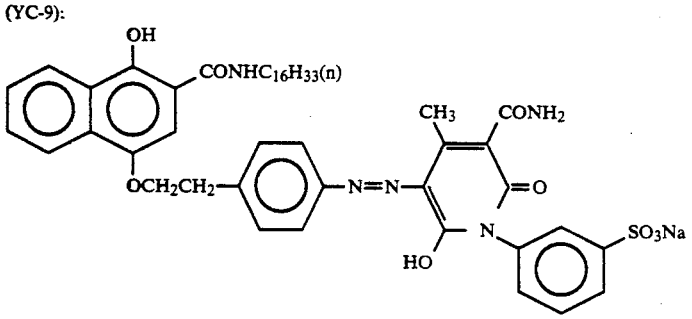
(YC-10):
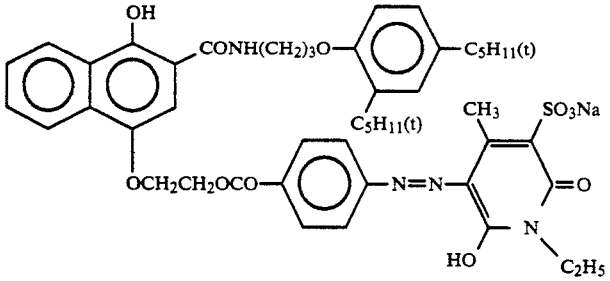
(YC-11):
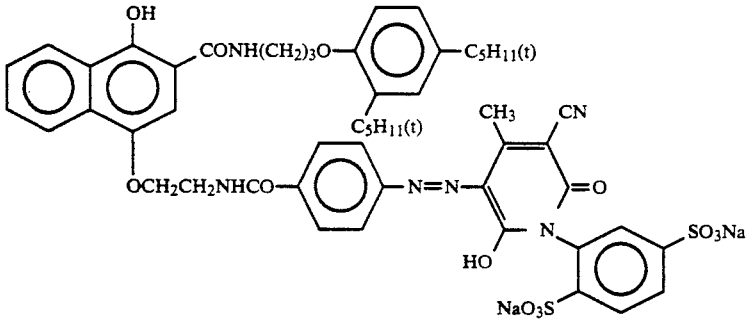
(YC-12):
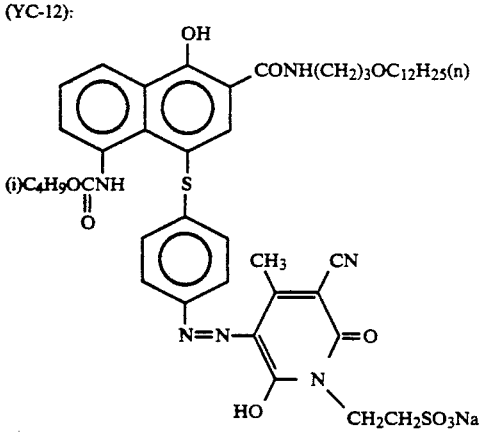
(YC-13):

-continued
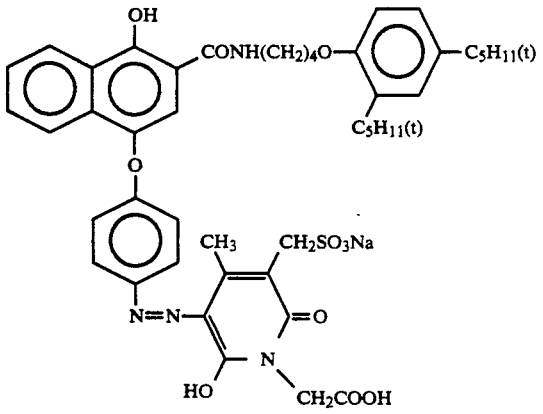
(YC-14):
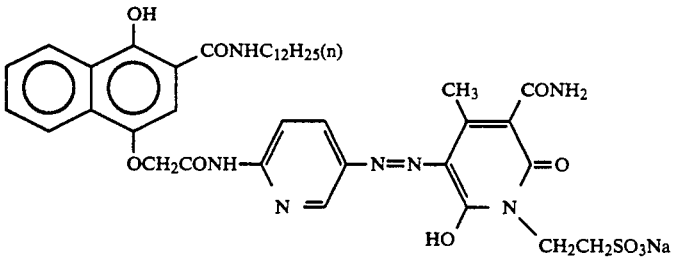
(YC-15):
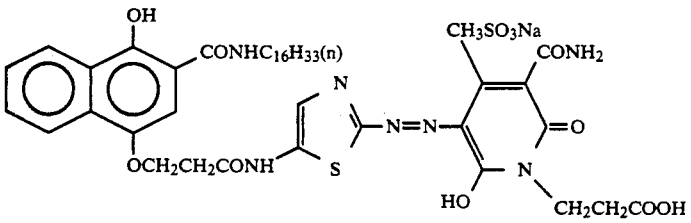
(YC-16):
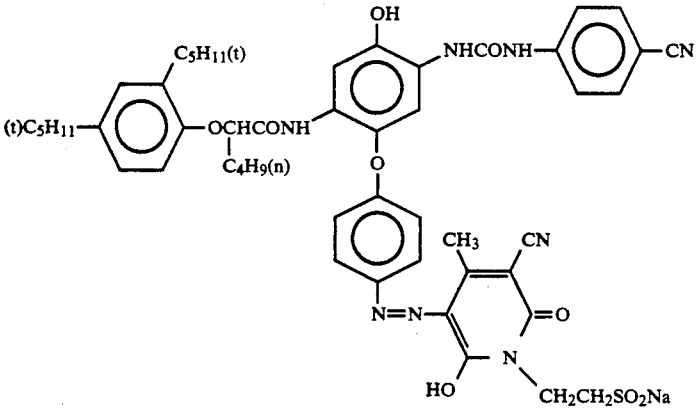
(YC-17):

-continued
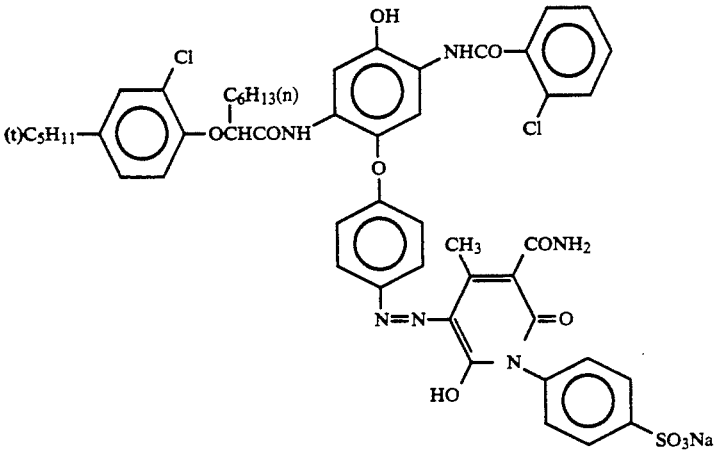
(YC-18):
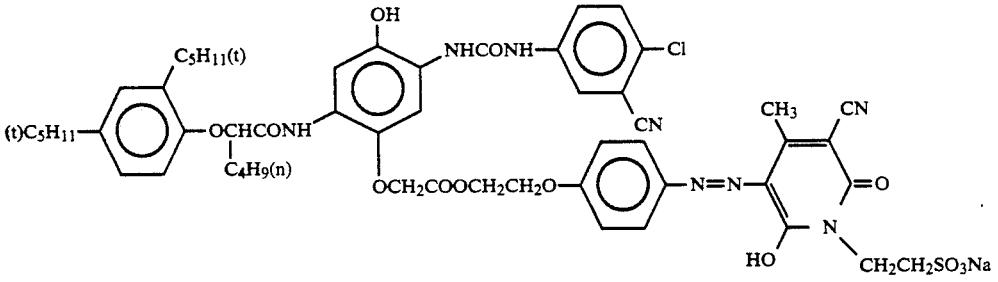
(YC-19):
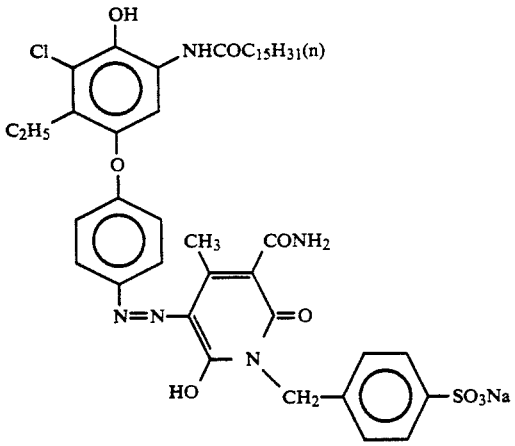
(YC-20):
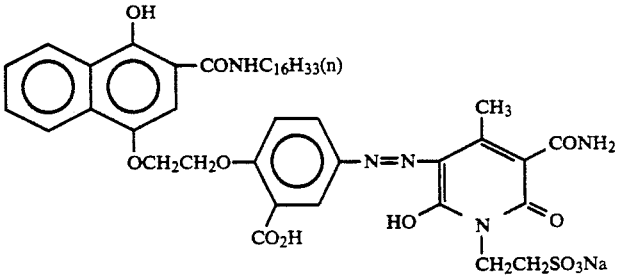
(YC-21):

-continued
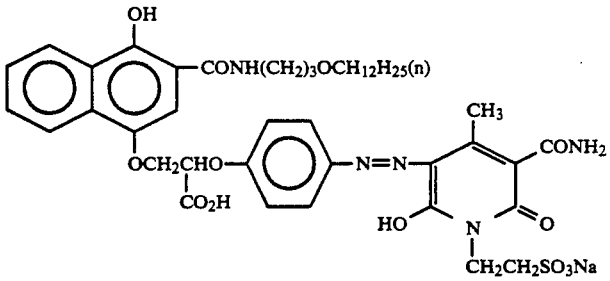
(YC-22):
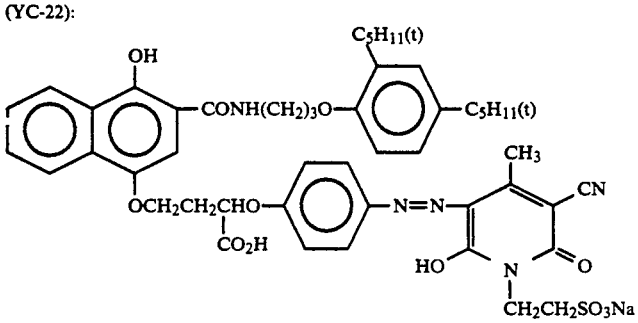
(YC-23):
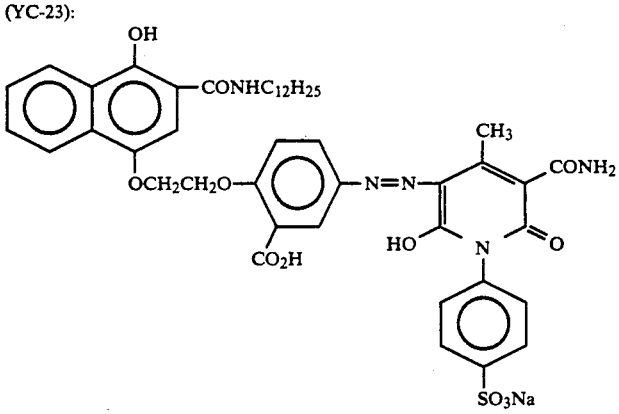
(YC-24):
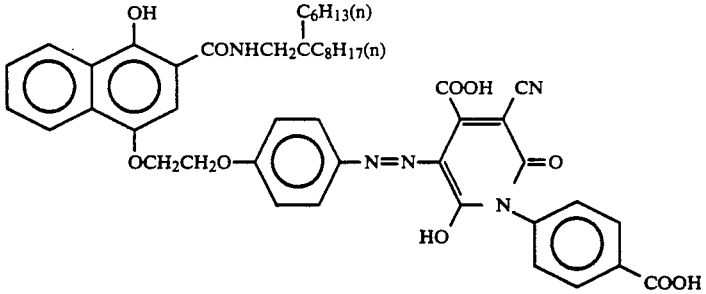
(YC-25):
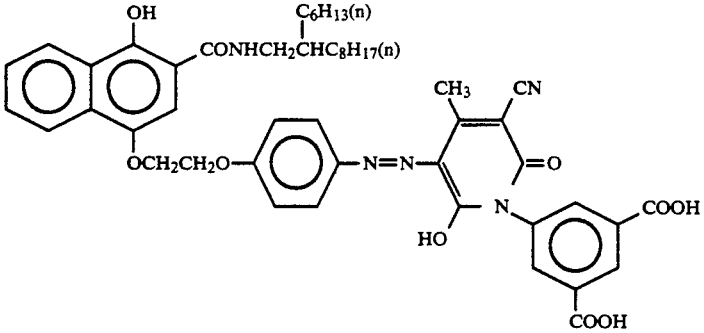

-continued
(YC-26):
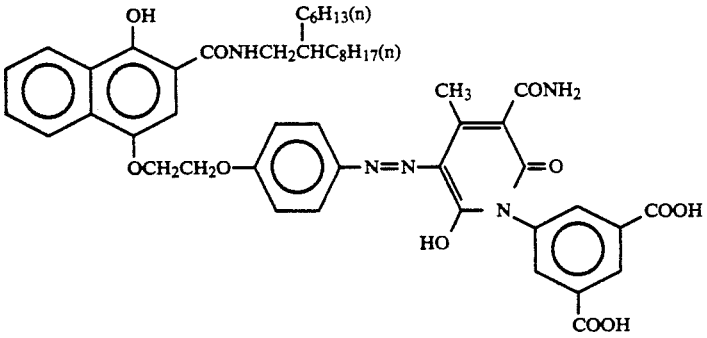
(YC-27):
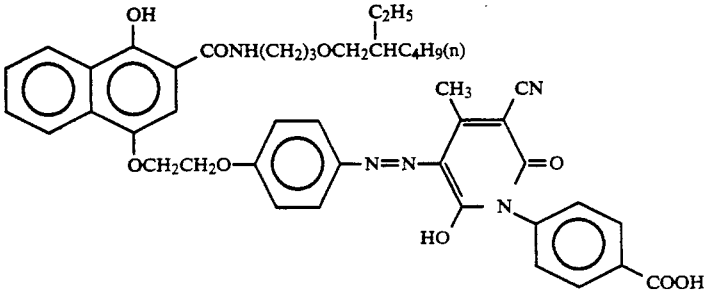
(YC-28):
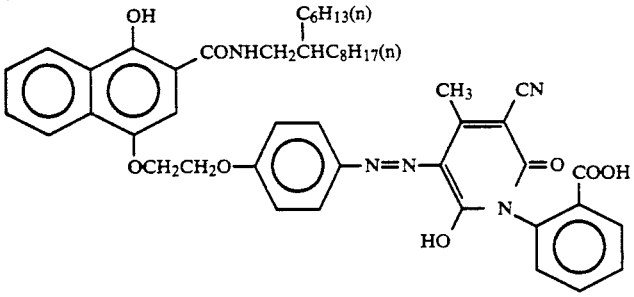
(YC-29):
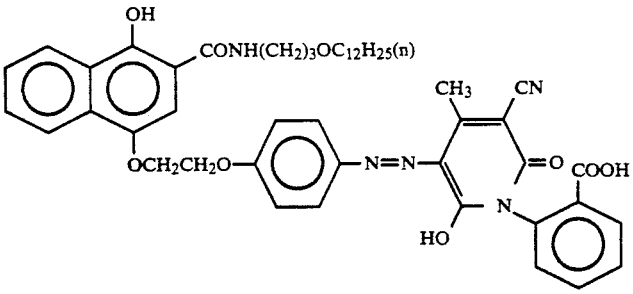
(YC-30):
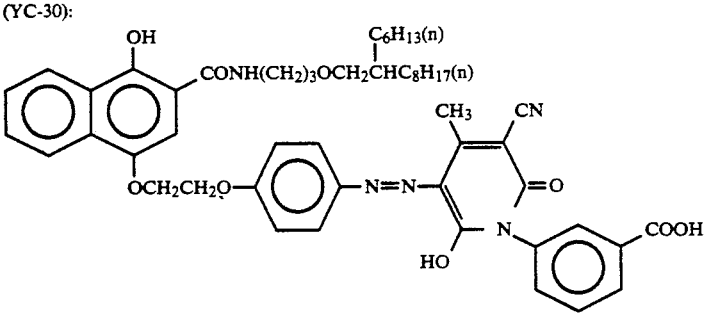
(YC-31):

-continued
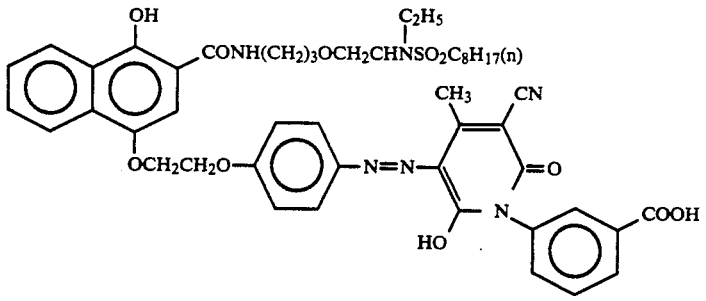
(YC-32):
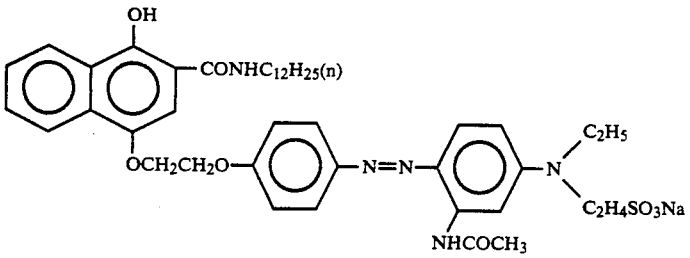
(YC-33):
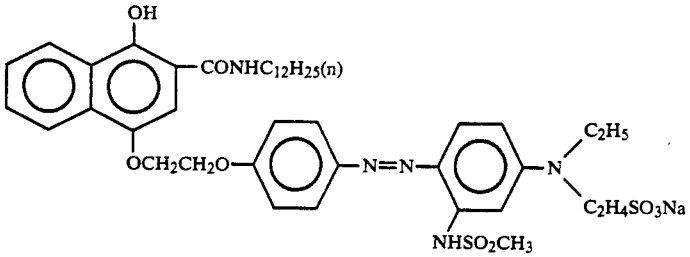
(YC-34):
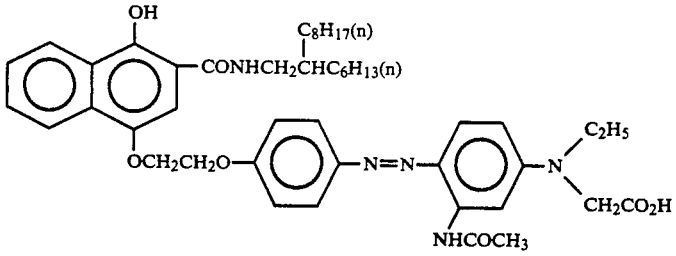
(YC-35):
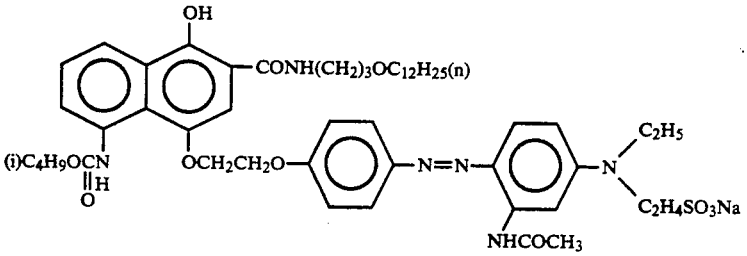
(YC-36):

-continued
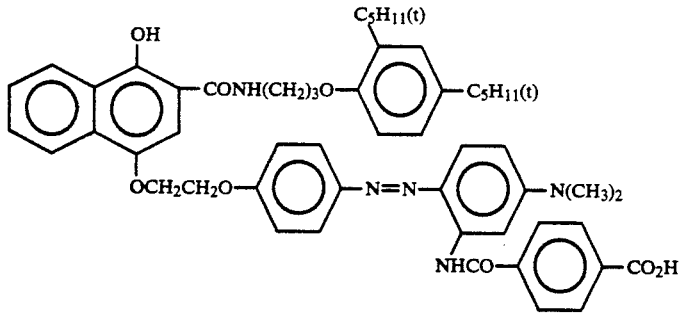
(YC-37):
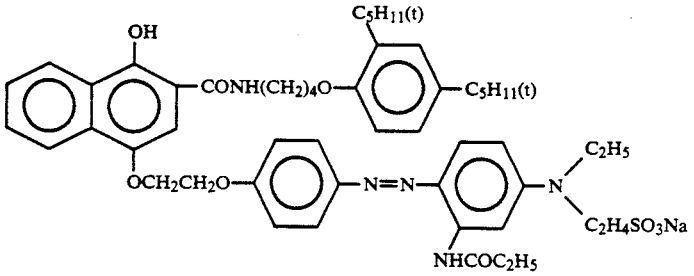
(YC-38):
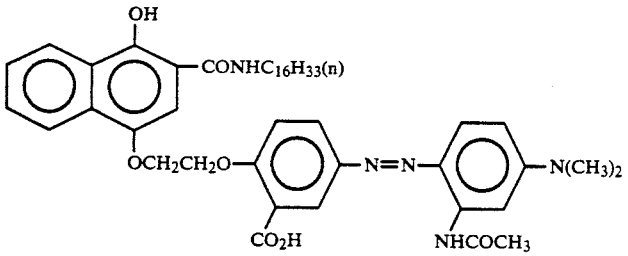
(YC-39):
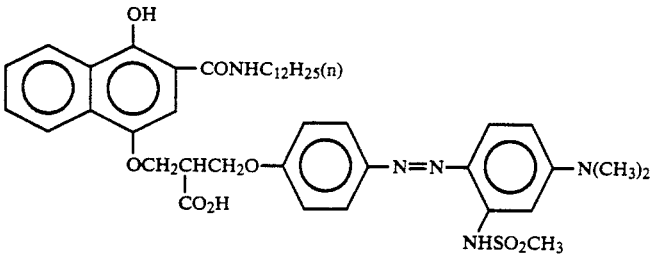
(YC-40):
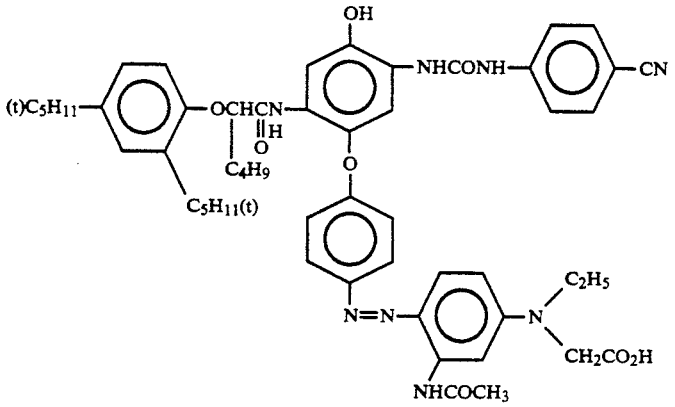
(YC-41):

-continued
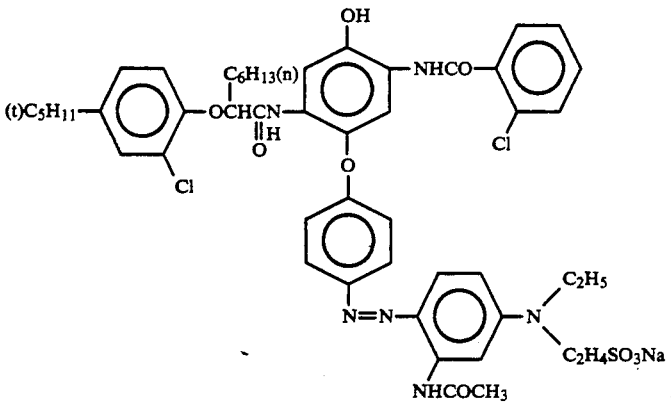
(YC-42):
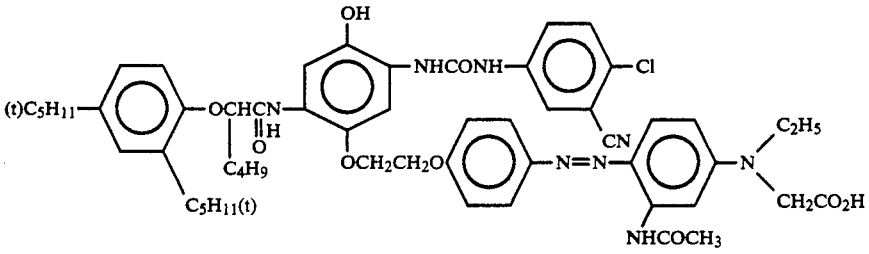
(YC-43):
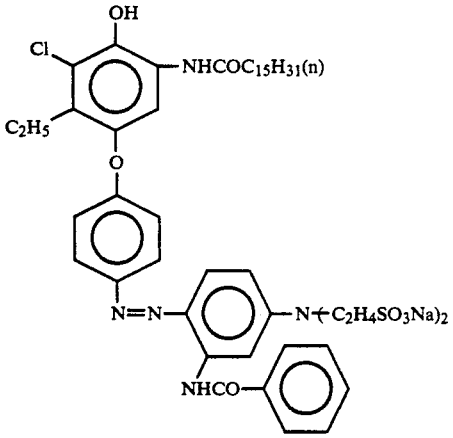
(YC-44):
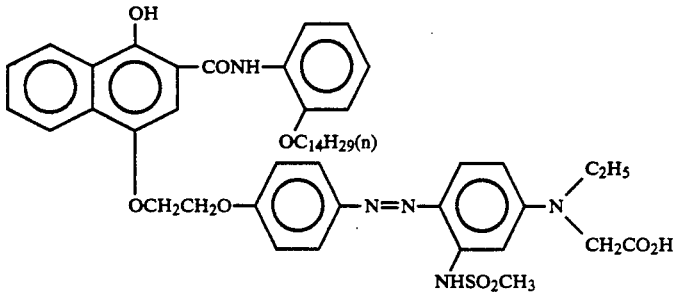
(YC-45):

-continued
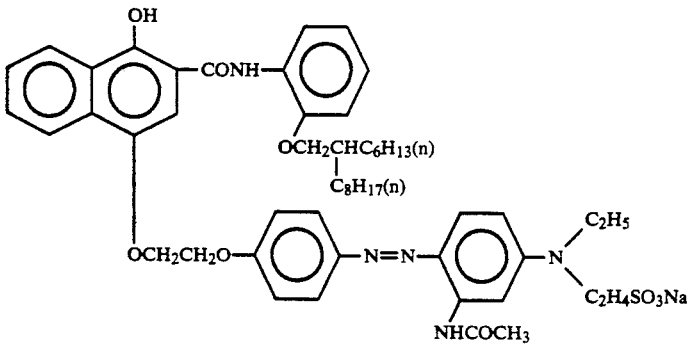
(YC-46):
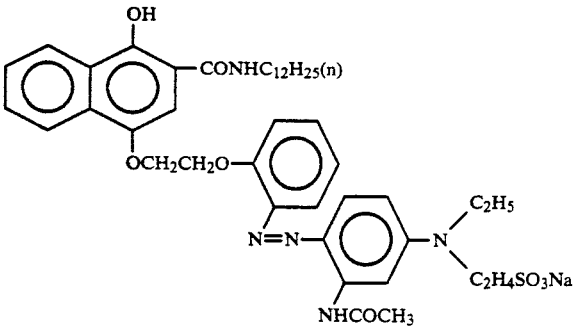
(YC-47):
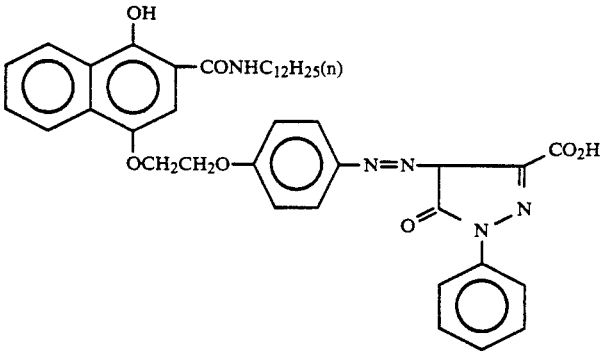
(YC-48):
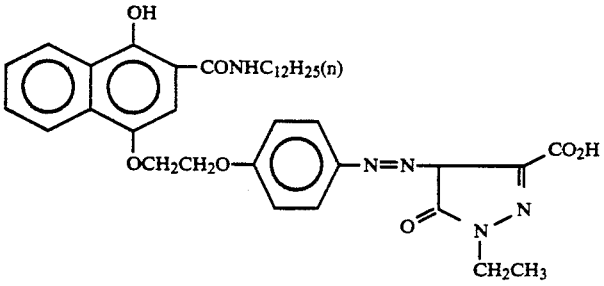
(YC-49):

-continued
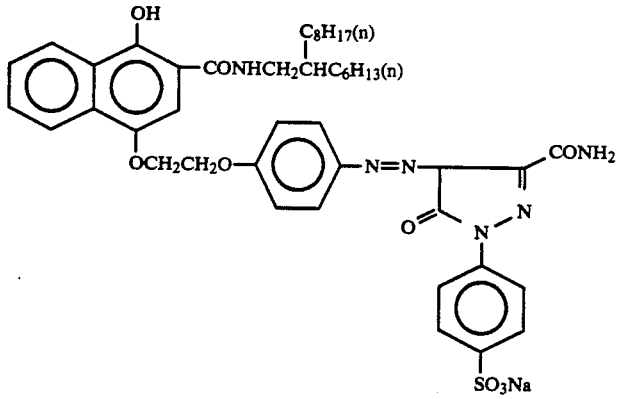
(YC-50):
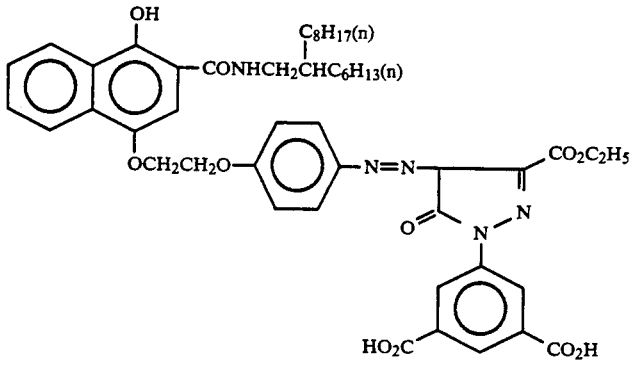
(YC-51):
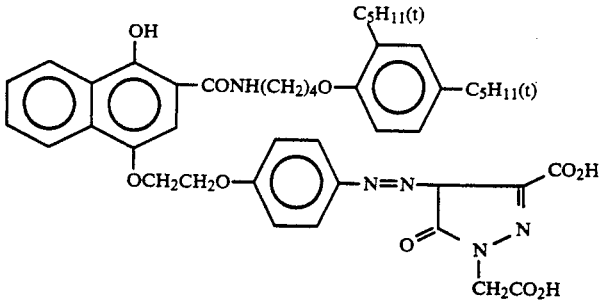
(YC-52):
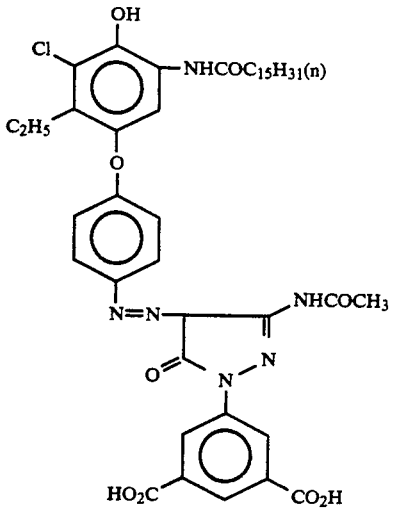
(YC-53):

-continued

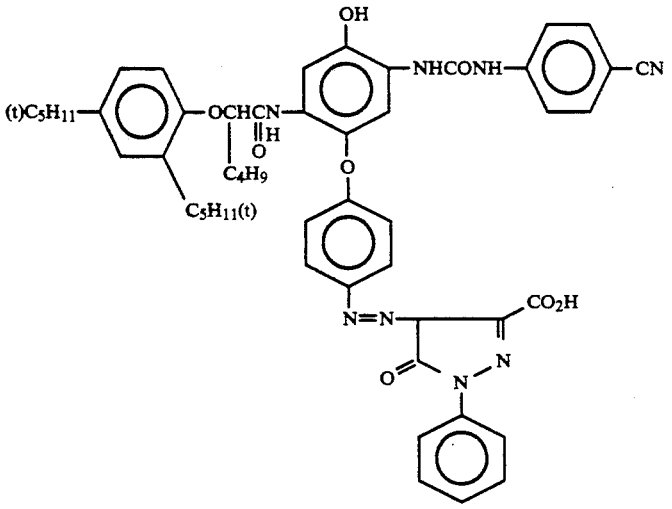

(YC-54):

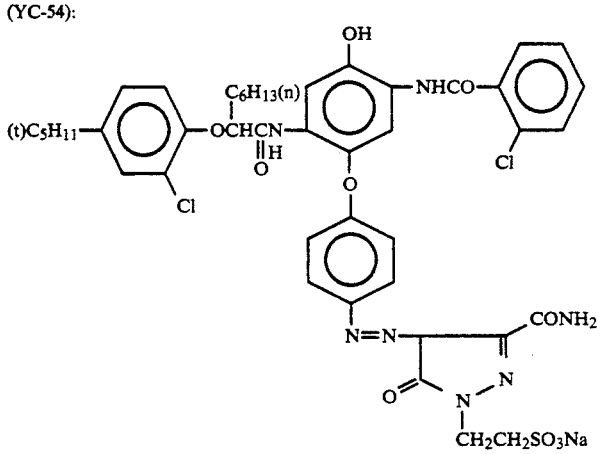

Yellow colored couplers of the above-mentioned formula (CI) for use in the present invention are generally produced by a diazo-coupling reaction between a 6-hydroxy-2-pyridone compound and a coupler structure-containing aromatic or heterocyclic diazonium salt.

The 6-hydroxy-2-pyridones are produced by various known methods, for example, as described in Crinsberg, *Heterocyclic compounds*—Pyridines and Derivatives—Part III (published by Interscience, 1962); *Journal of American Chemical Society,* 1943, Vol. 65, page 449; *Journal of the Chemical Technology & Biotechnology,* 1986, Vol. 36, page 410; *Tetrahedron,* 1966, Vol. 22, page 455; and JP-B-61-52827, West German Patents 2,162,612, 2,349,709 and 2,902,486, and U.S. Pat. No. 3,763,170.

The diazonium salts are produced by various known methods, for example, as described in U.S. Patents 4,004,929 and 4,138,258 and JP-A-61-72244 and JP-A-61-273543.

The diazo-coupling reaction between such a 6-hydroxy-2-pyridone compound and such a diazonium salt can be conducted in a solvent such as methanol, ethanol, methyl cellosolve, acetic acid, N,N-dimethylformamide, N,N-dimethylacetamide, tetrahydrofuran, dioxane or water, or a mixed solvent of them. In the reaction, a base is preferably used, for example, sodium acetate, potassium acetate, sodium carbonate, potassium carbonate, sodium hydrogen carbonate, sodium hydroxide, potassium hydroxide, pyridine, triethylamine, tetramethylurea or tetramethylguanidine.

The reaction temperature is generally −78° C. to 60° C., preferably −20° C. to 30° C.

Next, examples of reactions producing the yellow colored couplers for use in the present invention are mentioned below.

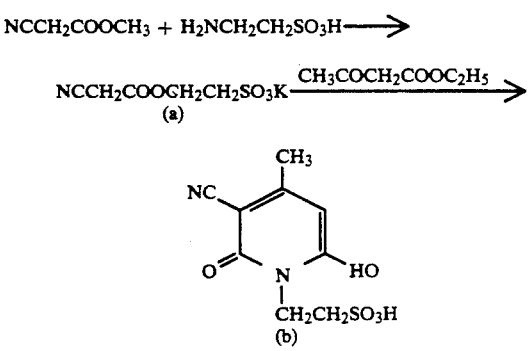

-continued

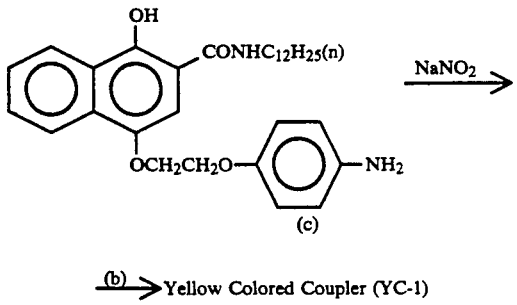

Production of Compound (a)

125.2 g of taurine and 66 g of potassium hydroxide were added to 500 ml of methanol and stirred under heat, and 110 g of methyl cyanoacetate was dropwise added thereto over a period of about one hour. After the whole was heated under reflux for 5 hours, it was allowed to stand as it was overnight, whereupon the crystal precipitated out was taken off by filtration. It was washed with ethanol and dried to obtain 202.6 g of a crystal of Compound (a).

Production of Compound (b)

11.5 g of Compound (a) and 3.5 g of potassium carbonate were added to 11.5 ml of water and stirred with heating on a steam bath, white 7.8 g of ethyl acetacetate was dropwise added thereto. After addition, the whole was stirred for further 7 hours. After cooled, 9.2 ml of concentrated hydrochloric acid was added to the reaction mixture, which was then stirred to give a crystal. The crystal thus formed was taken out by filtration, washed with methanol and dried, to obtain 10.4 g of a crystal of Compound (b).

Production of Yellow Colored Coupler (YC-1)

10.1 g of Compound (c) as produced by the method described in U.S. Pat. No. 4,138,258 was dissolved in 60 ml of N,N-dimethylformamide and 60 ml of methyl cellosolve, and 4.3 ml of concentrated hydrochloric acid was added thereto with cooling with ice. Then, 5 ml of an aqueous solution of 1.84 g of sodium sulfite was dropwise added to the reaction mixture to form a diazonium solution. Next, 60 ml of methyl cellosolve and 20 ml of water were added to 7.8 g of Compound (b) and 8.2 g of sodium acetate, and the diazonium solution was dropwise added thereto with stirring and cooling with ice. After addition, the whole was stirred for further one hour under the same condition and then for 2 hours at room temperature, whereupon the crystal precipitated out was taken off by filtration. This precipitate was washed with water and dried, and thereafter dispersed in 500 ml of water and heated under reflux for one hour and then cooled. The crystal was then taken out by filtration, washed with water and dried, to obtain 13.6 g of a red crystal of the intended yellow colored coupler (YC-1).

The compound had a melting point of 269° to 272° C. (decomposition), and the structure thereof was identified by $^1$HNMR spectrum, mass spectrum and elementary analysis. The compound had a maximum absorption wavelength in methanol of 457.7 nm and a molecular extinction coefficient of 41300, and it displayed a good spectral absorption characteristic of an yellow colored coupler.

PRODUCTION EXAMPLE 2

Production of Yellow Colored Coupler (YC-3)

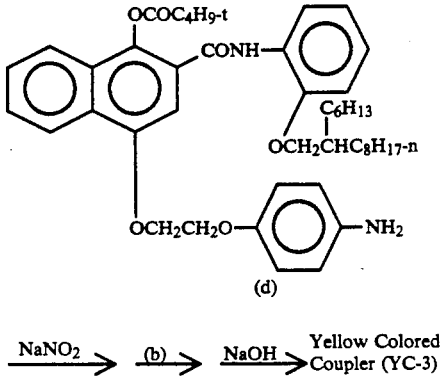

Seventy-five ml of N,N-dimethylformamide and 75 ml of methyl cellosolve were added to 19.2 g of Compound (d) as produced by the method described in JP-A-62-85242 and dissolved, and 5.6 ml of concentrated hydrochloric acid was added thereto with stirring and cooling with ice. Next, 5 ml of an aqueous solution of 2.5 g of sodium sulfite was dropwise added thereto. One hour after that addition, the whole was stirred for further one hour at room temperature to prepare a diazonium solution.

Seventy-five ml of methyl cellosolve and 26 ml of water were added to 10.1 g of Compound (b) and 10.7 g of sodium acetate, and the diazonium solution was dropwise added thereto with stirring and cooling with ice. One hour after that addition, the whole was stirred for further 2 hours at room temperature, whereupon the crystal as precipitated out was taken off by filtration. Then, the crystal was dispersed in 200 ml of methanol, and 10 ml of an aqueous solution of 2.2 g of sodium hydroxide was dropwise added thereto and stirred for 3 hours. This was neutralized with concentrated hydrochloric acid, whereupon the crystal as precipitated out was taken off by filtration, washed with water and then with methanol, and thereafter dried.

The crude crystal thus obtained was purified with a hot methanol in the same manner as in Production Example 1, to obtain 14.8 g of the intended yellow colored coupler (YC-3). The compound had a melting point of 246° to 251° C. (decomposition), and the structure thereof was identified by $^1$HNMR spectrum, mass spectrum and elementary analysis. The compound had a maximum absorption wavelength in methanol of 457.6 nm and a molecular extinction coefficient of 42700. It displayed a good spectral absorption characteristic of an yellow colored coupler.

PRODUCTION EXAMPLE 3

Production of Yellow Colored Coupler (YC-28)

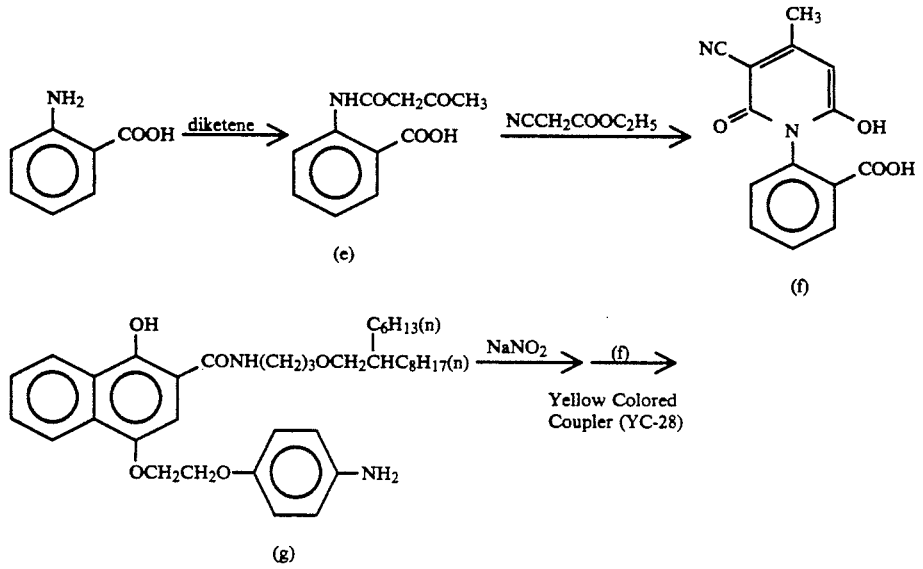

Production of Compound (e)

137.1 g of anthranilic acid was added to 600 ml of acetonitrile and stirred under heat, and 9.5 g of diketene was dropwise added thereto over a period of about one hour. After the whole was heated under reflux for one hour, it was cooled to room temperature, whereupon the crystal as precipitated out was taken off by filtration. This was washed with acetonitrile and dried of obtain 200.5 g of a crystal of Compound (e).

Production of Compound (f)

199.1 g of Compound (e), 89.2 g of ethyl cyanoacetate and 344 g of 28% sodium methoxide were added to 0.9 liter of methanol and reacted for 8 hours at 120° C. in an autoclave. After the reaction mixture was allowed to stand as it was overnight, it was concentrated under reduced pressure. Seven hundred ml of water was added to the resulting mixture, which was then made acidic with 230 ml of concentrated hydrochloric acid. The crystal thus precipitated out was taken off by filtration, and the crude crystal obtained was washed with a hot mixed solvent of ethyl acetate and acetonitrile, to obtain 152 g of Compound (f).

Production of Yellow Colored Coupler (YC-28)

13.0 g of Compound (g) as produced in accordance with the method described in U.S. Pat. No. 4,138,258 was dissolved in 40 ml of N,N-dimethylformamide, and 4.5 ml of concentrated hydrochloric acid was added thereto with cooling with ice. Next, 5 ml of an aqueous solution of 1.48 g of sodium sulfite was dropwise added thereto to prepare a diazonium solution. Next, 20 ml of N,N-dimethylformamide and 15 ml of water were added to 6.0 g of Compound (f) and 8 g of sodium acetate, and the diazonium solution was dropwise added thereto with stirring and cooling with ice. After addition, the whole was stirred for further 30 minutes at room temperature. This was made acidic with hydrochloric acid and then extracted with ethyl acetate. The resulting extract was washed with water and concentrated under reduced pressure. The resulting concentrate was recrystallized with a mixed solvent of ethyl acetate and methanol, to obtain 13 g of an yellow crystal of the intended yellow colored coupler (YC-28). This had a melting point of 154° to 156° C. The structure of the compound was identified by $^1$HNMR spectrum, mass spectrum and elementary analysis. The compound had a maximum absorption wavelength in methanol of 458.2 nm and a molecular extinction coefficient of 42800. It displayed a good spectral absorption characteristic of an yellow colored coupler.

Yellow colored couplers of the above-mentioned formulae (CII) to (CIV) for use in the present invention can be produced by various known methods, for example, as described in JP-B-58-6939 and JP-B-1-197563, or in accordance with the methods mentioned above, for example U.S. Pat. No. 4,138,258 and German Patent 3815469, for production of couplers of formula (CI).

In the present invention, yellow colored cyan couplers of formulae (CI) and (CII) are preferably employed; and those of formula (CI) are especially preferably employed.

In accordance with the present invention, the above-mentioned yellow colored cyan coupler is preferably added to the light-sensitive silver halide emulsion layer or the adjacent layer in the photographic material to be processed. Especially preferably, the coupler is added to a red-sensitive emulsion layer in the material. The total amount of the coupler to be added to the photographic material is from 0.005 to 0.30 g/m$^2$, preferably from 0.02 to 0.20 g/m$^2$, more preferably from 0.03 to 0.15 g/m$^2$.

Addition of the yellow colored coupler to the photographic material of the present invention may be effected in the same manner as that for addition of general couplers to the material, which will be mentioned below in detail.

Next, the silver halide grains to be in the photographic material of the present invention will be explained.

The emulsion layer to constitute the photographic material of the present invention contains chemically sensitized silver halide grains, the grains being characterized by having a silver iodobromide phase with a silver iodide content of from 15 to 45 mol% as a distinct layered structure and having a mean silver iodide content of more than 7 mol % based on the whole grain.

The distinct layered structure as referred to herein can be identified by an X-ray diffraction method. An example of using an X-ray diffraction method for identification of silver halide grains is described in H. Hirsche, *Journal of Photographic Science,* Vol. 10, from page 129, et seq. (1962). Where the lattice constant is determined on the basis of the halogen composition, the diffraction peak appears at the diffraction angle to satisfy Bragg's condition ($2\ d\sin\theta = n\lambda$).

X-Ray diffractometry is described in detail in *X-Ray Diffraction* (Basical Analytical Chemistry Lecture 24, published by Kyoritsu Publishing Co., Japan) and *Handbook of X-RaV Diffraction* (published by Rigaku Electric Co., Japan). A standard measuring method, is a method of obtaining a diffraction curve of (220) plane of a silver halide crystal where Cu is used as a target and the K$\beta$ ray of Cu is used as a ray source (tube voltage of 40 kV, tube current of 60 mA). In order to elevate the resolving power of the measuring device, it is necessary to properly select the width of slits (divergent slit, light-receiving slit), the time constant of the device, and the scanning rate and the recording rate of the goniometer, and to ascertain the measurement accuracy by the use of a standard sample such as silicon.

The distinct layered structure of the silver halide grain of the present invention indicates the following condition. When a curve of the diffraction intensity to diffraction angle of (220) plane of a silver halide crystal grain is obtained by the use of a K$\beta$ ray of Cu in the range of from 38° to 42° as the diffraction angle ($2\theta$), there appear at (1) least two diffraction maximum peaks, one corresponding to a high iodine layer having a silver iodide content of from 15 to 45 mol % and the other corresponding to a low iodine layer having a silver iodide content of 8 mol % or less, and (2) one minimum peak between the maximum peaks. Further, ratio of the diffraction intensity corresponding to the high iodine layer to that corresponding to the low iodine layer is from 1/10 to 3/1, more preferably from 1/5 to 3/1, especially preferably from 1/3 to 3/1. The silver halide crystal grains satisfying the above-defined condition are said to have "a silver iodobromide phase with a silver iodide content of from 15 to 45 mol % as a distinct layered structure" as specifically defined in the present invention.

In the emulsion containing silver halide grains with a substantially distinct two-layered structure, which is used in the present invention, the silver halide grain is preferably one in which the minimum diffraction intensity peak between the two maximum diffraction intensity peaks is 90% or less of the weaker or weakest of the two or more maximum peaks. More preferably, it is 80% or less, especially preferably 60% or less.

The means of analyzing a diffraction curve composed of two components diffracted is well known, for example, as discussed in *Experimental Physics,* Lecture 11, Lattice Defect (published by Kyoritsu Publishing Co., Japan).

It is also useful to assume the diffraction curve as a function such as Gauss function or Lorentz function and to analyze the curve by the use of Curve Analyzer (manufactured by DuPont Co.).

Even in an emulsion containing two different kinds of silver halide grains each having a different halogen composition with no distinct layered structure, the grains would give two peaks in the above-mentioned X-ray diffractiometry.

However, such an emulsion is useless in the present invention, as it does not display the excellent photographic characteristics as intended by the present invention.

In order to differentiate the silver halide emulsion of the present invention, in which the grains have a distinct layered structure as defined above, from an emulsion containing two different kinds of silver halide grains, which is outside the scope of the present invention, EPMA method (electron-probe micro-analyzer method) is employed in addition to the above-mentioned X-ray diffraction method.

In accordance with the EPMA method, an electron beam is irradiated to a sample dispersion as prepared by dispersing emulsion grains well so that the grains are not kept in contact with each other, whereby elementary analysis of an ultra-fine area of the grain may be effected by X-ray analysis by the excited electron rays.

By that method, the characteristic X-ray intensity of silver and iodine to be irradiated from each lattice is obtained and, accordingly, the halogen composition of each grain is determined.

At least 50 grains are measured by EPMA method to identify the halogen composition, whereby the emulsion is tested to determine whether it is within the scope of the present invention.

It is especially preferred that the silver halide grains in the emulsion of the present invention have a uniform iodine content between the grains.

Specifically, regarding the iodine content distribution of the silver halide grains of the emulsion as measured by EPMA method, it is preferred that the relative standard deviation is 50% or less, more preferably 35% or less.

Another preferred condition of the intergranular iodine distribution is that the relationship between the logarithmic number of the grain size and the iodine content is positive. That is to say, in the emulsion of the present invention the iodine content in the larger grains is higher while the iodine content in the smaller grains is lower. The emulsion having such a correlation gives a favorable result with respect to graininess. The coefficient of correlation is preferably 40% or more, more preferably 50% or more.

In the silver halide grain of the present invention, which has distinct layered structure as mentioned above, the silver halide other than silver iodide in the core part may be either silver chlorobromide or silver bromide, but it is preferred that the proportion of silver bromide is higher in the core part. In that core part, the silver iodide content may be from 15 to 45%, and it is preferably from 25 to 45% mol %, more preferably from 30 to 45 mol %. Most preferably, the silver halide composition in the core part is a silver iodobromide having a silver iodide content of from 30 to 45 mol %.

In the silver halide grain, the composition of the outermost layer is a silver halide containing a silver iodide content of 8 mol % or less, more preferably 5 mol % or less.

The other silver halide composition than silver iodide in the outermost layer may be anyone of silver chloride, silver chlorobromide or silver bromide, but it is preferred that the proportion of silver bromide in the layer is highest. Most preferably, the silver halide composition in the outermost layer is a silver iodobromide having a silver iodide content of from 0.5 to 6 mol % or is silver bromide.

Regarding the halogen composition of the whole grain, it is necessary, the silver iodide content in the whole grain is more than 7 mol %. More preferably, the silver iodide content therein is from 10 to 25 mol %, especially preferably from 12 to 20 mol %.

One reason for the good graininess of the silver halide emulsion of the present invention is that the grains in the emulsion have an elevated iodine content without lowering the developing activity thereof. As a result, the light absorbability of the emulsion is elevated. In addition, another more remarkable effect of the present invention is caused by the distinct layered structure composed of a high iodine layer as the core part and a low iodine layer as the outermost layer. Accordingly, the latent image forming efficiency of the emulsion has been improved because of the distinct layered structure.

The grain size of the silver halide grain having a distinct layered structure of the present invention is from 0.05 to 3.0 microns, preferably from 0.1 to 1.5 microns, more preferably from 0.2 to 1.3 microns, especially preferably from 0.3 to 1.0 micron, as the mean grain size of the grains.

The mean grain size of silver halide grains as referred to herein means a geometrical mean value of grain sizes, as is well known in this technical field, for example, as described in T. H. James, *The Theory of the Photographic Process,* 3rd Ed., page 39 (published by MacMillan Co., 1966). The grain size is represented by the sphere-corresponding diameter, as described in M. Arakawa, *Handbook of Measurement of Grain Size* (in Journal of Powdery Engineering, Vol. 17, pages 299 to 313, 1980, Japan). For instance, it may be measured by various methods including a coal tar counter method, a single grain light-scattering method and a laser ray scattering method.

Regarding the crystal form of the silver halide grains having a distinct layered structure of the present invention, the grains may have a regular crystalline form such as a hexahedral, octahedral, dodecahedral or tetradecahedral crystalline form (regular crystalline grains). Or they may have irregular crystalline form such as a spherical, potato-like or tabular crystalline form (irregular crystalline grains). In particular, preferred are tabular twin grains having an aspect ratio of from 1.2 to 8, especially preferably from.1.5 to 5.

Of the regular crystals, those having (111) plane in a proportion of 50% or more are especially preferred. Of the irregular crystals, those having (111) plane in a proportion of 50% or more are also preferred. The plane proportion of (111) plane can be measured by Kubelka-Munk dye absorption method. In the method, precisely, a dye which may predominantly adsorb to either (111) plane or (100) plane whereupon the associated condition on (111) plane is spectrally differentiated from that on (100) plane is selected. The thus selected dye is added to the emulsion to be tested and the color spectrum is checked in detail with respect to the amount of the dye added thereto. On the basis of the data obtained, the plane proportion of (111) plane is determined.

The emulsion of the present invention may be incorporated into any later constituting the silver halide photographic material. However, it is preferably added to the red-sensitive emulsion layer. More preferably, the red-sensitive emulsion layer is composed of two or more sub-layers each having a different sensitivity degree. In that case, the emulsion is desirably incorporated into other layers other than the lowermost sensitivity layers.

Especially preferably, compounds of the following general formula (A) are employed in the present invention.

$$Q—SM_1 \qquad (A)$$

where Q represents a heterocyclic ring residue having at least one member selected from the group consisting of $—SO_3M_2$, $—COOM_2$, —OH and $—MR_{21}R_{22}$, bonded to the residue either directly or indirectly; $M_1$ and $M_2$ independently represent a hydrogen atom, an alkali metal, a quaternary ammonium group, or a quaternary phosphonium group; and $R_{21}$ and $R^{22}$ independently represent a hydrogen atom, or a substituted or unsubstituted alkyl group.

Examples of the heterocyclic rings for Q include an oxazole ring, a thiazole ring, an imidazole ring, a selenazole ring, a triazole ring, a tetrazole ring, a thiadiazole ring, an oxadiazole ring, a pentazole ring, a pyrimidine ring, a thiadia ring triazine ring, a thiadiazine ring, as well as carbon ring-condensed rings or hetero ring-condensed rings such as a benzothiazole ring, a benzotriazole ring, a benzimidazole ring, a benzoxazole ring, a benzoselenazole ring, a naphthoxazole ring, a triazaindolidine ring, a diazaindolidine ring, and a tetraazaindolidine ring.

Among mercapto-heterocyclic compounds of the above-mentioned formula (A), especially preferred are those of the following formulae (B) and (C):

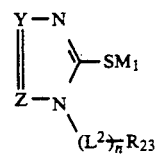

(B)

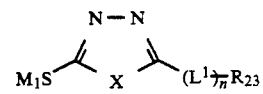

(C)

In formula (B), Y and Z independently represent a nitrogen atom or $$=\overset{|}{C}R_{24}$$

(where $R_{24}$ represents a hydrogen atom, a substituted or unsubstituted alkyl group, or a substituted or unsubstituted aryl group); $R^{23}$ represents an organic residue as substituted by at least one substituent selected from the group consisting of $—SO_3M_2$, $—COOM_2$, —OH and $—NR_{21}R_{22}$. Examples of the organic residue of $R_{23}$ include an alkyl group having from 1 to 20 carbon atoms (e.g., methyl, ethyl, propyl, hexyl, dodecyl, octadecyl), and an aryl group having from 6 to 20 carbon atoms (e.g., phenyl, naphthyl). In formula (B), $L^1$ represents a linking group selected from the group consisting of —S—, —O—, $$—\overset{|}{N}—,$$

—CO—, —SO— and —$SO_2$; and n represents 0 or 1.

The alkyl or aryl group of $R_{23}$ may further have one or more other substituents selected from the group consisting of a halogen atom (e.g., F, Cl, Br), an alkoxy group (e.g., methoxy, methoxyethoxy), an aryloxy group (e.g., phenoxy), an alkyl group (when $R_{23}$ is an aryl group), an aryl group (when $R_{23}$ is an alkyl group), an amido group (e.g., acetamido, benzoylamino), a carbamoyl group (e.g., unsubstituted carbamoyl, phenylcarbamoyl, methylcarbamoyl), a sulfonamido group (e.g., methanesulfonamido, phenylsulfonamido), a sulfamoyl group (e.g., unsubstituted sulfamoyl, methylsulfamoyl, phenylsulfamoyl), a sulfonyl group (e.g., methylsulfonyl, phenylsulfonyl), a sulfinyl group (e.g., methylsulfinyl, phenylsulfinyl), a cyano group, an alkoxycarbonyl group (e.g., methoxycarbonyl), an aryloxycarbonyl group (e.g., phenoxycarbonyl), and a nitro group.

Where $R_{23}$ has two or more substituents of —$SO_3M_2$, —$COOM_2$, —OH and —$NR_{21}R_{22}$, they may be same or different.

$M_2$ has the same meaning as that in formula (A).

In formula (C), X represents a sulfur atom, an oxygen atom, or

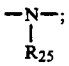

and $R_{25}$ represents a hydrogen atom, a substituted or unsubstituted alkyl group or a substituted or unsubstituted aryl group.

$L_2$ represents —$CONR_6$, —$NR_6CO$, —$SO_2NR_6$—, —$NR_6SO_2$, —OCO—, —COO—, —S—, —CO—, —SO—, —OCOO—, —$NR_6CONR_7$—, —$NR_6COO$—, —$OCONR_6$—, or —$NR_6SO_2NR_7$—; and $R_6$ and $R_7$ independently represent a hydrogen atom, a substituted or unsubstituted alkyl group, or a substituted or unsubstituted aryl group.

$R_{23}$ and $M_2$ have the same meanings as those in formulae (A) and (B), and n represents 0 or 1.

The alkyl or aryl group of $R_{24}$ $R_{25}$, $R_6$ or $R_7$ may be substituted by one or more substituents. Examples of substituents of the group include those of the group $R_{23}$.

Especially preferred are those embodiments of the above-mentioned formulae where $R_{23}$ is —$SO_3M_2$ or —$COOM_2$.

Next, preferred examples of compounds of formula (A) for use in the present invention are mentioned below:

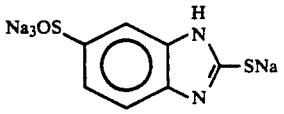
(1)

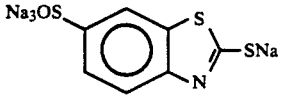
(2)

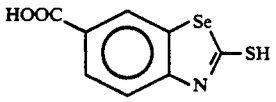
(3)

-continued

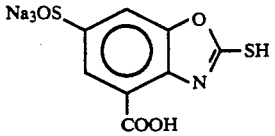
(4)

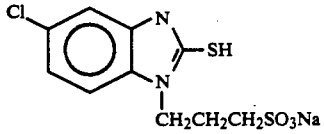
(5)

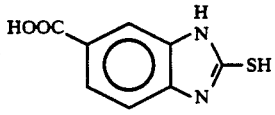
(6)

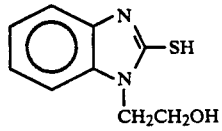
(7)

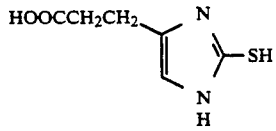
(8)

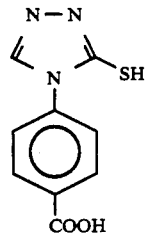
(9)

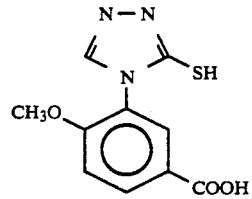
(10)

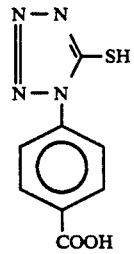
(11)

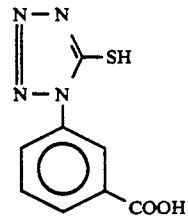
(12)

-continued
(13)
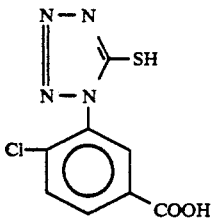
(14)
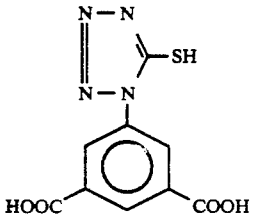
(15)
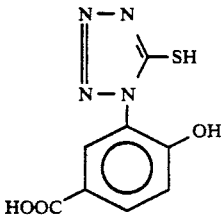
(16)
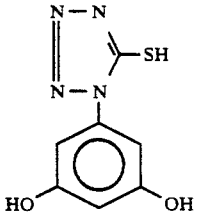
(17)
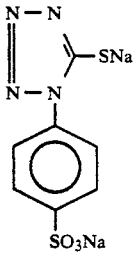
(18)
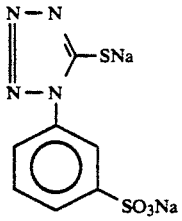
(19)
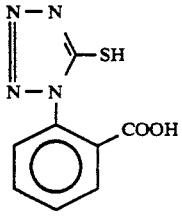
-continued
(20)
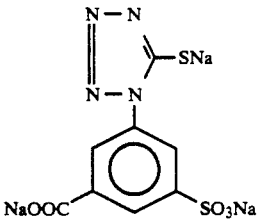
(21)
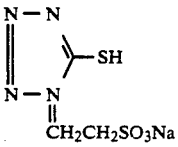
(22)
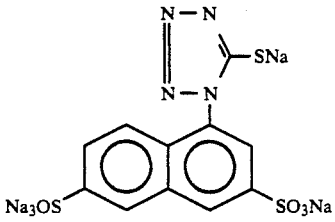
(23)
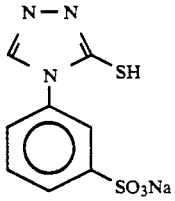
(24)
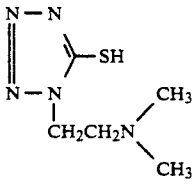
(25)
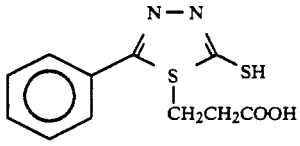
(26)
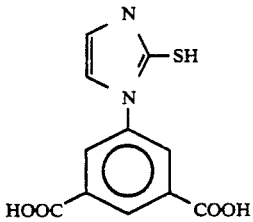
(27)
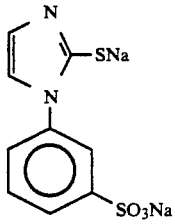

-continued (28)

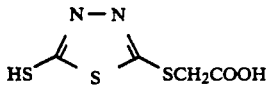

(29)

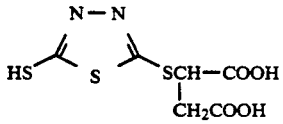

(30)

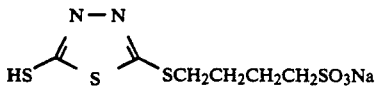

(31)

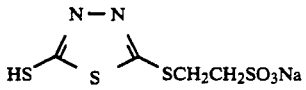

(32)

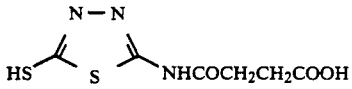

(33)

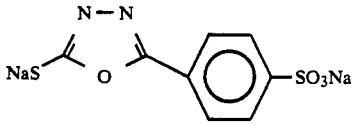

(34)

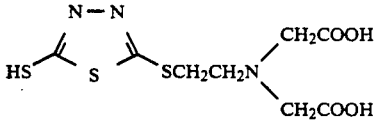

(35)

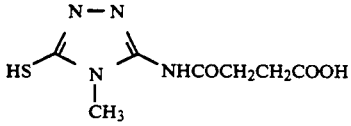

(36)

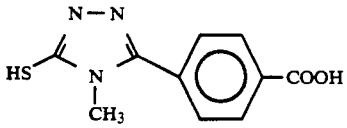

(37)

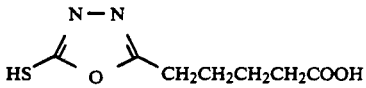

(38)

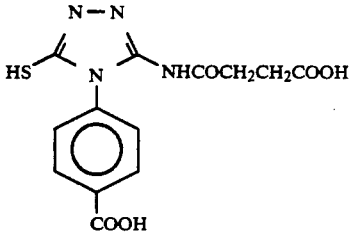

-continued (39)

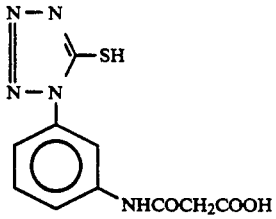

Compounds of formula (A) are known or can be produced by known methods, for example, those mentioned in the references below:

U.S. Pat. Nos. 2,585,388, 2,541,924, JP-B-52-21842, JP-A-53-50169, British Patent 1,275,701; D. A. Berges et al, *Journal of the Heterocyclic Chemistry,* Vol. 15, page 981 (1978); *The Chemistry of Heterocyclic Chemistry,* Imidazole and Derivatives, Part I, pages 336 to 339; *Chemical Abstract,* 58, 7921 (1963), page 394; E. Hoggarth, *Journal of Chemical Society,* pages 1160 to 1167; S. R. Saudler & W. Karo, *Organic Function Group Preparation* (published by Academic Press Co.), pages 312 to 315 (1968); M. Chamdon et al, *Bulletin de la Society Chimique de Pance,* 723 (1954); D. A. Shirley & D. W. Alley, *Journal of the American Chemical Society,* 79, 4992 (1954); A. Whol & W. Marchwald, Ber., Vol. 22, page 568 (1889); *Journal of the American Chemical Society,* 44, 1502 to 1510: U.S. Pat. No. 3,017,270, British Patent 940,169, JP-B-49-8334, JP-A-55-59463; Advanced in Heterocyclic Chemistry, 9, 165 to 209 (1968); West German Patent 2,716,707; *The Chemistry of Heterocyclic Compounds Imidazole and Derivatives,* Vol. 1, page 384; *Organic Synthesis,* IV., 569 (1963); Ber., 9, 465 (1976); *Journal of American Chemical Society,* 45, 2390 (1923); JP-A-50-89034, JP-A-53-28426, JP-A-55-21007, JP-B-40-28496.

Compounds of formula (A) are incorporated into silver halide emulsion layers and hydrophilic colloid layers (interlayer, surface protective layer, yellow filter layer, antihalation layer).

Preferably, they are incorporated into silver halide emulsion layers or their adjacent layers.

The amount of the compound (A) to be added to the layers is from $1\times10^{-7}$ to $1\times10^{-3}$ mol/m$^2$, preferably from $5\times10^{-7}$ to $1\times10^{-4}$ mol/m$^2$, more preferably from $1\times10^{-6}$ to $3\times10^{-5}$ mol/m$^2$.

The above-mentioned emulsion of the present invention is preferably a monodispersed one.

A monodispersed emulsion as referred to herein means one having a particular grain size distribution as defined by a fluctuation coefficient $S/\bar{r}$ of being 0.25 with respect to the grain size of silver halide grains, in which $\bar{r}$ indicates a mean grain size and S indicates a standard deviation of grain size. Precisely, where the grain size of the respective emulsion grains is represented by ri, and the number of the grains is represented by $n_i$, the mean grain size of $\bar{r}$ is defined as follows:

$$\bar{r} = \sqrt{\frac{\Sigma n_i \cdot r_i}{\Sigma n_i}}$$

and the standard deviation S is as follows:

$$S = \sqrt{\frac{\Sigma(r - r_i)^2 \cdot ni}{\Sigma ni}}$$

The grain size of each grain in silver halide emulsions as referred to herein means a projected area-corresponding diameter, which is a diameter of the projected area to be obtained by microscopically photographing the grain by a well-known method (generally, by electro-microscopic photography), for example, as described in T. H. James et al, *The Theory of the Photographic Process*, 3rd Ed., pages 36 to 43 (published by MacMillan Publishing Co., 1966). The projected area-corresponding diameter of silver halide grains is therefore defined by the diameter of the circle having the same area as the projected area of the silver halide grain, as mentioned in the above-mentioned literature. Accordingly, even when the shape of silver halide grains is any other than a spherical shape (for example, cubic, octahedral, tetradecahedral, tabular or potato-like shape), the mean grain size r and the standard deviation S can be obtained for the grains.

The fluctuation coefficient of the grain size of the silver halide grains in the emulsion of the invention is 0.25 or less, preferably 20 or less, more preferably 0.15 or less.

The emulsion of the invention may be incorporated into the light-sensitive emulsion layer singly, or alternatively, two or more emulsions each having a different mean grain size or two or more emulsions each having a different mean silver iodide content may be incorporated into the same light-sensitive layer. As mentioned above, the combination of two or more different emulsions is preferred from the viewpoint of control of gradation, control of graininess over the range from a low exposure amount range to a high exposure amount range, and control of color development-dependence (time-dependence, developer composition-dependence (on color developing agent, sodium fulfite), an pH-dependence).

The photographic material of the present invention is not specifically defined, provided that it has at least one blue-sensitive silver halide emulsion layer, at least one green-sensitive silver halide emulsion layer and at least one red-sensitive silver halide emulsion layer on a support. In the material, the number of the silver halide emulsion layers and non-light-sensitive layers as well as the order of the layers on the support is not specifically defined. A typical example is a silver halide color photographic material having several light-sensitive layer units each composed of plural silver halide emulsion layers each having substantially same color-sensitivity but having a different sensitivity degree. The respective light-sensitive layers are unit light-sensitive layers each having a color-sensitivity to any of blue-light, green light and red light. In such multi-layer silver halide color photographic materials, the order of the light-sensitive layer units on the support comprises generally a red-sensitive layer unit, a green-sensitive layer unit and a blue-sensitive layer unit as formed on the support in that order. As the case may be, however, the order may be opposite to that mentioned above, in accordance with the object of the photographic material. As still another embodiment, a different color-sensitive layer may be sandwiched between two other same color-sensitive layers.

Various non-light-sensitive layers such as interlayer may be provided between the above-mentioned silver halide light-sensitive layers, or on or below the uppermost layer or lowermost layers.

Such an interlayer may contain various couplers or DIR compounds described in JP-A-61-43748, JP-A-59-113438, JP-A-59-113440, JP-A-61-20037 and JP-A-61-20038, and it may also contain a conventional color mixing preventing agent.

As the constitution of the plural silver halide emulsions of constituting the respective light-sensitive layer units, a two-layered constitution composed of a high-sensitivity emulsion layer and a low-sensitivity emulsion layer as described in West German Patent 1,121,470 and British Patent 923,045 is preferred. In general, it is preferred that the plurality of light-sensitive layers are arranged on the support in such a way that the sensitivity degree of the layer decreases gradually in the direction of the support. In that embodiment, a non-light-sensitive layer may be provided between the plurality of silver halide emulsion layers. As another embodiment, a low-sensitivity emulsion layer is formed remote from the support and a high-sensitivity emulsion layer is formed near the support, as described JP-A-57-112751, JP-A-62-200350, JP-A-62-206541, and JP-A-62-206543.

Specific examples of the layer constitution on the support include an order of low-sensitivity blue-sensitive layer (BL)/high-sensitivity blue-sensitive layer (BH)/high-sensitivity green-sensitive layer (GH)/low sensitivity green-sensitive layer (GL)/high-sensitivity red-sensitive layer (RH)/low-sensitivity red-sensitive layer (RL) from the momotest side from the support; and an order of BH/BL/GL/GH/RH/RL; and an order of BH/BL/GH/GL/RL/RH.

Other examples include an order of blue-sensitive layer/GH/RH/GL/RL form the remotest side from the support, as described in JP-B-55-34932; and an order of blue-sensitive layer/GL/RL/GH/RH from the remotest side from the support, as described in JP-A-56-25738 and JP-A-62-63936.

A further example is a three-layer unit constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of the type, .the sensitivity degree of each emulsion layer is gradually lowered in the direction of the support. Even in the three-layer constitution of that type, each of the same color-sensitivity layers may be composed of three layers of middle-sensitivity emulsion layer/high-sensitivity emulsion layer/low-sensitivity emulsion layer as formed in this order from the side remotest to the support, as so described in JP-A-59-202464.

Further examples include a three-layer unit constitution of high-sensitivity emulsion layer/low-sensitivity emulsion layer/middle-sensitivity emulsion layer, and a three-layer unit constitution of low-sensitivity emulsion layer/middle-sensitivity emulsion layer/high-sensitivity emulsion layer.

The same orders as above shall apply also to other multiple layer unit constitutions composed of four layers or more layers.

As mentioned above, various layer constitutions and arrangements may be selected in preparing the photographic materials of the present invention in accordance with the object thereof.

Next, other silver halides than those as specifically defined in the present invention, which are employed along with the particular grains in the present invention, will be mentioned below.

Preferably, silver halides to be in the photographic emulsion layers constituting the photographic materials of the present invention are silver iodobromide, silver iodochloride or silver iodochlorobromide grains having a silver iodide content of about 30 mol % or less. Especially preferred are silver iodobromide or silver iodochlorobromide grains having a silver iodide content of from about 2 mol % to about 10 mol %.

The silver halide grains in the photographic emulsions constituting the photographic material of the present invention may be regular crystalline ones such as cubic, octahedral or tetradecahedral grains, or irregular crystalline ones such as spherical or tabular grains, or irregular crystalline ones having a crystal defect such as a twin plane, or composite crystalline ones composed of the above-mentioned regular and irregular crystalline forms.

Regarding the grain size of the silver halide grains, they may be fine grains having a small grain size of about 0.2 micron or less or may be large ones having a large grain size of up to about 10 microns as the diameter of the projected area. The emulsion of the grains may be either a polydispersed emulsion or a monodispersed emulsion.

The silver halide photographic emulsions to be used in the present invention may be prepared by various methods, for example, those described in *Research Disclosure* (RD) No. 17643 (December, 1978), pages 22 to 23 (I. Emulsion Preparation and Types); *RD* No. 18716 (November, 1979), pages 648: *RD* No. 307105 (November, 989), pages 863 to 865; P. Glafkides, *Chimie et Physique Photographique* (published by Paul Montel, 967}; G. F. Duffin, *Photographic Emulsion Chemistry* (published by Focal Press, 1966); and V. L. Zelikman et al, *Making and Coating Photographic Emulsion* (published by Focal Press, 1964).

Monodispersed emulsions described in U.S. Pat. Nos. 3,574,628 and 3,655,394 and British Patent 1,413,748 are also preferably used in the present invention.

Additionally, tabular grains having an aspect ratio of about 3 or more may also be used in the present invention. Such tabular grains may easily be prepared in accordance with the various methods, for example, as described in Gutoff, *Photographic Science and Engineering*, Vol. 14, pages 248 to 257 (1970); and U.S. Pat. Nos. 4,434,226, 4,414,310, 4,430,048, 4,439,520 and British Patent 2,112,157.

Regarding the crystal structure of the silver halide grains constituting the emulsions of the invention, the grains may have the same amount of silver halide throughout the whole grain, or they may have different amount of silver halide between the inside part and the outside part of one grain, or they may have a layered structure. Further, the grains may have different halogen compositions conjugated by an epitaxial bond, or they may have components other than silver halides, such as silver rhodanide or lead oxide, conjugated with the silver halide matrix. Additionally, a mixture of various grains of different crystalline forms may be employed in the present invention.

The above-mentioned emulsions for use in the present invention may be either surface latent image-type ones which form latent images essentially on the surfaces of the silver halide grains or internal latent image-type ones which form latent images essentially in the inside of the same. In any event, they must necessarily be negative emulsions. Regarding the latter case of internal latent image-type silver halide emulsions, they may be core/shell-type internal latent image-type emulsions as described in JP-A-63-264740. Preparation of core/shell-type internal latent image-type emulsions is described in JP-A-59-133542. In the emulsions of that type, the thickness of the shell of the grain is preferably from 3 to 40 nm, especially preferably from 5 to 20 nm, though varying in accordance with the condition of development of the emulsions.

The emulsions for use in the invention are generally physically ripened, chemically ripened and/or color sensitized. Additives to be used in such a ripening or sensitizing step are described in *Research Disclosure* Nos. 17643, 18716 and 307105, and the related descriptions in these references are mentioned below.

In preparing the photographic material of the present invention, two or more emulsions which are different from each other with respect to at least one characteristic, (1) the grain size of the light-sensitive silver halide grains, (2) the grain size distribution of he emulsions, (3) the halogen composition of the grains and the shape of the grains and (4) the sensitivity of the emulsions, may be incorporated into the same layer.

Surface-fogged silver halide grains described in U.S. Pat. No. 4,082,553, core-fogged silver halide grains described in U.S. Pat. No. 4,626,498 and JP A-59 214852, and colloidal silver may preferably be incorporated into light-sensitive silver halide emulsion layers and/or substantially non-light-sensitive hydrophilic colloid layers. Inside-fogged or surface-fogged silver halide grains are silver halide grains which may uniformly non-imagewise developed irrespective of the non-exposed area and the exposed area of the photographic material. Preparation of inside-fogged or surface-fogged silver halide grains is described in U.S. Pat. Nos. 4,626,498 and JP-A-59-214852.

The silver halide of forming the internal core of the inside-fogged core/shell type silver halide grains may have the same halogen composition or different two or more halogen compositions. As the inside-fogged or surface-fogged silver halide, any of silver chloride, silver chlorobromide, silver iodobromide or silver chloroiodobromide may be employed. The grain size of the fogged silver halide grains is not specifically defined but is preferably from 0.01 to 0.75 μm, especially preferably from 0.05 to 0.6 μm as the mean grain size. The shape of the grains is not also specifically defined, and the grains may be regular grains or they are in the form of a polydispersed emulsion or a monodispersed emulsion. The term "monodispersed emulsion" as used herein means an emulsion in which at least 95% by weight or by number of the silver halide grains have a grain size falling within the range of the mean grain size plus/minus 40%. Preferably, the emulsion is a monodispersed one.

In preparing the photographic material of the present invention, fine non-light-sensitive silver halide grains are preferably used. Fine non-light-sensitive silver halide grains are fine silver halide grains which are not sensitized by light with imagewise exposure for forming color images and therefore are not substantially developed in the successive development. It is preferred that these grains are not previously fogged.

Such fine silver halide grains have a silver bromide content of from 0 to 100 mol %, and if desired, they may contain silver chloride and/or silver iodide. Preferably, they contain silver iodide in an amount of from 0.5 to 10 mol %.

The fine silver halide grains are desired to have a mean grain size (mean value of the diameter of the circle which corresponds to the projected area) of from 0.01 to 0.5 μm, more preferably from 0.02 to 0.2 μm.

The fine silver halide grains may be prepared by the same method as that for forming general light-sensitive silver halide grains. In the case, the surfaces of the fine silver halide grains to be formed are neither necessary to be optically sensitized nor necessary to be color sensitized. However, it is preferred to add a known stabilizer, such as triazole compounds, azaindene compounds, benzothiazolium compounds or mercapto compounds or zinc compounds, to the grains, prior to coating the grain-containing emulsions. It is also preferred to incorporate a colloidal silver into the fine silver halide grain-containing layer.

In preparing the photographic material of the present invention, the amount of silver to be coated is preferably 6.0 g/m$^2$ or less, most preferably 4.5 g/m$^2$ or less.

Various known photographic additives can be used for preparing the photographic material of the present invention. They are described in *Research Disclosure* Nos. 17643, 18716 and 307105, and the related descriptions in these references are mentioned below.

| | Type of Additive | RD17643 (December 1978) | RD18716 (November 1979) | RD307105 (November 1989) |
|---|---|---|---|---|
| 1. | Chemical Sensitizer | Page 23 | Page 648, right column | Page 866 |
| 2. | Sensitivity Enhancer | | Page 648, right column | |
| 3. | Color Sensitizer, Supercolor Sensitizer | Pages 23–24 | Page 648 right column - page 649 right column | Pages 866–868 |
| 4. | Whitening Agent | Page 24 | Page 647, right column | Page 868 |
| 5. | Anti-foggant, Stabilizer | Pages 24–25 | Page 649, right column | Pages 868–870 |
| 6. | Light Absorbent, Filter Dye, UV Absorbent | Pages 25–26 | from Page 649, right column - page 650, left column | Page 873 |
| 7. | Stain Inhibitor | Page 25, right column | Page 650, left to right columns | Page 872 |
| 8. | Color Image Stabilizer | Page 25 | page 650, left column | Page 872 |
| 9. | Hardening Agent | Page 26 | Page 651, left column | Pages 874–875 |
| 10. | Binder | Page 26 | Page 651, left column | Pages 873–874 |
| 11. | Plasticizers, Lubricant | Page 27 | Page 650, right column | Page 876 |
| 12. | Coating Aid Surfactant | Pages 26–27 | Page 650, right column | Pages 875–876 |
| 13. | Antistatic Agent | Page 27 | Page 650, right column | Pages 876–877 |
| 14. | Mat Agent | | | Pages 878–879 |

In order to prevent deterioration of the photographic property of the photographic material of the present invention by formaldehyde gas, it is preferred to add a compound to the material which may react with formaldehyde to inactivate it, such as those described in U.S. Pat. Nos. 4,411,987 and 4,435,503.

It is also preferred to incorporate mercapto compounds as described in U.S. Pat. Nos. 4,740,454 and 4,788,132, JP-A-62-18539 and JP-A-1-283551 into the photographic material of the present invention.

It is also preferred to incorporate compounds capable of releasing a foggant, a development accelerator, a silver halide solvent or precursors thereof, irrespective of the amount of the developed silver to be formed by development, as described in JP-A-1-106052, into the photographic material of the present invention.

It is also preferred to incorporate dispersing dyes described in International Patent Laid-Open No. WO088/04794 and Japanese Patent Kohyo Koho Hei-1-502912 and dyes described in U.S. Pat. No. 4,420,555 and JP-A-1-259358 into the photographic material of the present invention.

Various color couplers can be used in the present invention, and examples of appropriate color couplers are described in patent publications referred to in the above-mentioned RD No. 17643, VII-C to G.

As yellow couplers, for example, those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A are preferred.

As magenta couplers, 5-pyrazolone compounds and pyrazoloazole compounds are preferred. For instance, those described in U.S. Pat. Nos. 4,310,619, 4,351,897, European Patent 73,636, U.S. Pat. Nos. 3,061,432, 3,725,045, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and WO(PCT)88/04795 are preferred.

As cyan couplers, phenol couplers and naphthol couplers are preferred. For instance, those described in U.S. Pat. Nos. 4,052,212, 4,146,396, 4,228,122, 4,296,200, 2,369,929, 2,801,171, 1,771,162, 1,895,816, 3,772,002, 3,758,308, 4,334,011, 4,327,173, West German Patent (OLS) No. 3,329,729, European Patents 121,365A, 249,453A, U.S. Pat. Nos. 3,446,622, 4,333,999, 4,753,871, 4,451,559, 4,427,767, 4,690,889, 4,254,212, 4,296,199, and JP-A-61-42658 are preferred.

Polymerized dye-forming couplers may also be used, and typical examples of such couplers are described in U.S. Pat. Nos. 3,451,820, 4,080,211, 4,367,282, 4,409,320, 4,576,910, British Patent 2,102,137, and European Patent 341,184A.

Couplers capable of forming colored dyes having a desired diffusibility may also be used, and those described in U.S. Pat. No. 4,366,237, British Patent 2,125,570, European Patent 96,570, and West German Patent OLS No. 3,234,533 are preferred.

As colored couplers for correcting the unnecessary absorption of colored dyes, those described in RD No. 17643, VII-G, No. 307105, VII-G, U.S. Pat. No. 4,163,670, JP-B-57-39413, U.S. Pat. Nos. 4,004,929, 4,138,258, and British Patent 1,146,368 are preferred. Additionally, couplers for correcting the unnecessary absorption of the colored dyed by the phosphor dye to be released during coupling, as described in U.S. Pat. No. 4,774,181, as well as couplers having a dye precursor group capable of reacting with a developing agent to form a dye, as a split-off groups, as described in U.S. Pat. No. 4,777,120, are also preferably used.

Couplers capable of releasing a photographically useful residue along with coupling may also be used in the present invention. For instance, as DIR couplers of releasing a development inhibit, those described in patent publications identified in the above-mentioned RD No. 17643, VII-F, No. 307,150, VII-F, as well as those described in JP-A-57-151944, JP-A-57-154234, JP-A-60-184248, JP-A-63-37346, U.S. Pat. Nos. 4,248,962 and 4,782,012, are preferred.

As couplers for imagewise releasing a nucleating agent or a development accelerator during development, those described in British Patents 2,097,140 and 2,131,188, and JP-A-59-157638 and JP-A-59-170840 are preferred. Further, compounds for releasing a foggant, a development accelerator or a silver halide solvent by redox reaction with the oxidation product of a developing agent, as described in JP-A-60-107019, JP-A-60-253340, JP-A-1-44940 and JP-A-1-45687, are also preferably used.

Additionally, as examples of couplers which may be incorporated into the photographic materials of the present invention, there are also: competing couplers described in U.S. Pat. No. 4,130,427; poly-valent couplers described in U.S. Pat. Nos. 4,283,472, 4,338,393 and 4,310,618; DIR-redox compound-releasing couplers, DIR coupler-releasing couplers, DIR coupler-releasing redox compound or DIR redox-releasing redox compounds described in JP-A-60-185950 and JP-A-62-24252; couplers for releasing a dye which recolors after being released from the coupler, as described in European Patent 173,302A; bleaching accelerator-releasing couplers as described in RD Nos. 11449 and 24241, and JP-A-201247; ligand-releasing couplers described in U.S. Pat. No. 4,553,477; leuco dye-releasing couplers described in JP-A-63-75747; and couplers for releasing a phosphor dye as described in U.S. Pat. No. 4,774,181.

The above-mentioned couplers can be incorporated into the photographic materials of the present invention by various known dispersion methods.

For instance, an oil-in-water dispersion method may be employed for the purpose. Examples of high boiling point solvents appropriate for the method are described in U.S. Pat. No. 2,322,027. For instance, examples of high boiling point organic solvents having a boiling point of 175° C. or higher at normal pressure, which are used in an oil-in-water dispersion, include phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl) sebacate, dioctyl azelate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately from 30° to 160° C., preferably from 50° to 160° C., can be used. Examples of such auxiliary organic solvents include ethyl acetate, butyl acetate, ethyl propionate, methyl ethyl ketone, cyclohexanone, 2-ethoxyethyl acetate and dimethyl form amide.

A latex dispersion method may also be employed for incorporating couplers into the photographic material of the present invention. The steps of carrying out the dispersion method, the effect of the method and examples of latexes usable in the method for impregnation are described in U.S. Pat. No. 4,199,363, West German Patent (OLS) Nos. 2,541,174 and 2,541,130.

The color photographic materials of the present invention preferably contain various antiseptics or antifungal agents, such as phenethyl alcohol, as well as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole as described in JP-A-63-57747, JP-A-62-272248 and JP-A-1-80941.

The present invention may apply to various color photographic materials. In particular, specific examples are general or movie color negative films, slide or television color reversal films, color papers, color positive films and color reversal papers.

Supports which are appropriate for the photographic materials of the present invention are described, for example, in the above-mentioned RD No. 17643, page 28, RD No. 18716, from page 647, right column to page 648, left column, and RD No. 307105, page 879.

In the photographic material of the present invention, the total film thickness of all the hydrophilic colloid layers on the side of the emulsion layers-having surface is desired to be 28 μm or less, preferably 18 μm or less, more preferably 16 μm or less. The photographic material is further desired to have a film swelling rate ($T_{\frac{1}{2}}$) of 30 seconds or less, more preferably 20 seconds or less. The film thickness means one as measured under the condition of a temperature of 25° C. and a relative humidity of 55%, the photographic material to be measured being conditioned under that condition for 2 days before measurement; and the film swelling rate ($T_{\frac{1}{2}}$) may be measured by a method well known in this technical field. For instance, a swellometer of the type as described in A. Green, *Photographic Science Engineering*, Vol. 19, No. 2, pages 124 to 129 can be used for the purpose. The specific film swelling rate ($T_{\frac{1}{2}}$) is defined as follows: 90% of the maximum swollen thickness of the photographic material as processed in a color developer under the condition of 30° C. and 3 minutes and 15 seconds is called a saturated swollen thickness. The time necessary for attaining a half(½) of the saturated swollen thickness is defined to be a film swelling rate ($T_{\frac{1}{2}}$).

The film swelling rate ($T_{\frac{1}{2}}$) may be adjusted by adding a hardening agent to gelatin of a binder in the photographic material or by varying the aging condition after coating the photographic layers on the support. The swelling percentage is desired to be from 150 to 400%. The swelling percentage may be obtained from the maximum swollen thickness as measured under the above-mentioned condition, in accordance with the following formula:

Swelling Percentage=(Maximum Swollen Thickness Dry Thickness)/(Dry Thickness)

It is desired that the photographic material of the present invention has a hydrophilic colloid layer having a total dry thickness of from 2 to 20 μm (this is called a "backing layer") on the surface opposite to that coated with the above-mentioned photographic emulsion layers. The backing layer preferably contains the above-mentioned light-absorbing agent, filter dye, ultraviolet absorbent, antistatic agent, hardening agent, binder, plasticizer, lubricant, coating aid, and surfactant. The backing layer is desired to have a swelling percentage of from 150 to 500%.

The color photographic material of the present invention can be developed by any conventional methods, for example, as described in the above-mentioned RD No. 17643, pages 28 and 29, RD No. 18716, page 651, from left column to right column, and RD No. 307105, pages 880 to 881.

The color developer for use in development of the photographic material of the present invention is preferably an aqueous alkaline solution consisting essentially of an aromatic primary amine developing agent. As the color developing agent for the developer, p-phenylenediamine compounds are preferably used, although aminophenol compounds are also useful. Specific examples of the compounds include 3-methyl-4-amino-N,N-diethylaniline, 3-methyl-4-amino-N-ethyl-N-β-hydroxyethylaniline, 3-methyl-4-amino-N-ethyl-N-βmethanesulfonamidoethylaniline, and 3-methyl-4-amino-N-ethyl-N-β-methoxyethylaniline, as well as sulfates, hydrochlorides and p-toluenesulfonates thereof. Above all, especially preferred is 3-methyl-4-amino-N-ethyl-β-hydroxyethylaniline sulfate. Two or more of these compounds can be used in combination, in accordance with the object.

The color developer generally contains a pH buffer such as alkali metal carbonates, borates or phosphates and a development inhibitor or an antifoggant such as chlorides, bromides, iodides, benzimidazoles, benzothiazoles or mercapto compounds. In addition, the developer may further contain, if desired, various preservatives such as hydroxylamine, diethylhydroxylamine, sulfites, hydrazines (e.g., N,N-biscarboxymethylhydrazine), phenylsemicarbazides, triethanolamine or catecholsulfonic acids; an organic solvent such as ethylene glycol or diethylene glycol; a development accelerator such as benzyl alcohol, polyethylene glycol, quaternary ammonium salts or amines; a color-forming coupler; a competing coupler; an auxiliary developing agent such as 1-phenyl-3-pyrazolidone; a tackifier; and various chelating agents such as aminopolycarboxylic acids, aminopolyphosphonic acids, alkylphosphonic acids, or phosphonocarboxylic acids. Specific examples of such chelating agents include ethylenediaminetetraacetic acid, nitrilotriacetic acid, diethylenetriaminepentaacetic acid, cyclohexanediamine-tetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof.

When reversal processing is carried out, the photographic material is first subjected to black-and-white development, then to reversal processing and thereafter to color development. The black-and-white developer to be used in the black-and-white development may contain known black-and-white developing agents, for example, dihydroxybenzenes such as hydroquinone, 3-pyrazolidones such as 1-phenyl-3-pyrazolidone or aminophenols such as N-methyl-p-aminophenol, either singly or in combination thereof.

The color developer and black-and-white developer generally have a pH value of from 9 to 12. The amount of the replenisher for the developer is, although depending upon the color photographic material to be processed, generally 3 liters or less per $m^2$ of the material. By lowering the bromide ion concentration in the replenisher, the amount may be 500 ml or lower. When the amount of the replenisher to be added is lowered, it is desired to prevent the evaporation and aerial oxidation of the processing solution by reducing the contact surface area of the processing tank with the air.

The contact surface area of the processing solution with air in the processing tank is represented by the opening ratio which is defined by the following formula:

Opening Ratio=(Contact Surface Area ($cm^2$) of Processing Solution with air)/(Volume ($cm^3$) of Processing Tank)

The above-mentioned opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A-1-82033 and employment of the slit-developing method described in JP-A-63-216050. Reduction of the opening ratio is preferably applied not only to both steps of color development and black-and-white development but also to all the subsequent steps such as bleaching, bleach-fixation, fixation, rinsing and stabilization steps. In addition, the amount of the replenisher to be added may also be reduced by means of suppressing accumulation of bromide ions in the developer.

The time for the color development is generally within the range of from 2 minutes to 5 minutes, but the processing time may be shortened by elevating the processing temperature, elevating the pH value of the processing solution or elevating the concentration of the processing solution.

After color development, the photographic emulsion layer is generally bleached. Bleaching may be carried out simultaneously with fixation (bleach-fixation) or separately from the latter. In order to accelerate the photographic processing, bleaching may be followed by bleach-fixation. In addition, bleach-fixation in continuous two processing tanks, fixation prior to bleach-fixation or bleach-fixation followed by bleaching may also be applied to the photographic material of the present invention, in accordance with the object thereof. The bleaching agent may include compounds of polyvalent metals such as iron(III), peracids, quinones, and nitro compounds. Specific examples of the bleaching agent appropriate for the present invention include organic complexes of iron(III), such as complexes thereof with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycol-ether-diaminetetraacetic acid or with organic acids such as citric acid, tartaric acid or maleic acid. Among them, aminopolycarboxylato/iron(III) complexes such as ethylenediaminetetraacetato/iron(III) complex and 1,3-diaminopropanetetraacetato/iron(III) complex are preferred in view of the rapid processability thereof and because they use reduces environmental pollution. The aminopolycarboxylato/iron(III) complexes are especially useful both in a bleaching solution and in a bleach-fixing solution. The bleaching solution or bleach-fixing solution containing such aminopolycarboxylat/iron(III) complexes generally has a pH value of from 4.0 to 8.0, but the solution may have a lower pH value for rapid processing.

The bleaching solution, the bleach-fixing solution and the previous bath may contain a bleaching accelerating agent, if desired. Various bleaching accelerating agents are known, and examples of the agents which are advantageously used in the present invention include mercapto group or disulfide group-containing compounds described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426 and *Research Disclosure* No. 17129 (June, 1978); thiazolidine derivatives described in JP-A-50-140129; thiourea derivatives described in JP-B-45-8506, JP-A-52-20832 and JP-A-53-32735, U.S. Pat. No. 3,706,561; iodides described in West German Patent 1,127,715, JP-A-56-16235; polyoxyethylene compounds described in West German Patents 966,410 and 2,748,430; polyamine compounds described in JP-B-45-8836; other compounds described in JP-A-49-40943, JP-A-49-59644, JP-A-53-94937, JP-A-54-35727, JP-A-55-26506, JP-A-58-163940; and bromide ion. Among them, mercapto group or disulfide group-having compounds are preferred because of the high accelerating effect thereof. The compounds described in U.S. Pat. No. 3,893,858, West German Patent 1,290,812 and JP-A-53-95630 are especially preferred. In addition, compounds described in U.S. Pat. No. 4,552,834 are also preferred. The bleaching accelerating agents may also be added to the photographic materials. When picture-taking color photographic materials are bleach-fixed, the bleaching accelerating agents are especially effective.

The bleaching solution and bleach-fixing solution may preferably contain, in addition to the above-mentioned compounds, various organic acids for the purpose of preventing formation of stains in bleaching. Especially preferred organic acids for the purpose are compounds having an acid dissociation constant (pKa) of from 2 to 5. Preferred organic acids are acetic acid and propionic acid.

The fixing agents for the fixing solution or bleach-fixing solution, which is used in processing the photographic material of the present invention, include thiosulfate, thiocyanates, thioether compounds, thioureas and a large amount of iodides. Among them, thiosulfates are generally used, and in particular, ammonium thiosulfate is most widely used. Also preferred is a combination of thiosulfates with thiocyanates, thioether compounds or thioureas. As the preservative for the fixing solution or bleach-fixing solution, sulfites, bisulfites, carbonyl-bisulfite adducts, as well as sulfinic acid compounds described in European Patent 294769A are preferred. Further, it is also preferred to add various aminopolycarboxylic acids or organic phosphonic acids to the fixing solution of bleach-fixing solution for the purpose of stabilizing it.

The fixing solution or bleach-fixing solution may preferably contain compounds having a pKa value of from 6.0 to 9.0, preferably imidazoles such as imidazole, 1-methylimidazole, 1-ethylimidazole or 2-methylimidazole, in an amount of from 0.1 to 10 mol/liter, for the purpose of suitably adjusting the pH value of the solution.

In processing the photographic material of the present invention, the total processing time in the desilvering step is preferably shorter only to the extent of not causing desilvering failure. The preferred processing time is therefore from 1 minute to 3 minutes, more preferably from 1 minute to 2 minutes. The processing temperature may be from 25° to 50° C., especially preferably from 35° to 45° C. In such a preferred processing temperature range, the desilvering speed is accelerated and formation of stains in the processed photographic material may be effectively inhibited.

In the desilvering step, it is preferred that stirring means for the photographic material being processed (or desilvered) is reinforced as much as possible. Examples of reinforced stirring means for forcedly stirring the photographic material drying the desilvering step include a method of running a jet stream of the processing solution to the emulsion-coated surface of the material, as described in JP-A-62-183460; a method of promoting the stirring effect by the use of a rotating means, as described in JP-A-62-183461; a method of moving the photographic material being processed in the processing bath while the emulsion-coated surface of the material is brought into contact with a wiper blade provided in the processing bath, whereby the processing solution applied to the emulsion-coated surface of the material is made turbulent and the stirring effect is promoted; and a method of increasing the total amount of the circulating processing solution. Such reinforced stirring means are effective with the bleaching solution, bleach-fixing solution and fixing solution. It is believed that reinforcement of stirring of the processing solution would promote penetration of the bleaching agent and fixing agent into the emulsion layer of the photographic material being processed. As a result, the desilvering rate in processing the material would be elevated. The above-mentioned reinforced stirring means is more effective, when a bleaching accelerator is incorporated into the processing solution. Because of the stirring means, therefore, the bleaching accelerating effect could remarkably be augmented, and the fixation preventing effect of the bleaching accelerator could be evaded.

In processing the photographic material of the present invention, an automatic developing machine is preferably used. The automatic developing machine to be used for processing the photographic material of the present invention is desired to be equipped with a photographic material-conveying means as described in JP-A-60-191257, JP-A-60-191258, JP-A-60-191259. As is noted from the related disclosure of JP-A-60-191257, the conveying means may noticeably reduce the carryover amount from the previous bath to the subsequent bath and therefore it is extremely effective for preventing deterioration of the processing solution being used. Because of these reasons, the conveying means is especially effective for shortening the processing time in each processing step and for reducing the amount of the replenisher to each processing bath.

The silver halide color photographic material of the present invention is generally rinsed in water and/or stabilized, after being desilvered. The amount of the water to be used in the rinsing step can be set in a broad range, in accordance with the characteristic of the photographic material being processed (for example, depending upon the raw material components, such as the coupler and so on) or the use of the material, as well as the temperature of the rinsing water, the number of the rinsing tanks (the number of the rinsing stages), the replenishment system of normal current or countercurrent and other conditions. Among these conditions, the relation between the number of the rinsing tanks and the amount of the rinsing water in a multi-stage countercurrent rinsing system can be obtained by the method described in *Journal of the Society of the Motion Picture and Television Engineers,* Vol. 64, pages 248 to 253 (May, 1955).

According to the multi-stage countercurrent system described in the above-mentioned reference, the amount of the rinsing water to be used can be reduced noticeably, but because .of the prolongation of the residence time of the water in the rinsing tank, bacteria would propagate in the tank so that the floating substances generated by the propagation of bacteria would adhere to the surface of the material as it was processed. Accordingly, the above system would often presents problems. In the practice of processing the photographic material of the present invention, the method of reducing calcium and magnesium ions, which is described in JP-A-62-288838, can extremely effective in overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms,* edited by Association of Sanitary Technique, Japan, 1982, published by Kogyo Gijutsu-kai, Japan), and *Encyclopedia of Bactericidal and Fungicidal Agents,* edited by Nippon Bactericide and Fungicide Association (1988), can be used.

The pH value of the rinsing water to be used for processing the photographic material of the present invention is from 4 to 9, preferably from 5 to 8. The temperature of the rinsing water and the rinsing time can also be set in accordance with the characteristics of the photographic material being processed as well as the use thereof. In general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may be processed directly with a stabilizing solution instead of being rinsed with water. For stabilization, any known methods, for example as described in JP-A-57-8543, JP-B-58-14834 and JP-B-60-220345, can be employed.

In addition, the material can also be stabilized, following the rinsing step. One example thereof is a stabilizing bath containing a dye stabilizer and a surfactant, which is used as a final bath for picture-taking color photographic materials. Examples of dye stabilizers in the bath include aldehydes such as formaldehyde or glutaraldehyde, N-methylol compounds, hexamethylenetetramine and aldehydesulfite adducts.

The stabilizing bath may also contain various chelating agents and fungicides.

The overflow from the rinsing and/or stabilizing solutions because of addition of replenishers thereto may be re-used in the other steps such as the previous desilvering step.

Where the processing solutions are evaporated and concentrated in the process to be carried out with an automatic developing machine, it is preferred to add water to compensate and correct the concentrated solutions.

The silver halide color photographic material o the present invention can contain a color developing agent for the purpose of simplifying and accelerating the processing of the material. For incorporation of color developing agents into the photographic material, various precursors of the agents are preferably used. Such agent precursors include indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A-53-135628.

The silver halide color photographic material of the present invention can contain various kinds of 1-phenyl-3-pyraozlidones, if desired, for the purpose of accelerating the color developability thereof. Specific examples of these compounds are described in JP-A-56-64339, JP-A-57-144547 and JP-A-58-115438.

The processing solutions for the photographic material of the present invention are used at 10° C. to 50° C. In general, a processing temperature of from 33° C. to 38° C. is standard, but the temperature may be set higher to accelerate the processing or to shorten the processing time, or on the contrary, the temperature may be made lower to improve the quality of images formed and to improve the stability of the processing solutions used.

The present invention may also apply to heat-developing photographic materials described in U.S. Pat. No. 4,500,626, JP-A-60-133449, JP-A-59-218433, JP-A-61-238056 and European Patent 210,660A2.

The present invention will be explained in more detail by way of the following examples, which, however, are not intended to restrict the scope of the present invention.

EXAMPLE 1

Preparation of Emulsions

An aqueous solution prepared by dissolving 20 g of inactive gelatin, 2.4 g of potassium bromide and 2.05 g of potassium iodide in 800 ml of distilled water was stirred at 58° C., to which 150 cc of an aqueous solution containing 5.0 g of silver nitrate was added thereto all at a time. Further an excess amount of potassium bromide was added thereto still with stirring, and thereafter the resulting solution was physically ripened for 20 minutes. Next, in accordance with the method described in U.S. Pat. No. 4,242,445, 0.2 mol/liter 0.67 mol/liter and 2 mol/liter of aqueous silver nitrate solution and aqueous potassium halide solution (containing 58 mol % of potassium bromide and 42 mol % of potassium iodide) were added to the thus ripened solution, each at a flow rate of 10 cc/min. Accordingly, 42 mol % of silver iodobromide grains grew. These grains were rinsed with water for desalting, and an Emulsion (a) was thus obtained. The final amount of the finished Emulsion (a) was 900 g. Emulsion (a) had a mean grain size of 0.61 μm. In the same manner as in preparation of Emulsion (a), Emulsions (b), (c), (d) and (e) were prepared, which had a silver iodide content of 42 mol % and a mean grain size of 0.59 μm, 0.56 μm, 0.52 μm and 0.46 μm, respectively.

Three hundred g of the emulsion (a) was weighed, and 850 cc of distilled water and 30 cc of 10% potassium bromide were added thereto and heated up to 70° C. With stirring, 0.02 g of Compound (18) was added thereto. The resulting emulsion was adjusted to have pAg of 8.0. Next, 300 cc of an aqueous solution containing 33 g of silver nitrate and 320 cc of an aqueous solution containing 25 g of potassium bromide were simultaneously added to the emulsion over a period of 40 minutes, and further 800 cc of an aqueous solution containing 100 g of silver nitrate and 860 cc of an aqueous solution containing 75 g of potassium bromide were also simultaneously added thereto over a period of 60 minutes. Accordingly, a silver iodobromide Emulsion (1) having a silver iodide content of 14 mol % and a mean grain size of 0.88 μm was prepared. The grains in the Emulsion (1) were twin grains having an aspect ratio of 2.0 and the proportion of (111) plane in the grains was 80%. Next, 300 g of the Emulsion (b) was weighed and treated in the same manner as above, in which 125 g, as a total, of silver nitrate was added to the emulsion for shelling. Accordingly, a silver iodobromide Emulsion (2) having a silver iodide content of 12 mol % was prepared. Also in the same manner as above, Emulsions (3) to (5) were prepared.

Additionally, Emulsions (6) to (9) were prepared in the same manner as in preparation of Emulsions (1) to (4), respectively, except that the shelling condition was varied to that having a temperature of 60° C. and a pAg value of 9.0 and that Compound (18) was not added.

133 g of Emulsion (b) and 167 g of Emulsion (d) were weighed and they were shelled in the same manner as that of preparing Emulsion (3) from 300 g of Emulsion (c). Accordingly, Emulsion (10) was prepared. Further, 50 g of Emulsion (a), 200 g of Emulsion (c) and 50 g of Emulsion (d) were weighed and were shelled in the same manner as that of preparing Emulsion (3) from 300 g of Emulsion (c). Accordingly, Emulsion (11) was prepared. Characteristic values of all these emulsions are shown in Table (A) below.

Next, a plurality of layers each having the composition mentioned below was formed on a subbing layer-coated cellulose triacetate film support, to prepare a multi-layer color photographic material sample (No. 101).

Compositions of Light-Sensitive Layers

The numbers corresponding to the respective components mentioned below indicate the amounts coated, which were represented by the unit of g/m². For silver halides, the number indicates the amount of silver therein. For sensitizing dyes, the amount is represented by the unit of mols per mol of the silver halide in the same layer.

Sample No. 101

| | |
|---|---|
| First Layer: Anti-Halation Layer | |
| Black Colloidal Silver | 0.18 (as Ag) |
| Gelatin | 1.40 |
| Second Layer: Interlayer | |
| 2,5-Di-t-pentadecylhydroquinone | 0.18 |
| EX-1 | 0.070 |
| EX-3 | 0.020 |
| EX-12 | 0.0020 |
| U-1 | 0.060 |
| U-2 | 0.080 |
| U-3 | 0.10 |
| HBS-1 | 0.10 |
| HBS-2 | 0.020 |
| Gelatin | 1.04 |
| Third Layer: First Red-Sensitive Emulsion Layer | |
| Emulsion (A) | 0.25 (as Ag) |
| Emulsion (B) | 0.25 (as Ag) |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.335 |
| EX-10 | 0.020 |
| U-1 | 0.070 |
| U-2 | 0.050 |
| U-3 | 0.070 |
| HBS-1 | 0.060 |
| Gelatin | 0.87 |
| Fourth Layer: Second Red-Sensitive Emulsion Layer | |
| Emulsion (G) | 1.00 (as Ag) |
| Sensitizing Dye | $5.1 \times 10^{-5}$ |
| Sensitizing Dye II | $1.4 \times 10^{-5}$ |
| Sensitizing Dye III | $2.3 \times 10^{-4}$ |
| EX-2 | 0.400 |
| EX-3 | 0.050 |
| EX-10 | 0.015 |
| U-1 | 0.070 |
| U-2 | 0.050 |
| U-3 | 0.070 |
| Gelatin | 1.30 |
| Fifth Layer: Third Red-Sensitive Emulsion Layer | |
| Emulsion (1) | 1.60 (as Ag) |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.63 |
| Sixth Layer: Interlayer | |
| EX-5 | 0.040 |
| HBS-1 | 0.020 |
| Gelatin | 0.80 |
| Seventh Layer: First Green-Sensitive Emulsion Layer | |
| Emulsion (A) | 0.15 (as Ag) |
| Emulsion (B) | 0.15 (as Ag) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-3 | 0.010 |
| Gelatin | 0.63 |
| Eighth Layer: Second Green-Sensitive Emulsion Layer | |
| Emulsion (C) | 0.45 (as Ag) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.094 |
| EX-8 | 0.018 |
| EX-7 | 0.026 |
| HBS-1 | 0.160 |
| HBS-3 | 0.008 |
| Gelatin | 0.50 |

-continued

| | |
|---|---|
| Ninth Layer: Third Green-Sensitive Emulsion Layer | |
| Emulsion (E) | 1.2 (as Ag) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Tenth Layer: Yellow Filter Layer | |
| Yellow Colloidal Silver | 0.02 (as Ag) |
| EX-5 | 0.08 |
| HBS-1 | 0.03 |
| Gelatin | 0.95 |
| Eleventh Layer: First Blue-Sensitive Emulsion Layer | |
| Emulsion (A) | 0.080 (as Ag) |
| Emulsion (B) | 0.070 (as Ag) |
| Emulsion (F) | 0.070 (as Ag) |
| Sensitizing Dye VIII | $3.5 \times 10^{-4}$ |
| EX-9 | 0.721 |
| EX-8 | 0.042 |
| HBS-1 | 0.28 |
| Gelatin | 1.10 |
| Twelfth Layer: Second Blue-Sensitive Emulsion Layer | |
| Emulsion (G) | 0.45 (as Ag) |
| Sensitizing Dye VIII | $2.1 \times 10^{-4}$ |
| EX-9 | 0.154 |
| EX-10 | 0.007 |
| HBS-1 | 0.05 |
| Gelatin | 0.78 |
| Thirteenth Layer: Third Blue-Sensitive Emulsion Layer | |
| Emulsion (H) | 0.77 (as Ag) |
| Sensitizing Dye VIII | $2.2 \times 10^{-4}$ |
| EX-9 | 0.20 |
| HBS-1 | 0.07 |
| Gelatin | 0.69 |
| Fourteenth Layer: First Protective Layer | |
| Emulsion I | 0.20 (as Ag) |
| U-4 | 0.11 |
| U-5 | 0.17 |
| HBS-1 | 0.05 |
| Gelatin | 1.00 |
| Fifteenth Layer: Second Protective Layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

In addition to the above-mentioned components, all the layers contained (W-1), (W-2), (W-3), (B-4), (B-5), (F-1), (F-2), (F-3), (F-4), (F-5), (F-6), (F-7), (F-8), (F-9), (F-10), (F-11), (F-12), (F-13), and iron salt, lead salt, bold salt, platinum salt, iridium salt and rhodium salt, for the purpose of improving the storage stability, processability, pressure-resistance, anti-fungal property, anti-bacterial property, antistatic property and coatability.

Sample Nos. 102 to 111

Samples Nos. 102 to 111 were prepared in the same manner as Sample No. 101, except that the Emulsion (I) in the fifth layer of Sample No. 101 was varied as indicated in Table (B) below.

Samples Nos. 112 to 122

Samples Nos. 112 to 122 were prepared in the same manner as Samples Nos. 101 to 111, respectively, except that Yellow Colored Cyan Coupler (YC-28) of the present invention was added to the third layer, fourth layer and fifth layer in an amount of 0.025 g/m$^2$, 0.070 g/m$^2$ and 0.010 g/m$^2$, respectively.

Samples Nos. 123 and 124

Samples Nos. 123 and 124 were prepared in the same manner as Sample No. 112, except that 40%, as silver, of Emulsion (1) in the fifth layer was replaced by Emulsion (10) and Emulsion (B), respectively.

All these samples were imagewise exposed with a white light and then color-developed in accordance with the procedure mentioned below. The photographic properties of the thus processed samples were shown in Table 1 below, along with the RMS value (value of cyan image as measured with a 48 μm-diameter aperture) to indicate the graininess thereof. For determining the sharpness, the samples were processed in the same manner, and the processed samples were measured by a conventional MTF method. Additionally, the samples were imagewise exposed with a red light, and the color turbidity of each sample was obtained as a value calculated by subtracting the yellow density at the cyan-fogged density from the yellow density at the point of giving the cyan density (fog+1.5).

As is obvious from the results shown in Table 1 below, only the samples of the present invention, which contain the particular emulsion of the present invention and the particular yellow colored cyan coupler of the present invention, had a high sensitivity and excellent graininess and sharpness in the low density area and the middle density area. Additionally, it is also obvious that only the samples of the present invention have an excellent color reproducibility. Investigating the Samples Nos. 112, 121 and 122 each containing the Emulsions (1), (10) and (11), respectively, it is understood that the graininess is better when the fluctuation coefficient of the grain size is small. Investigating Samples Nos. 123 and 124 in which Emulsion (1) of the invention was combined with the additional Emulsion (10) of the same kind or with the additional Emulsion (11) of a different kind, it is understood that the effect of the present invention is positive even when two different emulsions are combined.

Color development of the samples was effected by the use of an automatic developing machine, at 38° C. in accordance with the following procedure:

| | |
|---|---|
| Color Development | 2 min 45 sec |
| Bleaching | 1 min |
| Bleach-Fixation | 3 min 15 sec |
| Rinsing (1) | 40 sec |
| Rinsing (2) | 1 min |
| Stabilization | 40 sec |
| Drying (50° C.) | 1 min 15 sec |

In the above-mentioned procedure, rinsing was effected by countercurrent rinsing system from the rinsing tank (2) to the rinsing tank (1).

Next, compositions of the processing solutions used in the above-mentioned steps are mentioned below.

The amount of the replenisher to the color developer was 1200 ml per m$^2$ of the color photographic material being processed; and amount of the replenisher to the other components including the rinsing water was 800 ml per m$^2$ of the same. The amount of the carryover from the previous bath to the rinsing step was 50 ml per m$^2$ of the color photographic material being processed.

| | Mother Solution | Replenisher |
|---|---|---|
| Color Developer: | | |
| Diethylenetriaminepentaacetic Acid | 1.0 g | 1.1 g |
| 1-Hydroxyethylidene-1,1-diphosphonic Acid | 2.0 g | 2.2 g |
| Sodium Sulfite | 4.0 g | 4.4 g |
| Potassium Carbonate | 30.0 g | 32.0 g |
| Potassium Bromide | 1.4 g | 0.7 g |
| Potassium Iodide | 1.3 mg | — |
| Hydroxylamine Sulfate | 2.4 | 2.6 |
| 4-(N-ethyl-N-(β-hydroxyethyl-amino)-2-methylaniline Sulfate | 4.5 g | 5.0 g |
| Water to make | 1.0 liter | 1.0 liter |
| pH | 10.0 | 10.05 |

Bleaching Solution:

Mother solution and replenisher were same.

| | |
|---|---|
| Ammonium Ethylenediaminetetraacetato/Fe(III) | 120.0 g |
| Sodium Ethylenediaminetetraacetate | 10.0 g |
| Ammonium Sulfate | 10.0 g |
| Ammonium Bromide | 100.0 g |
| Bleaching Accelerator | $5 \times 10^{-3}$ mol |
| Aqueous Ammonia to make | pH of 6.3 |

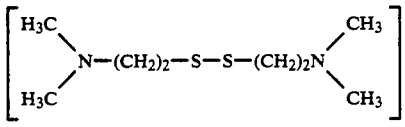

| | |
|---|---|
| Water to make | 1.0 liter |

Bleach-Fixing Solution:

Mother solution and replenisher were same.

| | |
|---|---|
| Ammonium Ethylenediaminetetraacetato/Fe (III) | 50.0 g |
| Disodium Ethylenediaminetetraacetate | 5.0 g |
| Sodium Sulfite | 12.0 g |
| Ammonium Thiosulfate (aqueous solution, 70%) | 240 ml |
| Aqueous Ammonium to make | pH of 7.3 |
| Water to make | 1.0 liter |

Rinsing Water:

Tap water having a calcium ion concentration of 32 mg/liter and a magnesium ion concentration of 7.3 mg/liter was passed through a column filled with an H-type strong acidic cation-exchange resin and an OH-type strong basic anion-exchange resin to obtain a processed water having a calcium ion concentration of 1.2 mg/liter and a magnesium ion concentration of 0.4 mg/liter, to which sodium dichloroisocyanurate was added in the amount of 20 mg/liter. The thus processed water was used as the rinsing water.

Stabilizing Solution:

Mother solution and replenisher were same.

| | |
|---|---|
| Formalin (37% w/v) | 2.0 ml |
| Polyoxyethylene-p-monononylphenyl Ether (mean polymerization degree 10) | 0.3 g |
| Disodium Ethylenediaminetetraacetate | 0.05 g |
| Water to make | 1 liter |
| pH | 5.8 |

Drying:

Drying temperature was 50° C.

TABLE 1

| Sample No. | Emulsion in 5th Layer | Yellow Colored Coupler in 3rd, 4th & 5th Layers | Relative Sensitivity | RMS (fog + 0.2) | RMS (fog + 0.6) | MTF Cyan Image (25 cycle/mm) | Color Turbidity |
|---|---|---|---|---|---|---|---|
| 101 (Comparative Sample) | 1 | — | 0.00 | 16.7 | 16.6 | 53 | 0.12 |
| 102 (Comparative Sample) | 2 | — | 0.00 | 16.8 | 16.5 | 53 | 0.12 |
| 103 (Comparative Sample) | 3 | — | 0.01 | 17.0 | 16.4 | 53 | 0.12 |
| 104 (Comparative Sample) | 4 | — | 0.01 | 17.2 | 16.4 | 54 | 0.12 |
| 105 (Comparative Sample) | 5 | — | 0.01 | 18.3 | 16.8 | 55 | 0.12 |
| 106 (Comparative Sample) | 6 | — | −0.06 | 17.3 | 18.6 | 52 | 0.12 |
| 107 (Comparative Sample) | 7 | — | −0.05 | 17.4 | 18.5 | 52 | 0.12 |
| 108 (Comparative Sample) | 8 | — | −0.04 | 17.7 | 18.1 | 53 | 0.12 |
| 109 (Comparative Sample) | 9 | — | −0.04 | 18.1 | 17.7 | 54 | 0.12 |
| 110 (Comparative Sample) | 10 | — | 0.00 | 17.2 | 17.4 | 53 | 0.12 |
| 111 (Comparative Sample) | 11 | — | 0.00 | 17.7 | 17.2 | 53 | 0.12 |
| 112 (Sample of | 1 | YC-28 | +0.02 | 16.7 | 16.7 | 56 | 0.01 |

TABLE 1-continued

| Sample No. | Emulsion in 5th Layer | Yellow Colored Coupler in 3rd, 4th & 5th Layers | Relative Sensitivity | RMS (fog + 0.2) | RMS (fog + 0.6) | MTF Cyan Image (25 cycle/mm) | Color Turbidity |
|---|---|---|---|---|---|---|---|
| the Invention) | | | | | | | |
| 113 (Sample of the Invention) | 2 | " | +0.02 | 16.9 | 16.7 | 56 | 0.01 |
| 114 (Sample of the Invention) | 3 | " | +0.03 | 17.0 | 16.6 | 56 | 0.01 |
| 115 (Sample of the Invention) | 4 | " | +0.03 | 17.2 | 16.6 | 56 | 0.01 |
| 116 (Comparative Sample) | 5 | " | +0.02 | 18.4 | 17.0 | 56 | 0.01 |
| 117 (Comparative Sample) | 6 | " | −0.04 | 17.5 | 18.9 | 54 | 0.01 |
| 118 (Comparative Sample) | 7 | " | −0.03 | 17.6 | 18.7 | 54 | 0.01 |
| 119 (Comparative Sample) | 8 | YC-28 | −0.02 | 17.9 | 18.2 | 55 | 0.01 |
| 120 (Comparative Sample) | 9 | " | −0.02 | 18.2 | 17.9 | 56 | 0.01 |
| 121 (Sample of the Invention) | 10 | " | +0.02 | 17.4 | 17.5 | 56 | 0.01 |
| 122 (Sample of the Invention) | 11 | " | +0.02 | 17.9 | 17.5 | 55 | 0.01 |
| 123 (Sample of the Invention) | 1/10 | " | +0.02 | 17.1 | 16.9 | 56 | 0.01 |
| 124 (Sample of the Invention) | 1/13 | " | +0.01 | 17.5 | 17.1 | 56 | 0.01 |

EXAMPLE 2

Emulsions (12) and (13) were prepared in the same manner as in Example 1, except that Compound (18) of the present invention was not used in shelling Emulsions (a) and (c) for preparing Emulsions (1) and (3), respectively, and that the pAg value was varied to 7.5. (See Table A below.)

Sample No. 201

Sample No. 201 was prepared in the sa e manner as Sample No. 101, except that Emulsion (1) in the fifth layer was replaced by Emulsion (11).

Samples No. 202 to 206

Samples Nos. 202 to 206 were prepared in the same manner as Sample No. 201, except that Yellow Colored Couplers (YC-1), (YC-25), (YC-30), (YC-32) and (YC-47) of the present invention were added to the third, fourth and fifth layers of Sample No. 201 in an amount of 0.040 g/m$^2$, 0.050 g/m$^2$ and 0.020 g/m$^2$, respectively.

Samples Nos. 207 to 214

Samples Nos. 207 to 214 were prepared in the same manner as Samples Nos. 201 to 206, respectively, except that Emulsion (11) was replaced by Emulsion (12), (1) or (3).

Samples Nos. 215 to 217

Samples Nos. 215, 216 and 217 were prepared in the same manner as Sample No. 204, except that the preferred Compound (11) was added to the sixth layer in an amount of 0.009 g/m$^2$ (No. 215), Compound (18) was added to the same in an amount of 0.003 g/m$^2$ (No. 216) and Compound (11) (0.006 g/m$^2$) and Compound (18) (0.001 g/m$^2$) were added to the same layer (Sample No. 217).

These samples were processed and evaluated in the same manner as in Example 1, whereupon color development of the samples were effected as indicated below.

The results obtained are shown in Table 2 below. As is obvious from the results in Table 2, all the samples of the present invention were superior to any other comparative samples with respect to their sensitivity, sharpness, graininess and color reproducibility. Additionally, it is further noted therefrom that addition of the compound of formula (A) of the invention causes further elevation and improvement of the sensitivity and graininess of the photographic materials.

TABLE 2

| Sample No. | Emulsion in 5th Layer | Yellow Colored Coupler in 3rd, 4th & 5th Layers | Compound of Formula (A) | Relative Sensitivity | RMS (fog + 0.2) | RMS (fog + 0.6) | MTF Cyan Image (25 cycle/mm) | Color Turbidity |
|---|---|---|---|---|---|---|---|---|
| 201 | 11 | — | — | 0.00 | 16.8 | 16.8 | 51 | 0.15 |

TABLE 2-continued

| Sample No. | Emulsion in 5th Layer | Yellow Colored Coupler in 3rd, 4th & 5th Layers | Compound of Formula (A) | Relative Sensitivity | RMS (fog + 0.2) | RMS (fog + 0.6) | MTF Cyan Image (25 cycle/mm) | Color Turbidity |
|---|---|---|---|---|---|---|---|---|
| (Comparative Example) | | | | | | | | |
| 202 (Example of the Invention) | " | YC-1 | — | 0.02 | 17.0 | 16.9 | 54 | 0.02 |
| 203 (Example of the Invention) | " | YC-25 | — | 0.02 | 17.0 | 16.9 | 54 | 0.02 |
| 204 (Example of the Invention) | " | YC-30 | — | 0.02 | 17.0 | 16.9 | 54 | 0.02 |
| 205 (Example of the Invention) | " | YC-32 | — | 0.01 | 16.9 | 16.9 | 54 | 0.04 |
| 206 (Example of the Invention) | " | YC-47 | — | 0.00 | 16.9 | 17.1 | 53 | 0.06 |
| 207 (Comparative Example) | 12 | — | — | 0.01 | 17.1 | 16.7 | 52 | 0.15 |
| 208 (Example of the Invention) | 12 | YC-1 | — | 0.03 | 17.3 | 16.8 | 54 | 0.02 |
| 209 (Example of the Invention) | 12 | YC-25 | — | 0.03 | 17.3 | 16.8 | 54 | 0.02 |
| 210 (Example of the Invention) | " | YC-30 | — | 0.03 | 17.3 | 16.8 | 54 | 0.02 |
| 211 (Example of the Invention) | " | YC-32 | — | 0.02 | 17.1 | 17.0 | 54 | 0.04 |
| 212 (Example of the Invention) | " | YC-47 | — | 0.01 | 17.1 | 17.2 | 53 | 0.06 |
| 213 (Example of the Invention) | 1 | YC-30 | (18) | 0.04 | 16.6 | 16.5 | 54 | 0.02 |
| 214 (Example of the Invention) | 3 | " | (18) | 0.05 | 16.8 | 16.4 | 54 | 0.02 |
| 215 (Example of the Invention) | 11 | " | (11) | 0.04 | 16.6 | 16.5 | 54 | 0.02 |
| 216 (Example of the Invention) | " | " | (18) | 0.05 | 16.7 | 16.4 | 54 | 0.02 |
| 217 (Example of the Invention) | " | " | (11)/(18) | 0.05 | 16.7 | 16.4 | 54 | 0.02 |

Development of the samples was effected in accordance with the following procedure, using a processing machine for motion picture film.

Specifically, the samples were imagewise exposed and then continuously developed with the color developer having the composition mentioned below with replenishing a replenisher thereto, until the total amount of the replenisher as replenished to the processing tank became three times of the capacity of the mother solution tank. Using the thus fatigued (aged) developer, the samples to be subjected to evaluation of the properties thereof were then developed.

| Step | Processing Time | Processing Temp. | Amount of Replenisher* | Tank Capacity |
|---|---|---|---|---|
| | Processing Method | | | |
| Color Development | 2 min 20 sec | 44.0° C. | 23 ml | 15 liters |
| Bleaching | 50 sec | 38.0° C. | 5 ml | 5 liters |
| Bleach-Fixation | 50 sec | 38.0° C. | — | 5 liters |
| Fixation | 50 sec | 38.0° C. | 16 ml | 5 liters |
| Rinsing (1) | 30 sec | 38.0° C. | — | 3 liters |
| Rinsing (2) | 20 sec | 38.0° C. | 34 ml | 3 liters |
| Stabilization | 20 sec | 38.0° C. | 20 ml | 3 liters |
| Drying | 1 min | 55° C. | | |

*Amount of replenisher is per meter of 35 mm-wide sample.

Rinsing was effected by countercurrent system from the rinsing tank (2) to the rinsing tank (1). All the overflow from the rinsing tank was recirculated to the fixing bath. The tap of the bleaching tank was connected to the bottom of the bleach-fixing tank via a pipe, and the top of the fixing tank to the bottom of the bleach-fixing tank also via a pipe. Accordingly, all the overflows from the bleaching tank and the fixing tank to be caused by replenishment of replenishers thereto were introduced into the bleach-fixing bath. Replenishment to the bleach-fixing bath was effected in this way. The amount of the carryover of the developer to the next bleaching step, that of the bleaching solution to the next bleach-fixing step, that of the bleach-fixing solution to the next fixing step, and that of the fixing solution to the next rinsing step were 2.5 ml, 2.0 ml, 2.0 ml and 2.0 ml, respectively, per meter of the 35 mm-wide photographic material being processed. In the process, the crossover time was always 5 seconds, and this period is included in the processing time of the previous step. All the processing bathes had a means of applying a jet stream of the processing solution to the emulsion-coated surface of the photographic material being processed, in accordance with the method described in JP-A-62-183460.

Compositions of the processing solutions used herein are mentioned below.

| | Mother Solution (g) | Replenisher (g) |
|---|---|---|
| Developer: | | |
| Diethylenetriaminepentaacetic Acid | 2.0 | 2.2 |
| 1-Hydroxyethylidene-1,1-diphosphonic Acid | 3.3 | 3.3 |
| Sodium Sulfite | 3.9 | 5.2 |
| Potassium Carbonate | 37.5 | 39.0 |
| Potassium Bromide | 1.4 | 0.4 |
| Potassium Iodide | 1.3 mg | — |
| Hydroxylamine Sulfate | 2.4 | 3.3 |
| 2-Methyl-4-[N-ethyl-N-(β-hydroxyethyl)amino]aniline Sulfate | 4.5 | 6.1 |
| Water to Make | 1.0 liter | 1.0 liter |
| pH | 10.05 | 10.15 |
| Bleaching Solution: | | |
| Ammonium 1,3-Propylenediaminetetraacetato/Fe(III) Monohydrate | 144.0 | 206.0 |
| Ammonium Bromide | 84.0 | 120.0 |
| Ammonium Nitrate | 17.5 | 25.0 |
| Hydroxyacetic Acid | 63.0 | 90.0 |
| Acetic Acid | 33.2 | 47.4 |
| Water to make | 1.0 liter | 1.0 liter |
| pH (adjusted with aqueous ammonia) | 3.20 | 2.80 |

Bleach-Fixing Solution (mother solution):

The bleaching solution (mother solution) mentioned above and the fixing solution (mother solution) mentioned below were blended in a proportion of 15/85.

| Fixing Solution: | Mother Solution (g) | Replenisher (g) |
|---|---|---|
| Ammonium Sulfite | 19.0 | 57.0 |
| Ammonium Thiosulfate (aqueous solution, 700 g/liter) | 280 ml | 840 ml |
| Imidazole | 28.5 | 85.5 |
| Ethylenediaminetetraacetic Acid | 12.5 | 37.5 |
| Water to make | 1.0 liter | 1.0 liter |
| pH | 7.40 | 7.45 |
| (pH was adjusted with aqueous ammonia and acetic acid.) | | |

Rinsing Water:

Mother solution and replenisher were same.

Tap water was passed through a mixed bed type column as filled with an H-type strong acidic cation-exchange resin (Amberlite IR120B, produced by Rhom & Haas Co.) and an OH-type strong basic anion-exchange resin (Amberlite IRA-400, produced by Rhom & Haas Co.) so that both the calcium ion concentration and the magnesium ion concentration in the water were reduced to 3 mg/liter, individually. Next, 20 ml/liter of sodium dichloroisocyanurate and 150 mg/liter of sodium sulfate were added to the resulting water, which had a pH value falling within the range of from 6.5 to 7.5. This was used as the rinsing water.

| Stabilizing Solution: | |
|---|---|
| Mother solution and replenisher were same. | |
| Formalin (37%) | 2.0 ml |
| Polyoxyethylene-p-monononylphenyl Ether (mean polymerization degree 10) | 0.3 g |

EXAMPLE 3

Yellow Colored Cyan Coupler (YC-26), (YC-27), (YC-28), (YC-29) or (YC-30) of the present invention was added to the third, fourth and fifth layers of Sample No. 110 of JP-A-1-269335, in an amount of 0.03 g/m$^2$ in each layer. The resulting sample was processed and evaluated in the same manner as in Example 1. As a result, the processed sample gave good color reproducibility and sharpness.

Next, Yellow Colored Cyan Coupler (YC-26), (YC-28), (YC-30) or (YC-31) of the present invention was added to the fourth and fifth layers of Sample No. 2 of JP-A-1-269335, in an amount of 0.040 g/m$^2$ in each layer. The resulting sample was processed and evaluated in the same manner as in Example 1. As a result, the processed sample gave good color reproducibility and sharpness.

Characteristic values of Emulsions (A) to (I) are shown in Table (B) below.

Ex-1:
-continued
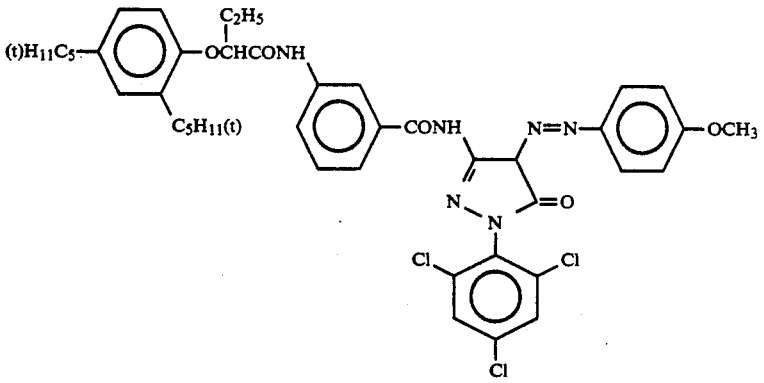
Ex-2:
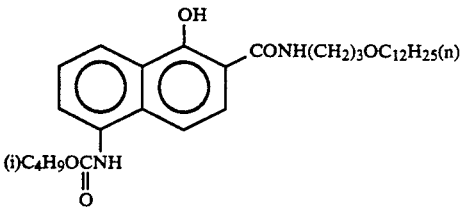
EX-3:
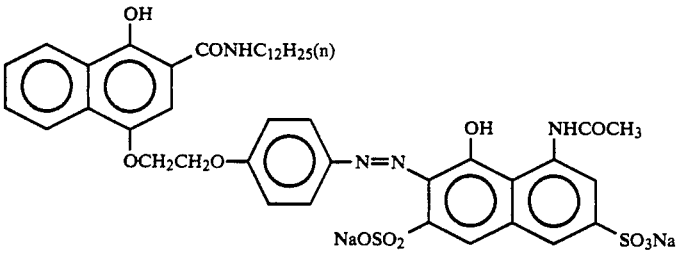
EX-4:
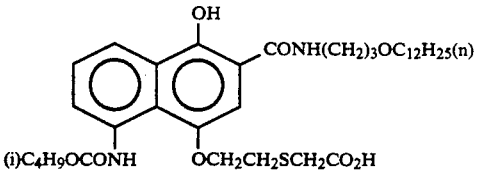
EX-5:
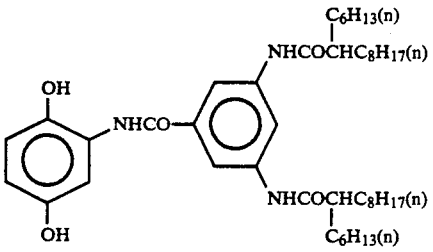
EX-6:

-continued
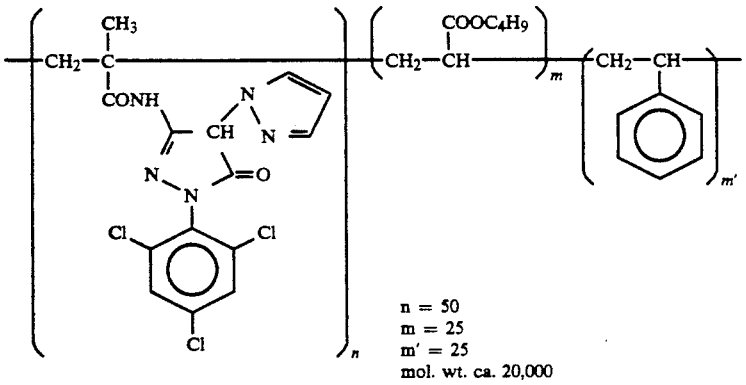
EX-7:
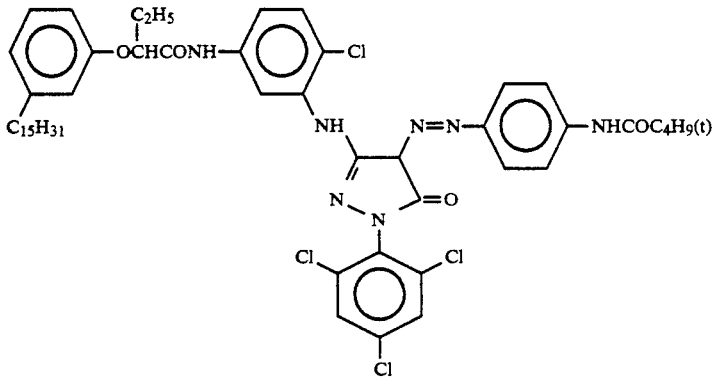
EX-8:
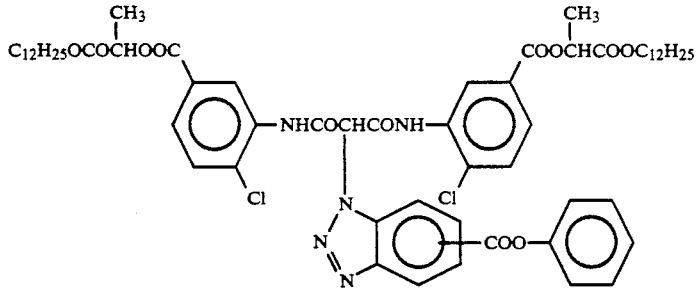
EX-9:
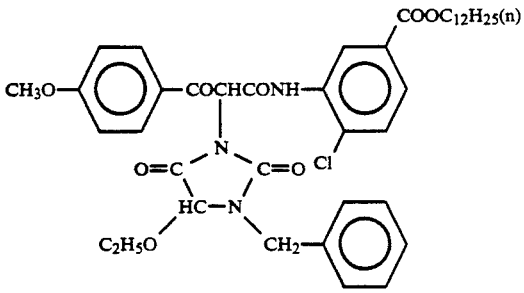
EX-10:

-continued
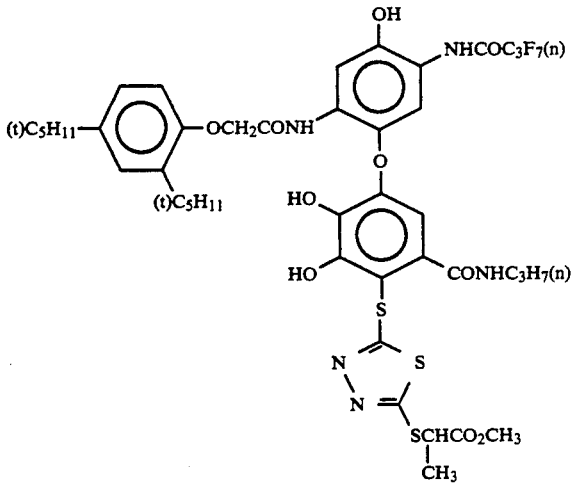
EX-11:
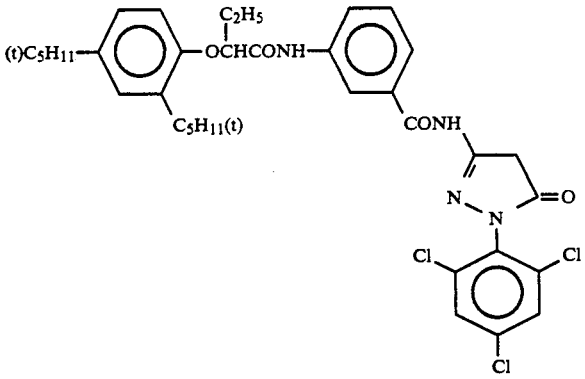
EX-12:
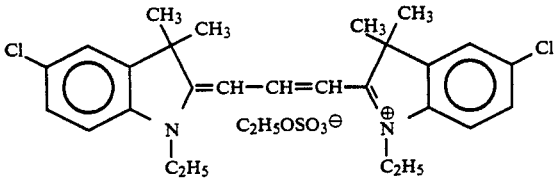
EX-13:
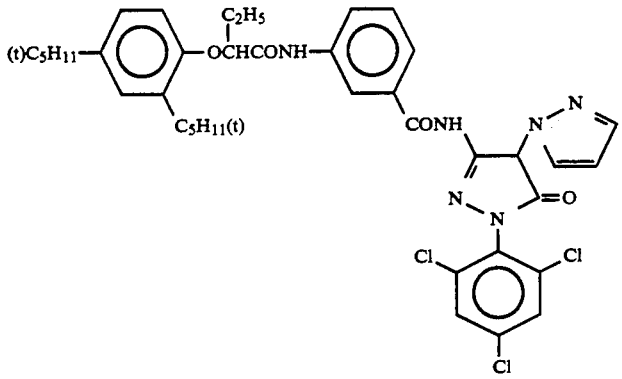
U-1:

-continued
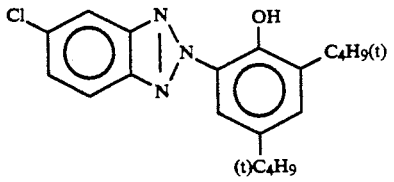
U-2:
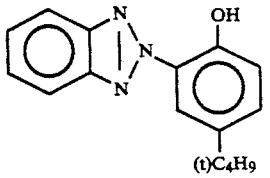
U-3:
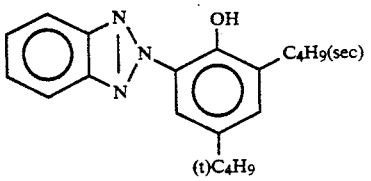
U-4:
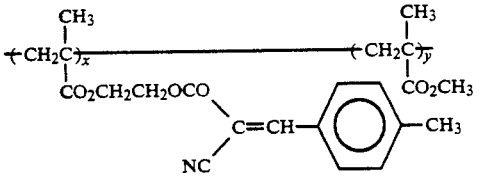
x:y = 70:30 (wt %)
U-5:
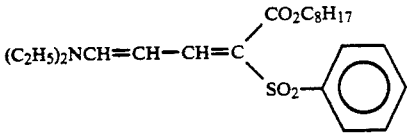
HBS-1:
Tricresyl Phosphate
HBS-2:
N-n-butyl Phthalate
HBS-3:
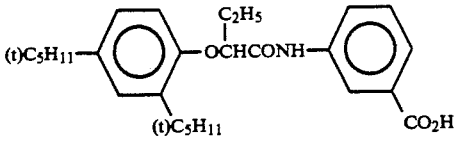
Sensitizing Dye I:
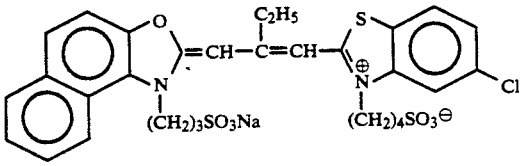
Sensitizing Dye II:

-continued
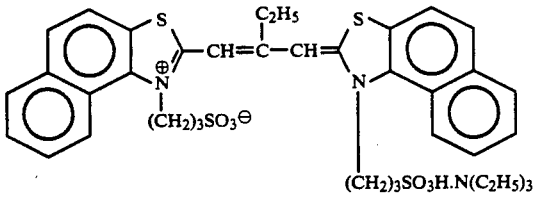
Sensitizing Dye III:
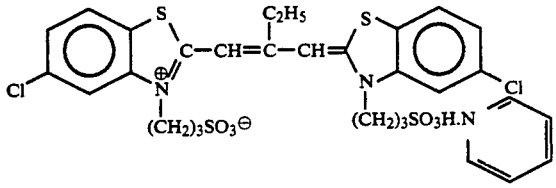
Sensitizing Dye V:
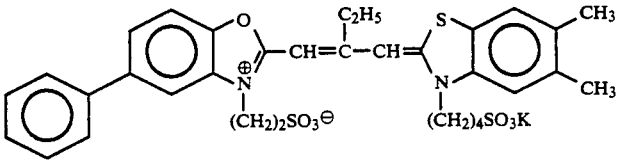
Sensitizing Dye VI:
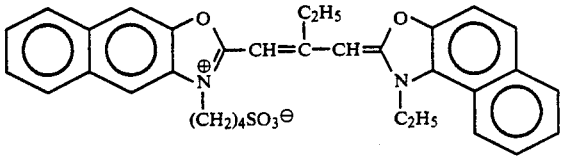
Sensitizing Dye VII:
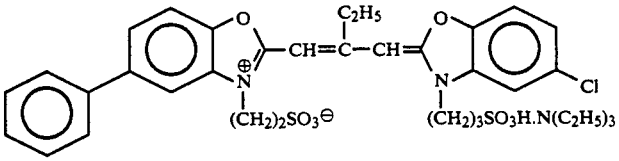
Sensitizing Dye VIII:
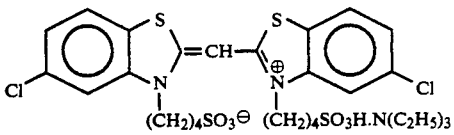
S-1:
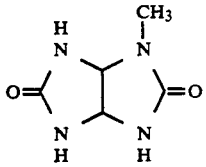
H-1:
$CH_2{=}CH{-}SO_2{-}CH_2{-}CONH{-}CH_2$
$CH_2{=}CH{-}SO_2{-}CH_2{-}CONH{-}CH_2$
B-1:
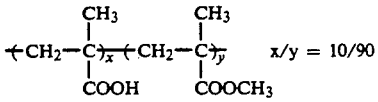
x/y = 10/90

-continued
B-2:
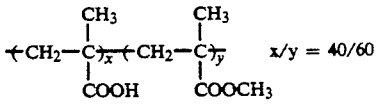
x/y = 40/60
B-3:
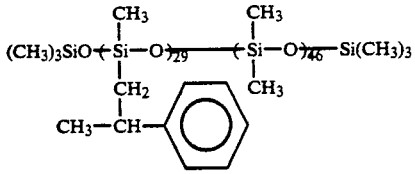
B-4:
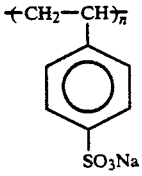
B-5:
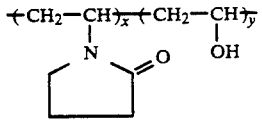
x/y = 70/30
W-1:
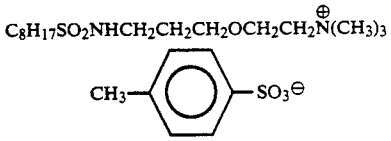
W-2:
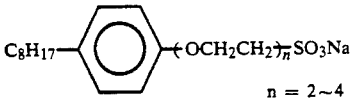
n = 2~4
W-3:
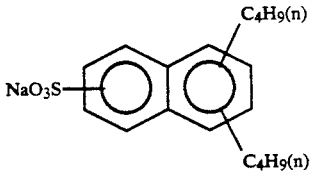
F-1:
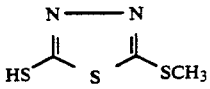
F-2:
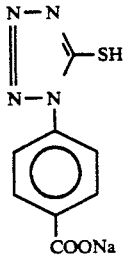
F-3:

-continued
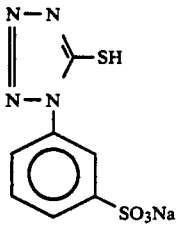
F-4:
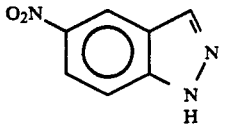
F-5:
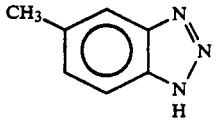
F-6:
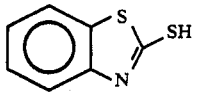
F-7:
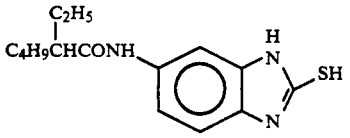
F-8:
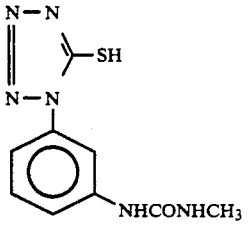
F-9:
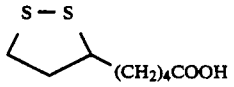
F-10:
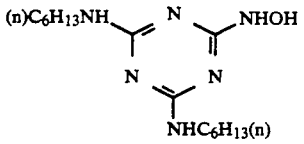
F-11:
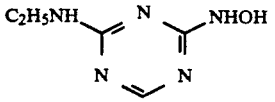
F-12:

-continued

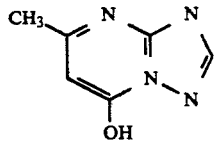

F-13:

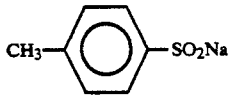

TABLE (A)

| Emulsion | AgI Content (mol %) Core | Shell | Molar Ratio (Core/Shell) of Ag Content | Mean AgI Content (mol %) | Distinct Layered Structure | Mean Grain Size (μm) | Fluctuation Coefficient of Grain Size | Aspect Ratio | Compound of Formula (A) |
|---|---|---|---|---|---|---|---|---|---|
| 1 | 42 | 0 | 1/2 | 14.0 | YES | 0.88 | 0.20 | 2.0 | (18) |
| 2 | 42 | 0 | 1/2.5 | 12.0 | " | 0.86 | 0.19 | 1.9 | " |
| 3 | 42 | 0 | 1/3.2 | 10.0 | " | 0.86 | 0.19 | 1.9 | " |
| 4 | 42 | 0 | 1/4 | 8.4 | " | 0.88 | 0.18 | 1.8 | " |
| 5 | 42 | 0 | 1/6 | 6.0 | " | 0.87 | 0.18 | 1.6 | " |
| 6 | 42 | 0 | 1/2 | 14.0 | NO | 0.89 | 0.21 | 2.2 | — |
| 7 | 42 | 0 | 1/2.5 | 12.0 | " | 0.87 | 0.20 | 2.0 | — |
| 8 | 42 | 0 | 1/3.2 | 10.0 | " | 0.86 | 0.20 | 2.0 | — |
| 9 | 42 | 0 | 1/4 | 8.4 | " | 0.87 | 0.19 | 1.9 | — |
| 10 | 42 | 0 | 1/3.2 | 10.0 | YES | 0.87 | 0.22 | 2.0 | (18) |
| 11 | 42 | 0 | 1/3.2 | 10.0 | " | 0.87 | 0.27 | 2.2 | " |
| 12 | 42 | 0 | 1/2 | 14.0 | " | 0.89 | 0.21 | 1.9 | — |
| 13 | 42 | 0 | 1/3.2 | 10.0 | " | 0.88 | 0.21 | 1.8 | — |

TABLE (B)

| | Mean AgI Content | Mean Grain Size | Fluctuation Coefficient of Grain Size | Aspect Ratio | Ratio of Silver Content (AgI Content %) | Distinct Layered Structure |
|---|---|---|---|---|---|---|
| Emulsion A | 4.0 | 0.45 | 27 | 1 | Core/Shell = 1/3 (3/1), two-layered structure grains | YES |
| Emulsion B | 6.0 | 0.70 | 14 | 1 | Core/Shell = 1/2 (18/0), two-layered structure grains | YES |
| Emulsion C | 6.0 | 0.75 | 30 | 2 | Core/Shell = 2/1 (9/0), two-layered structure grains | YES |
| Emulsion D | 6.0 | 1.05 | 35 | 2 | Core/Shell = 1.1 (12/0), two-layered structure grains | YES |
| Emulsion E | 6.0 | 1.05 | 35 | 3 | Core/Shell = 1/2 (18/0), two-layered structure grains | YES |
| Emulsion F | 4.0 | 0.25 | 28 | 1 | Core/Shell = 1/3 (13/1), two-layered structure grains | YES |
| Emulsion G | 6.0 | 0.75 | 25 | 2 | Core/Shell = 1/2 (18/0), two-layered structure grains | YES |
| Emulsion H | 6.0 | 1.30 | 25 | 3 | Core/Shell = 1/1 (12/0), two-layered structure grains | YES |
| Emulsion I | 1.0 | 0.07 | 15 | 1 | Uniform grains | NO |

While the invention has been described in detail and with reference to specific embodiments thereof, it will be apparent to one skilled in the art that various changes and modifications can be made therein without departing from the spirit and scope thereof.

What is claimed is:

1. A solution-developable silver halide color photographic material having at least one light-sensitive emulsion layer on a support, the material comprising at least one yellow colored cyan coupler, the emulsion layer containing chemically sensitized silver halide grains, and the chemically sensitized silver halide grains in the emulsion having a silver iodobromide phase with a silver iodide content of from 15 to 45 mol % as a distinct layered structure and having a silver iodide content of more than 7 mol % based on the whole grain, wherein the yellow colored cyan coupler is capable of releasing a residue of a compound containing a water-soluble 6-hydroxy-2-pyridon-5-ylazo group, a water-soluble 2-acylaminophenylazo group or a water-soluble 2-sulfonamidophenylazo group, by coupling with the oxidation product of an aromatic primary amine developing agent.

2. The solution-developable silver halide color photographic material as in claim 1, wherein the yellow colored cyan coupler is one selected from compounds of the following formulae (CI) and (CII):

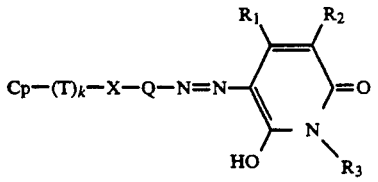

(CI)

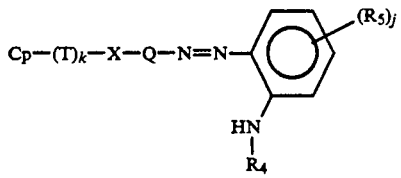

(CII)

wherein

Cp represents a cyan coupler residue where T is bonded to the coupling position of the residue;

T represents a timing group;

k represents an integer of 0 to 1;

X represents a divalent linking group which contains an N, O, or S atom and which is bonded to $(T)_k$ via that N, O or S atoms to link $(T)_k$ and Q;

Q represents an arylene group or a divalent heterocyclic group;

$R_1$ and $R_2$ independently represent a hydrogen atom, a carboxyl group, a sulfo group, a cyano group, an alkyl group, a cycloalkyl group, an aryl group, a heterocyclic group, a carbamoyl group, a sulfamoyl group, a carbon-amido group, a sulfonamido group or an alkylsulfonyl group;

$R_3$ represents a hydrogen atom, an alkyl group, a cycloalkyl group, an aryl group or a heterocyclic group; provided that at least one of T, X, Q, $R_1$, $R_2$ and $R_3$ in formula (CI) contains a water-soluble group;

$R_4$ represents an acyl group or a sulfonyl group;

$R_5$ represents a substitutable group;

j represents an integer of from 0 to 4, and when j is an integer of 2 or more, the plurality of $R_4$ groups may be the same or different;

provided that at least one of T, X, Q, and $R_4$ and $R_5$ in formula (CII) contains a water-soluble group.

3. The solution-developable silver halide color photographic material as in claim 2, wherein the yellow colored cyan coupler is the compound of formula (CI):

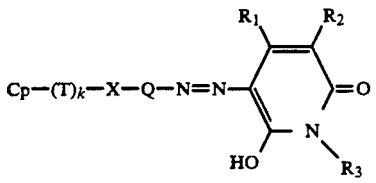

(CI)

wherein Cp, T, k, X, Q, and $R_1$ to $R_3$ are as defined in claim 2.

4. The solution-developable silver halide color photographic material as in claim 2, wherein Cp in formulae (CI) to (CIV) is a coupler residue of anyone of the following formulae (Cp-6), (Cp-7) and (Cp-8):

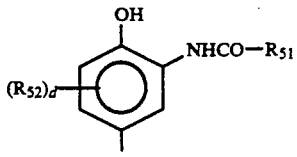

(Cp-6)

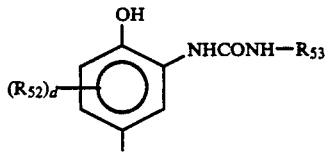

(Cp-7)

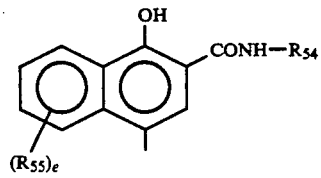

(Cp-8)

wherein the free bond as derived from the coupling position is the position to which the coupling split-off group is bonded;

$R_{51}$ represents $R_{42}$—;

$R_{52}$ represents $R_{41}$—, $R_{41}(R_{43})CON$—, $R_{41}O(R_{43})CON$—, $R_{41}SO_2(R_{43})N$—, $R_{43}N(R_{44})CO$—$N(R_{45})$—, $R_{41}O$—, $R_{41}S$—, a halogen atom, or $R_{41}(R_{43})N$—;

d represents from 0 to 3; and when d is a plural number, the plurality of $R_{52}$ groups may be same or different substituents;

the $R_{52}$ groups may be bonded to each other as divalent groups to form a cyclic structure;

$R_{53}$ represents $R_{41}$, $R_{41}OCONH$—, $R_{41}SO_2NH$—, $R_{43}N(R44)$—$CON(R_{45})$—, $R_{43}N(R_{44})$—$SO_2$—$N(R_{45})$—, $R_{43}O$—, $R_{41}S$—, a halogen atom or $R_{41}N(R_{43})$—;

where formula (Cp-8) has plural $R_{55}$ group s, they may be same or different; $R_{41}$ represents an aliphatic group, an aromatic group or a heterocyclic group;

$R_{42}$ represents an aromatic group or a heterocyclic group; and $R_{43}$, $R_{44}$ and $R_{45}$ independently represent a hydrogen atom, an aliphatic group, an aromatic group or a heterocyclic group.

5. The solution-developable silver halide color photographic material as in claim 2, wherein T in formulae (CI) to (CIV) is a timing group of anyone of the following formulae (T-1) to (T-7):

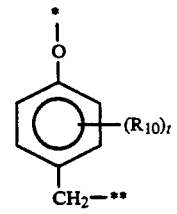

(T-1)

-continued (T-2)

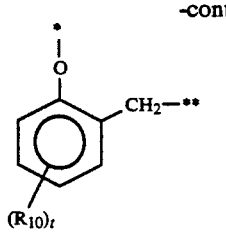

(T-3)

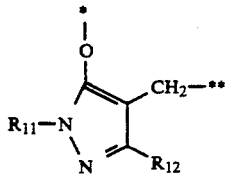

(T-4)

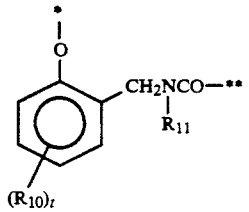

(T-5)

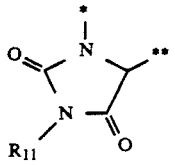

*—$OCH_2$—* (T-6)

(T-7)

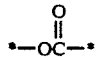

wherein $R_{10}$ represents a group substitutable on the benzene ring; $R_{11}$ has the same meaning as $R_{41}$; $R_{12}$ represents a hydrogen atom or a substituent; and t represents an integer of from 0 to 4.

6. The solution-developable silver halide color photographic material as in claim 2, wherein the chemically sensitized silver halide grains have a fluctuation coefficient of the grain size of 0.25 or less.

7. The solution-developable silver halide color photographic material as in claim 2, wherein one and the same light-sensitive emulsion layer contains two or more kinds of the chemically sensitized silver halide grains or contains one or more kinds of the chemically sensitized silver halide grains along with other silver halide grains.

8. The solution-developable silver halide color photographic material as in claim 2, which contains a compound of a general formula (A):

$$Q—SM_1 \quad (A)$$

wherein Q represents a heterocyclic ring residue having at least one member selected from the group consisting of $—SO_3M_2$, $—COOM_2$, —OH and $MR_{21}R_{22}$, as bonded to the residue either directly or indirectly; $M_1$ and $M_2$ independently represent a hydrogen atom, an alkali metal, a quaternary ammonium group, or a quaternary phosphonium group; and $R_{21}$ and $R_{22}$ independently represent a hydrogen atom, or a substituted or unsubstituted alkyl group.

9. The solution-developable silver halide color photographic material as in claim 8, wherein the mercapto-heterocyclic compound of formula (A) is selected from compounds of formula (B) and (C):

(B)

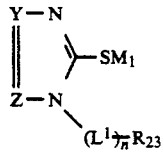

(C)

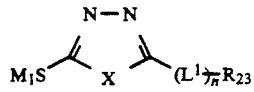

wherein

Y and Z independently represent a nitrogen atom or $$=\overset{|}{C}R_{24}$$

(where $R_{24}$ is a hydrogen atom, a substituted or unsubstituted alkyl group, or a substituted or unsubstituted aryl group;

$R_{23}$ represents an organic residue as substituted by at least one substituent selected from the group consisting of $—SO_3M_2$, $—COOM_2$, —OH and $—NR_{21}R_{22}$;

$L^1$ represents a linking group selected from the group consisting of —S—, —O—, $$—\overset{|}{N}—,$$

—CO—, —SO— and $—SO_2—$;

$M_1$ and $M_2$ have the same meanings as those defined in formula (A):

X represents a sulfur atom, an oxygen atom, or $—NR_{25}—$ (where $R_{25}$ is a hydrogen atom, a substituted or unsubstituted alkyl group, or a substituted or unsubstituted aryl group);

$L_2$ represents $—CONR_6—$, $—NR_6CO—$, $—SO_2NR_6—$, $—NR_6SO_2—$, —OCO—, —COO—, —S—, $—NR_6—$, —SO—, —OCOO—, $—NR_6CONR_7—$, $—NR_6COO—$, $—OCONR_6—$, or $—NR_6SO_2NR_7—$;

$R_6$ and $R_7$ independently represent a hydrogen atom, a substituted or unsubstituted alkyl group, or a substituted or unsubstituted aryl group; and $R_{23}$ and $M_2$ have the same meanings as those defined in formula (A).

10. The solution-developable silver halide color photographic material as in claim 1, wherein the chemically sensitized silver halide grains have a fluctuation coefficient of the grain size of 0.25 or less.

11. The solution-developable silver halide color photographic material as in claim 10, which contains a compound of a general formula (A):

$$Q—SM_1 \quad (A)$$

wherein Q represents a heterocyclic ring residue having at least one member selected from the group consisting of $—SO_3M_2$, $—COOM_2$, —OH and $MR_{21}R_{22}$, as bonded to the residue either directly or indirectly; $M_1$ and $M_2$ independently represent a hydrogen atom, an alkali metal, a quaternary ammonium group, or a quaternary phosphonium group; and $R_{21}$ and $R_{22}$ independently represent a hydrogen atom, or a substituted or unsubstituted alkyl group.

12. The solution-developable silver halide color photographic material as in claim 1, wherein one and the same light-sensitive emulsion layer contains two or more kinds of the chemically sensitized silver halide grains or contains or more kinds of the chemically sensitized silver halide grains along with other silver halide grains.

13. The solution-developable silver halide color photographic material as in claim 12, which contains a compound of a general formula (A):

$$Q—SM_1 \quad (A)$$

wherein Q represents a heterocyclic ring residue having at least one member selected from the group consisting of $—SO_3M_2$, $—COOM_2$, —OH and $MR_{21}R_{22}$, as bonded to the residue either directly or indirectly; $M_1$ and $M_2$ independently represent a hydrogen atom, an alkali metal, a quaternary ammonium group, or a quaternary phosphonium group; and $R_{21}$ and $R_{22}$ independently represent a hydrogen atom, or a substituted or unsubstituted alkyl group.

* * * * *